US005742688A

United States Patent [19]

Ogawa et al.

[11] Patent Number: 5,742,688

[45] Date of Patent: Apr. 21, 1998

[54] SOUND FIELD CONTROLLER AND CONTROL METHOD

[75] Inventors: Michiko Ogawa, Osaka; Akihisa Kawamura, Hirakata; Masaharu Matsumoto, Katano; Toshihiko Date, Yamatokoriyama; Tadashi Tamura, Toyonaka; Yasutoshi Nakama, Ikoma, all of Japan

[73] Assignee: Matsushita Electric Industrial Co., Ltd., Osaka, Japan

[21] Appl. No.: 383,295

[22] Filed: Feb. 3, 1995

[30] Foreign Application Priority Data

| | | | |
|---|---|---|---|
| Feb. 4, 1994 | [JP] | Japan | 6-032993 |
| Apr. 11, 1994 | [JP] | Japan | 6-098040 |
| Apr. 15, 1994 | [JP] | Japan | 6-102114 |

[51] Int. Cl.[6] ..... H04R 5/00

[52] U.S. Cl. ..... 381/17; 381/61

[58] Field of Search ..... 381/17, 1, 18, 381/60, 63, 61

[56] References Cited

U.S. PATENT DOCUMENTS

| | | | |
|---|---|---|---|
| 4,308,423 | 12/1981 | Cohen . | |
| 4,394,536 | 7/1983 | Shima et al. . | |
| 4,569,074 | 2/1986 | Polk . | |
| 4,589,128 | 5/1986 | Pfleiderer . | |
| 4,792,974 | 12/1988 | Chace . | |
| 4,868,878 | 9/1989 | Kunugi et al. . | |
| 4,873,722 | 10/1989 | Tominari . | |
| 5,027,403 | 6/1991 | Short et al. . | |
| 5,105,462 | 4/1992 | Lowe et al. | 381/17 |
| 5,146,507 | 9/1992 | Satoh et al. | 381/63 |
| 5,285,503 | 2/1994 | Satoh et al. | 381/17 |
| 5,371,799 | 12/1994 | Lowe et al. | 381/17 |
| 5,386,082 | 1/1995 | Higashi | 381/17 |
| 5,467,401 | 11/1995 | Nagamitsu et al. | 381/17 |
| 5,555,310 | 9/1996 | Minami et al. | 381/17 |

FOREIGN PATENT DOCUMENTS

| | | |
|---|---|---|
| 0553832 | 8/1993 | European Pat. Off. . |
| 1-109997 | 4/1989 | Japan . |
| 1-279698 | 11/1989 | Japan . |
| WO 94/24836 | 10/1994 | WIPO . |

OTHER PUBLICATIONS

European Search Report dated Sep. 23, 1997.

Y. Matsushita et al., "A Digital Audio Signal Processor for Sound Field Controls", IEEE Transactions on Consumer Electronics, vol. 37, No. 1, pp.28–31, Feb., 1991.

*Primary Examiner*—Curtis Kuntz
*Assistant Examiner*—Vivian Chang
*Attorney, Agent, or Firm*—Ratner & Prestia

[57] ABSTRACT

A sound field controller of the invention reproduces a sound field which provides a distance perspective depending on a position of a sound image for a listener. The sound field controller includes: an A/D converter; a signal processing section for processing the digital signal using predetermined parameters, and generating a sound signal; an input device for inputting conditions which include a position of a sound image to be localized and a distance from a listener; a parameter controller for setting the parameters in the signal processing section so that the sound signal has characteristics in accordance with the input conditions; a D/A converter; and a reproducing unit for amplifying and reproducing the signal output from the D/A converter.

24 Claims, 45 Drawing Sheets

FIG.14A Left
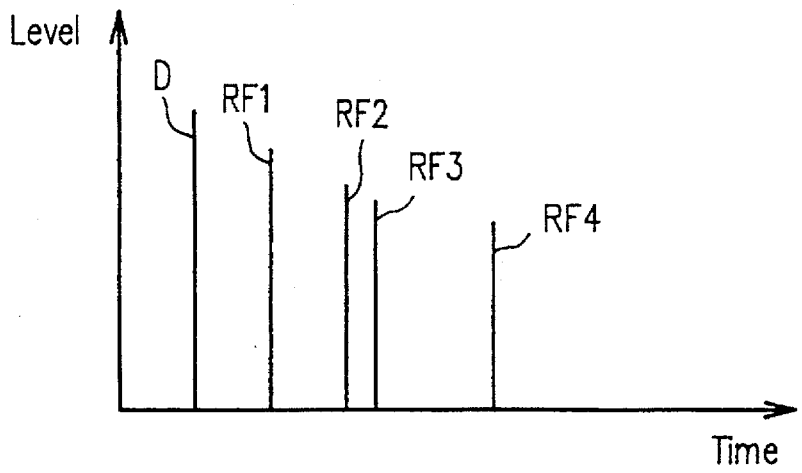
FIG.14B Right
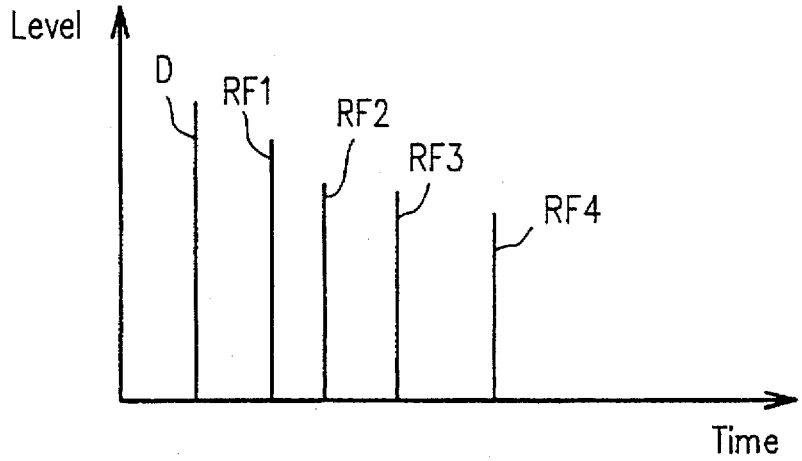

PRIOR ART

PRIOR ART

PRIOR ART

PRIOR ART

PRIOR ART

SOUND FIELD CONTROLLER AND CONTROL METHOD

BACKGROUND OF THE INVENTION

1. Field of the Invention

The present invention relates to a sound field controller for use in audio-visual (AV) equipment, and a method used in such a sound field controller. More particularly, the present invention relates to a sound field controller for sound reproduction with a sense of presence by controlling the distance perspective and the sense of expansion of a sound image, and with superior reproduction frequency characteristics.

2. Description of the Related Art

In recent years, as VTRs (video tape recorders) have become a common household item, a large-screened display and a sound reproduction system giving a sense of presence are desired to enjoy music as well as movies on video tapes at home, thereby giving rise to the requirement of corresponding hardware development.

FIG. 41 shows an example of a conventional sound field controller 400 which controls the distance perspective. As shown in FIG. 41, the sound field controller 400 includes a signal input device 401 for inputting an audio signal, a gain controller 402, a pair of amplifiers 403*a* and 403*b*, a pair of loudspeakers 405*a* and 405*b*, and a distance input device 404. The distance input device 404 is connected to the gain controller 402. Signal levels in two channels are changed depending on the distance by the distance input device 404, so as to control the distance perspective for the sound image which is received by a listener.

The conventional sound field controller 400 having the above-described construction will be described below.

A signal input through the signal input device 401 is applied to the gain controller 402. The gain controller 402 controls the level of the input signal so that the input signal can be reproduced from the loudspeakers 405*a* and 405*b* at a sound volume which reflects the distance input from the distance input device 404. In general, as the sound volume of a signal to be reproduced is increased, the position of the sound source is felt to be nearer. On the other hand, as the sound volume is decreased, the position of the sound source is felt to be farther. According to the sound field controller 400, the gain controller 402 controls the sound volume of the reproduced signal, so that the distance perspective from the sound source which is felt by the listener is controlled. The signal having a level which is controlled by the gain controller 402 is amplified by the amplifiers 403*a* and 403*b*, and then reproduced from the loudspeakers 405*a* and 405*b*. By the above-described processing, it is possible to control the distance perspective felt by the listener.

However, in the conventional sound field controller 400 having the above-described construction, the distance perspective is controlled using a direct sound only. Accordingly, even if the listener listens to the reproduced sound at a suitable position, the listener has a strange feeling that the reproduced distances are different from the actual distances. Moreover, the sound field controller 400 can give a proper distance perspective in the forward direction to the listener, but cannot realize a proper distance perspective in the backward and side directions.

An exemplary sound reproducing apparatus includes a loudspeaker system in which a horn or a sound tube for guiding a sound wave generated from a diaphragm is provided in a front face portion of the loudspeaker diaphragm. An example of such a loudspeaker system 450 is shown in FIGS. 42A and 42B.

FIGS. 42A and 42B are cross-sectional views showing the main portions of the structure of the loudspeaker system 450 used in the conventional sound reproducing apparatus. FIG. 42A shows a transverse cross section, and FIG. 42B shows a vertical cross section. As shown in FIGS. 42A and 42B, a loudspeaker unit 451 is attached at an opening of a back cavity 452. The back cavity 452 prevents a sound wave emitted from a back face of a diaphragm of the loudspeaker unit 451 from leaking out of the loudspeaker unit 451. A horn 453 is mounted on the back cavity 452 so that the horn 453 is positioned in front of the loudspeaker unit 451. As shown in. FIG. 42A, the horn 453 has a conical shape. Specifically, a transverse cross-sectional area of the horn 453 increases from the front face of the diaphragm of the loudspeaker unit 451 toward an opening 453*a*. As shown in FIG. 42B, a vertical cross-sectional area of the horn 453 decreases toward the opening 453*a*. The sound wave generated by the diaphragm of the loudspeaker unit 451 is emitted to the outside through a sound path portion 454, as a sound.

If the length L of the horn 453 is set to be sufficiently larger than the wavelength of the frequency band of the reproduced sound, the variation of acoustic impedance at the opening 453*a* becomes very small. Thus, superior matching can be attained for the acoustic impedance at the opening 453*a*. In such a case, the frequency characteristic of the reproduced sound pressure is flat, and an ideal loudspeaker system can be realized.

However, if such a loudspeaker system 450 is incorporated in AV equipment such as a television image receiver (hereinafter, referred to as a television set or a TV), it is actually impossible to set the length of the horn 453 to be sufficiently larger than the wavelength of the frequency band of the reproduced sound. Therefore, the reproduced sound pressure frequency characteristic of the general loudspeaker system using a horn includes a large number of peak dips, as shown in FIG. 43. This is because the acoustic impedance is drastically changed at the opening 453*a*, so that part of the sound wave emitted from the loudspeaker unit 451 is reflected from the opening 453*a*, and hence a resonance occurs in the sound path portion 454. The resonance causes a large number of peaks.

In a loudspeaker system having a sound tube having a substantially uniform cross-sectional area instead of the horn 453, this resonance also occurs, and hence a large number of peaks are caused in the reproduced sound pressure frequency characteristic. For example, the case where a sound tube 460 as shown in FIG. 44 is used is described. When the length of the sound tube 460 is denoted by L, and the sound velocity is denoted by C, the resonance occurs at the frequency which is denoted by f and represented as follows:

$$f=(2n-1)C/4L \quad (n=1,2,3,\ldots)$$

FIG. 44 shows the sound pressure distribution in the case of n=2.

FIG. 45 shows a loudspeaker system 470 using an absorbing material in order to realize a flat reproduced frequency characteristic with less peak dips (see for example, Japanese Patent Application No. 63-109343). The loudspeaker system 470 reduces the number of peaks by disposing an absorber 475 and a partition plate 476 on the side face of the sound path portion 474. However, in the case where the absorbing characteristic of the absorber 475 is not uniform, or in the case where a sufficient amount of absorber 475 is not disposed because of the shape of the loudspeaker system, the loudspeaker system 470 has a drawback in that the desired characteristic cannot be always obtained.

SUMMARY OF THE INVENTION

The sound field controller of this invention for reproducing a sound field provides a distance perspective depending on a position of a sound image for a listener. The sound field controller includes: an A/D converter for converting an input audio signal into a digital signal; a signal processing section for receiving the digital signal, processing the digital signal using predetermined parameters, and generating a sound signal; an input device for inputting conditions which include a position of a sound image to be localized and a distance from a listener; a parameter controller for setting the parameters in the signal processing section so that the sound signal has characteristics in accordance with the conditions; a D/A converter for converting the sound signal output from the signal processing section into an analog signal; and a reproduction reflection generator amplifying and reproducing the analog signal output from the D/A converter.

In one embodiment of the invention, the signal processing section includes: a direct sound processing section for receiving the digital signal and generating a direct sound signal by which a sound image of a direct sound is localized in a direction toward a sound source; a reflection sound processing section including a delay circuit for receiving the digital signal and delaying the digital signal in accordance with a reflection time of a reflection sound, and a reflection generator for generating a reflection sound signal by which a sound image of the reflection sound is localized in a direction in which the reflection sound is reflected; and an adder for adding the direct sound signal to the reflection sound signal.

In another embodiment of the invention, the reflection generator for generating a reflection sound signal includes a filter unit, and the parameter controller sets a delay time in the delay circuit and filter coefficients for the filter unit, based on the position of the sound image and the distance from the listener.

In another embodiment of the invention, the signal processing section further includes a summation ratio controller for continuously changing ratios of the direct sound signal and the reflection sound signal to be added.

In another embodiment of the invention, the signal processing section further includes a reverberation sound generator for adding a reverberation sound to a signal output from the adder, the conditions input from the input device further includes an expansion of a sound field, and the parameter controller sets a parameter for the reverberation sound generator based on the expansion of the sound field.

In another embodiment of the invention, the conditions input from the input device includes the position of the sound image, the distance from the listener, and an expansion of a sound field, and the signal processing section includes: a direct sound processing section for receiving the digital signal and generating a direct sound signal by which a sound image of a direct sound is localized in a direction toward a sound source; a reflection sound processing section including a delay circuit for receiving the digital signal and delaying the digital signal in accordance with a reflection time of a reflection sound, and a reflection generator for generating a reflection sound signal by which a sound image of the reflection sound is localized in a direction in which the reflection sound is reflected; a summation ratio controller for adding the direct sound signal to the reflection sound signal by continuously changing summation ratios thereof, and outputting a sum signal; and a reverberation sound generator for adding a reverberation sound to the sum signal output from the summation ratio controller.

In another embodiment of the invention, the signal processing section includes a frequency characteristic controller for changing frequency characteristics of the direct sound signal and the reflection sound signal.

In another embodiment of the invention, the input device is parameter receiving unit for receiving sound field control signals supplied from the outside of the sound field controller.

In another embodiment of the invention, the signal processing section includes: a direct sound processing section for receiving the digital signal and generating a direct sound signal; a reflection sound processing section including a plurality of delay circuit for receiving and delaying the digital signal in accordance with respective reflection times of a plurality of reflection sounds and generating a plurality of delay signals, and gain controller for outputting reflection sound signals by adjusting respective gains for the delay signals; and an adder for adding the direct sound signal to the reflection sound signals.

In another embodiment of the invention, the conditions include a side reflection angle which is formed by a direction of a reflection sound which reaches the listener after being emitted from a sound source and then reflected from a wall of an audio space with respect to a direction from the sound source to the listener, and the parameter controller converts the side reflection angle into a parameter of a position of a listener and/or a parameter of a position of a sound image, and inputs the parameter into the signal processing section.

According to another aspect of the invention, a sound reproducing apparatus in which a signal from a sound signal source is processed by a signal processing section, and the processed sound signal is reproduced from loudspeaker systems is provided. In the apparatus, each of the loudspeaker systems includes a horn for guiding a sound wave emitted from a front face of a diaphragm of a loudspeaker unit, and has a resonance frequency due to the horn, and the signal processing section includes a filter unit for receiving the signal, attenuating the resonance frequency components of the signal in a frequency band of a sound to be reproduced, and outputting a resulting sound signal.

According to another aspect of the invention, a sound reproducing apparatus in which a signal from a sound signal source is processed by a signal processing section, and the processed sound signal is reproduced from a loudspeaker system and rear loudspeakers, respectively, is provided. In the apparatus, the loudspeaker system includes loudspeaker units located on front left and front right sides of a listener, and horns for guiding sound waves emitted from front faces of diaphragms of the loudspeaker units, the loudspeaker system having a resonance frequency due to the horns, the rear loudspeakers are located on rear left and rear right sides of the listener, and the signal processing section includes a generator for generating a surround signal from the signals, and a filter unit for receiving the signal, attenuating the resonance frequency components of the signal in a frequency band of a sound to be reproduced, and outputting a resulting sound signal.

In one embodiment of the invention, the loudspeaker systems are located on front left and front right sides of a listener, and the signal processing section further includes a sound field control section for receiving the sound signal, converting the sound signal so that a sound image of the sound signal is localized at a desired position, and outputting the converted signal to the loudspeaker systems.

According to another aspect of the invention, a sound reproducing apparatus in which a signal from a sound signal source is processed by a signal processing section, and the processed sound signal is reproduced from a loudspeaker system and effect loudspeakers, respectively, is provided. In the apparatus, the loudspeaker system includes loudspeaker units located on front left and front right sides of a listener, and horns for guiding sound waves emitted from front faces of diaphragms of the loudspeaker units, the loudspeaker system having a resonance frequency caused by the horns, the effect loudspeakers are located on the outer left and right sides of the loudspeaker system, the effect loudspeakers reproducing an expansion sound, and the signal processing section includes a filter unit for receiving the signal, attenuating the resonance frequency components of the signal in a frequency band of a sound to be reproduced, and outputting a resulting sound signal to the loudspeaker system and the effect loudspeakers.

In one embodiment of the invention, the loudspeaker systems are located on front left and front right sides of a listener, and the signal processing section further includes a sound image expanding section for receiving the sound signal, converting the received sound signal so that a sound image of the sound signal is localized on front left and front right sides of the listener, and on outer left and right sides thereof, and outputting the converted signal to the loudspeaker systems, whereby an expanded sound including a moving sound is reproduced from the loudspeaker systems.

In another embodiment of the invention, the loudspeaker systems are located on front left and front right sides of a listener, and the signal processing section further includes a speech conversion section for receiving the sound signal, converting, when the received sound signal is judged to be a speech signal, a reproducing velocity of the speech signal, and outputting the speech signal to the loudspeaker systems.

In another embodiment of the invention, the loudspeaker systems are located on front left and front right sides of a listener, and the signal processing section includes: a speech detector for receiving the sound signal, judging whether the sound signal is a speech signal or a non-speech signal, and outputting the speech signal and the non-speech signal separately from each other; a sound field control section for receiving the non-speech signal, converting the non-speech signal so that a sound image of the non-speech signal is localized at a desired position, and outputting the converted signal; and an adder for receiving and adding the converted signal and the speech signal to each other, and outputting the added signal to the loudspeaker systems.

In another embodiment of the invention, the filter unit reduces a gain of the sound signal at the resonance frequency, so that a sound pressure of a reproduced sound at the resonance frequency of the loudspeaker systems is equal to or lower than a predetermined level.

In another embodiment of the invention, the loudspeaker systems are provided on side faces of a cathode-ray tube of a television image receiver, respectively.

In another embodiment of the invention, a cross-sectional area of the horn is increased from the front face of the diaphragm of the loudspeaker unit toward an opening from which the sound wave is emitted.

In another embodiment of the invention, a cross-sectional area of the horn is substantially uniform from the front face of the diaphragm of the loudspeaker unit toward an opening from which the sound wave is emitted.

According to another aspect of the invention, a sound field control method for reproducing a sound field which provides a distance perspective depending on a position of a sound image for a listener is provided. The method includes the steps of: converting an input audio signal into a digital signal; processing the digital signal using predetermined parameters, and generating a sound signal; setting conditions which include a position of a sound image to be localized and a distance from a listener; controlling the parameters used in the signal processing step so that the sound signal has characteristics in accordance with the conditions; converting the sound signal into an analog signal; and amplifying and reproducing the analog signal.

In one embodiment of the invention, the signal processing step includes the steps of: processing the digital signal so as to generate a direct sound signal for localizing a sound image of a direct sound in a direction toward a sound source; delaying the digital signal in accordance with a reflection time of a reflection sound, and processing the delayed digital signal so as to generate a reflection sound signal for localizing a sound image of the reflection sound in a direction in which the reflection sound is reflected; and adding the direct sound signal and the reflection sound signal.

In another embodiment of the invention, the step of generating a reflection sound signal includes a filtering step, and the step of controlling the parameters includes a step of setting a delay time of the digital signal and a step of setting filter coefficients for the filtering step, based on the position of the sound image and the distance from the listener.

In another embodiment of the invention, the signal processing step further includes a step of continuously changing summation ratios of the direct sound signal and the reflection sound signal to be added.

In another embodiment of the invention, the signal processing step further includes a step of adding a reverberation sound to a sum signal generated in the adding step, the conditions further includes an expansion of a sound field, and the parameter control step further includes a step of setting a parameter for the step of adding a reverberation sound based on the expansion of the sound field.

In another embodiment of the invention, the conditions includes the position of the sound image, the distance from the listener, and an expansion of a sound field, and the signal processing step includes the steps of: processing the digital signal so as to generate a direct sound signal for localizing a sound image of a direct sound in a direction toward a sound source; delaying the digital signal in accordance with a reflection time of a reflection sound, and processing the delayed digital signal so as to generate a reflection sound signal for localizing a sound image of the reflection sound in a direction in which the reflection sound is reflected; adding the direct sound signal and the reflection sound signal by continuously changing summation ratios thereof, and outputting a sum signal; and adding a reverberation sound signal to the sum signal in accordance with the expansion of the sound field.

In another embodiment of the invention, the signal processing step further includes a step of controlling frequency characteristics of the direct sound signal and the reflection sound signal.

In another embodiment of the invention, the signal processing step further includes a step of continuously changing summation ratios of the direct sound signal and the reflection sound signal to be added.

In another embodiment of the invention, the step of setting the conditions includes a step of receiving sound field control signals supplied from the outside of the sound field controller and a step of determining conditions based on the control signals.

In another embodiment of the invention, the signal processing step includes the steps of: processing the digital signal so as to generate a direct sound signal; delaying the digital signal in accordance with respective reflection times of a plurality of reflection sounds, generating a plurality of delay signals, and adjusting respective gains for the delay signals so as to generate reflection sound signals; and adding the direct sound signal and the reflection sound signals.

In another embodiment of the invention, the conditions include a side reflection angle which is formed by a direction of a reflection sound which reaches the listener after being emitted from a sound source and then reflected from a wall of an audio space with respect to a direction from the sound source to the listener, and in the step of controlling the parameters, the side reflection angle is converted into a parameter of a position of a listener and/or a parameter of a position of a sound image.

According to another aspect of the invention, a sound reproducing method including the steps of processing a signal from a sound signal source, and reproducing the processed sound signal from loudspeaker systems, each of the loudspeaker systems including a horn for guiding a sound wave emitted from a front face of a diaphragm of a loudspeaker unit, and each of the loudspeaker systems having a resonance frequency due to the horn is provided. In the method, the processing step includes a filtering step of receiving the signal, attenuating the resonance frequency components of the signal in a frequency band of a sound to be reproduced, and outputting a resulting sound signal.

In one embodiment of the invention, the loudspeaker systems are located on front left and front right sides of a listener, and the processing step further includes a sound field control step for converting the sound signal so that a sound image of the sound signal is localized at a desired position, and outputting the converted signal to the loudspeaker systems.

In another embodiment of the invention, the loudspeaker systems are located on front left and front right sides of a listener, and the signal processing step further includes a sound image expansion step of converting the received sound signal so that a sound image of the sound signal is localized on front left and front right sides of the listener, and on outer left and right sides thereof, and outputting the converted signal to the loudspeaker systems, whereby an expanded sound including a moving sound is reproduced from the loudspeaker systems.

In another embodiment of the invention, the loudspeaker systems are located on front left and front right sides of a listener, and the signal processing step further includes a speech conversion step of converting, when the sound signal is judged to be a speech signal, a reproducing velocity of the speech signal, and outputting the speech signal to the loudspeaker systems.

In another embodiment of the invention, the loudspeaker systems are located on front left and front right sides of a listener, and the signal processing step includes: a step of judging whether the sound signal is a speech signal or a non-speech signal, and outputting the speech signal and the non-speech signal separately from each other; a sound field control step of converting the non-speech signal so that a sound image of the non-speech signal is localized at a desired position, and outputting the converted signal; and a step of adding the converted signal and the speech signal to each other, and outputting the added signal to the loudspeaker systems.

In another embodiment of the invention, in the filtering step, a gain of the sound signal at the resonance frequency is reduced, so that a sound pressure of a reproduced sound at the resonance frequency of the loudspeaker systems is equal to or lower than a predetermined level.

Thus, the invention described herein makes possible the advantages of (1) providing a sound field controller and a sound field control method by which natural distance perspective and sense of expansion in all directions can be given, (2) providing a sound field controller which can reproduce a sound with high clarity without deteriorating the sound characteristics, while it is unnecessary to increase the length of a horn or a sound tube (hereinafter collectively referred to as a horn) of a loudspeaker system and it is unnecessary to dispose an absorber and a partition plate, and (3) providing a sound field controller which can clearly reproduce a speech signal and reproduce a sound with a sense of presence and natural expansion and which can be produced with a simple system construction at a low cost.

These and other advantages of the present invention will become apparent to those skilled in the art upon reading and understanding the following detailed description with reference to the accompanying figures.

BRIEF DESCRIPTION OF THE DRAWINGS

FIGS. 14A and 14B are graphs showing the relationships between a sound level of a reflection sound and a delay time in the sound field controller in Example 8.

DESCRIPTION OF THE PREFERRED EMBODIMENTS

Figure 1:
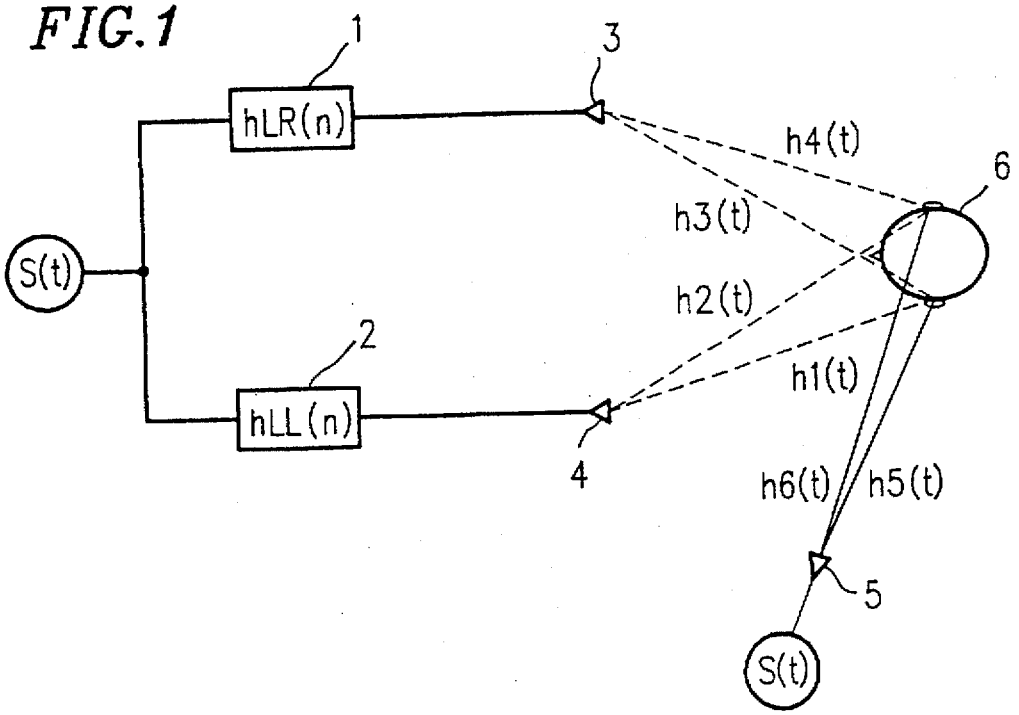
FIG. 1 is a block diagram for illustrating a principle of sound localization in a sound field controller according to the invention.

First, a method for virtually localizing the sound image in an arbitrary direction will be explained with reference to FIG. 1. FIG. 1 shows a diagram indicating the principle of virtually generating a sound image localization using a left-channel (Lch) loudspeaker 4 and a right-channel (Rch) loudspeaker 3, which is equivalent to the sound image localization generated from the signal reproduced from a left-side loudspeaker 5. In FIG. 1, the loudspeakers 3 and 4 are located on the left and right sides respectively in front of a listener 6. An input signal S(t) is applied to operational circuits 1 and 2. The operational circuit 1 comprises an FIR filter for performing convolution with impulse response hLR(n), and the operational circuit 2 comprises an FIR filter for performing convolution with impulse response hLL(n). In this figure, h1(t) represents the impulse response at the left-ear position (more accurately, the position of the eardrum, or in the case of measurement, the entrance of the acoustic meatus) of the listener 6 when the loudspeaker 4 produces an impulse sound. Hereinafter, the term "impulse response" is used for the description in a time domain, and the term "head-related transfer function" is used for the description in a frequency domain. Similarly, h2(t) represents the impulse response at the right-ear position of the listener 6 when the loudspeaker 4 produces the impulse sound. Also, h3(t) represents the impulse response at the left-ear position of the listener 6 when the loudspeaker 3 produces an impulse sound, h4(t) represents the impulse response at the right-ear position of the listener 6 when the loudspeaker 3 produces the impulse sound, h5(t) represents the impulse response at the left-ear position of the listener 6 when the loudspeaker 5 produces the impulse sound, and h6(t) represents the impulse response at the right-ear position of the listener 6 when the loudspeaker 5 produces the impulse sound.

In this configuration, when the signal S(t) is produced from the loudspeaker 5, the sound that reaches the ears of the listener 6 is expressed by the following equations.

Specifically, the sound pressure L(t) at the left ear is represented by Equation (1).

$$L(t)=S(t)*h5(t) \quad (1)$$

The sound pressure R(t) at the right ear is expressed as $$R(t)=S(t)*h6(t) \quad (2)$$

where * represents a convolution.

A transfer function of the loudspeaker itself which is multiplied in practical situations is ignored in the case under consideration. Alternatively, the transfer function of the loudspeakers may be considered to be included in the impulse response functions.

Further, supposing that the sound pressures L(t) and R(t) given by Equations (1) and (2), the impulse responses h1(t) to h6(t), and the signal S(t) are all temporally discrete digital signals, they are converted to the formations as shown by the following expressions (3), (4), (5), (6) and (7).

$$L(t) \rightarrow L(n) \quad (3)$$
$$R(t) \rightarrow R(n) \quad (4)$$
$$h5(t) \rightarrow h5(n) \quad (5)$$
$$h6(t) \rightarrow h6(n) \quad (6)$$
$$S(t) \rightarrow S(n) \quad (7)$$

In this case, Equations (1) and (2) are expressed by following Equations (8) and (9) respectively.

$$L(n) = S(n)*h5(n) = \sum_{k=0}^{N-1} S(k) \cdot h5(n-k) \quad (8)$$

$$R(n) = S(n)*h6(n) = \sum_{k=0}^{N-1} S(k) \cdot h6(n-k) \quad (9)$$

It should be noted that the natural number n should actually be expressed by nT instead, T indicating a sampling time. However, T is omitted as usual and Equations (8) and (9) are written in the above-mentioned expression.

Similarly, when the signal S(t) is reproduced from the loudspeakers 3 and 4, the sound which reaches the ears of the listener 6 is represented by following Equations (10) and (11). The sound pressure at the left ear is given by Equation (10).

$$L'(n) = S(n)*hLL(n)*h1(n) + S(n)*hLR(n)*h3(n) \quad (10)$$

The sound pressure at the right ear is expressed by Equation (11).

$$R(n)=S(n)*hLL(n)*h2(n) + S(n)*hLR(n)*h4(n) \quad (11)$$

Assuming that the sounds are perceived as coming from the same direction if the head related transfer functions of the sounds are equivalent to each other (i.e., the direction from which sound is coming is determined based on the amplitude difference and the time difference between the sounds reaching the right and left ears, and this assumption is generally valid), Equations (12) to (15) hold as follows.

$$L(n)=L'(n) \quad (12)$$

$$h5(n)=hLL(n)*h1(n)+hLR(n)*h3(n) \quad (13)$$

$$R(n)=R'(n) \quad (14)$$

$$h6(n)=hLL(n)*h2(n)+hLR(n)*h4(n) \quad (15)$$

Thus, the impulse responses hLL(n) and hLR(n) may be determined so as to satisfy Equations (13) and (15).

The impulse responses h1(t) to h6(t) and hLL(t) to hLR(t) are rewritten in a frequency domain expression as shown by following Equations (16) to (23).

$$H1(n)=FFT(h1(n)) \quad (16)$$

$$H2(n)=FFT(h2(n)) \quad (17)$$

$$H3(n)=FFT(h3(n)) \quad (18)$$

$$H4(n)=FFT(h4(n)) \quad (19)$$

$$H5(n)=FFT(h5(n)) \quad (20)$$

$$H6(n)=FFT(h6(n)) \quad (21)$$

$$HLL(n)=FFT(hLL(n)) \quad (22)$$

$$HLR(n)=FFT(hLR(n)) \quad (23)$$

where FFT( ) represents a function transformed by Fourier transformation (FFT: Fast Fourier Transformer).

Next, Equations (13) and (15) are also rewritten in the frequency domain expression. The operation is transformed from a convolution to a multiplication as represented in Equations (24) and (25). The remaining parts are transformed to the transfer functions with the respective impulse responses by Fourier transformation.

$$H5(n)=HLL(n)\cdot H1(n)+HLR(n)\cdot H3(n) \quad (24)$$

$$H6(n)=HLL(n)\cdot H2(n)+HLR(n)\cdot H4(n) \quad (25)$$

In Equations (24) and (25), the values other than the transfer functions HLL(n) and HLR(n) are obtained by measurement. Therefore, the transfer functions HLL(n) and HLR(n) can be obtained from following Equations (26) and (27).

$$HLL(n)=H5(n)\cdot H4(n)-H6(n)\cdot H3(n)/H1(n)-H4(n)\cdot H2(n)\cdot H3(n) \quad (26)$$

$$HLR(n)=H6(n)\cdot H(n)\cdot H5(n)\cdot H2(n)/H1(n)-H4(n)-H2(n)\cdot H3(n) \quad (27)$$

By using hLL(n) and hLR(n) obtained from HLL(n) and HLR(n) by performing the inverse Fourier transformation (IFFT), and applying the signal S(n) to the operational circuits 1 and 2, the signal to be reproduced from the loudspeaker 4 is obtained by performing the convolution with S(n) and hLL(n), and the signal to be produced from the loudspeaker 3 is obtained by preforming the convolution with S(n) and hLR(n). When the convolution sum signals are reproduced and the corresponding sounds are output from the respective loudspeakers 3 and 4, the listener 6 can perceive the sounds as if the sound comes from the left loudspeaker 6 that is not actually played.

The method described above can virtually localize the sound image in a desirable direction.

Figure 2:
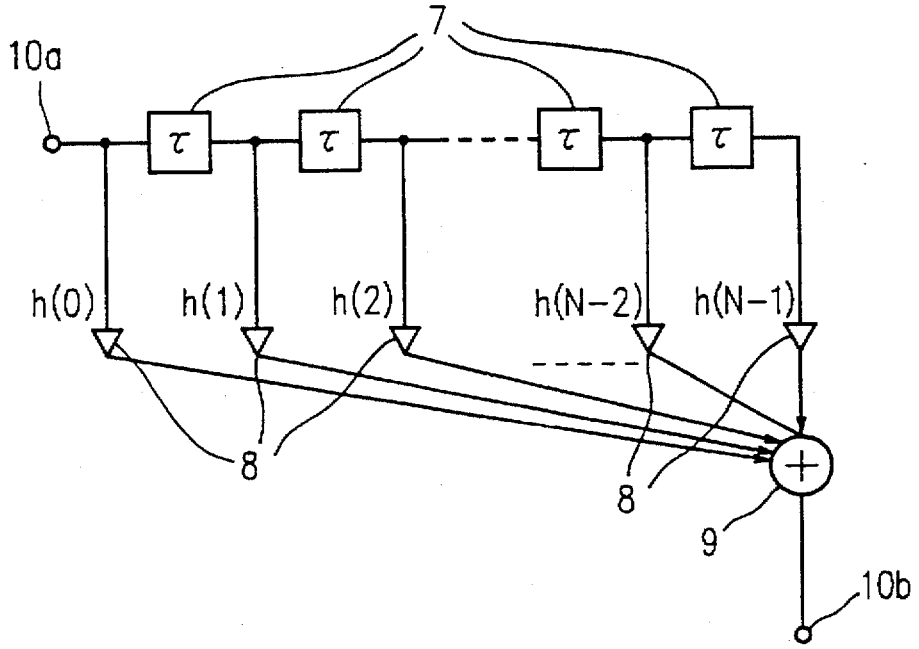
FIG. 2 is a diagram illustrating the construction of an operation circuit of the sound field controller according to the invention.

An exemplary structure of an FIR filter for performing convolution is shown in FIG. 2. In FIG. 2, the signal is applied to a signal input terminal 10*a* and goes through serially connected N−1 delay elements 7. Each of delay elements 7 delays the signal by τ, each of the multipliers 8 multiplies the input signal by a value called the tap (a coefficient of the FIR filter) indicated by h(n), an adder 9 adds all the signals output from the multipliers 8, and the added (sum) signal is output via an output terminal 10*b*.

Although the FIR filter shown in FIG. 2 is formed by hardware, the FIR filter may be implemented by using a DSP (Digital Signal Processor) or a custom LSI for high speed multiplication and addition operations.

The impulse responses h(n) (n: 0 to N−1, where N is the required length of the impulse response) are set up as the tap coefficients of the respective multipliers 8 as shown in FIG. 2. Also, a delay time corresponding to the sampling frequency of converting an analog signal to a digital signal is set up in each of the delay elements 7. The signals applied to the input terminal 10*a* are multiplied/added/delayed repeatedly, thereby the convolution as shown in Equations (8) and (9) is performed. This operation involves digital signals. In practice, therefore, an A/D converter and a D/A converter are to be provided in order to convert analog signals to digital signals before being applied to the FIR filter, and to convert the digital signal output from the FIR filter to an analog signal (these converters are not shown in the figures as is the case in the following descriptions).

The impulse response hLL(t) and hLR(t) are obtained in the above mentioned manner, and the sound image is localized on the left side or left rear by using the operational circuits 1 and 2 with a phantom loudspeaker from which the sound is perceived to come.

Similarly, when the sound image is to be localized on the right side or right rear, hRL(t) and hRR(t) are obtained so as to perform the convolution.

Figure 3:
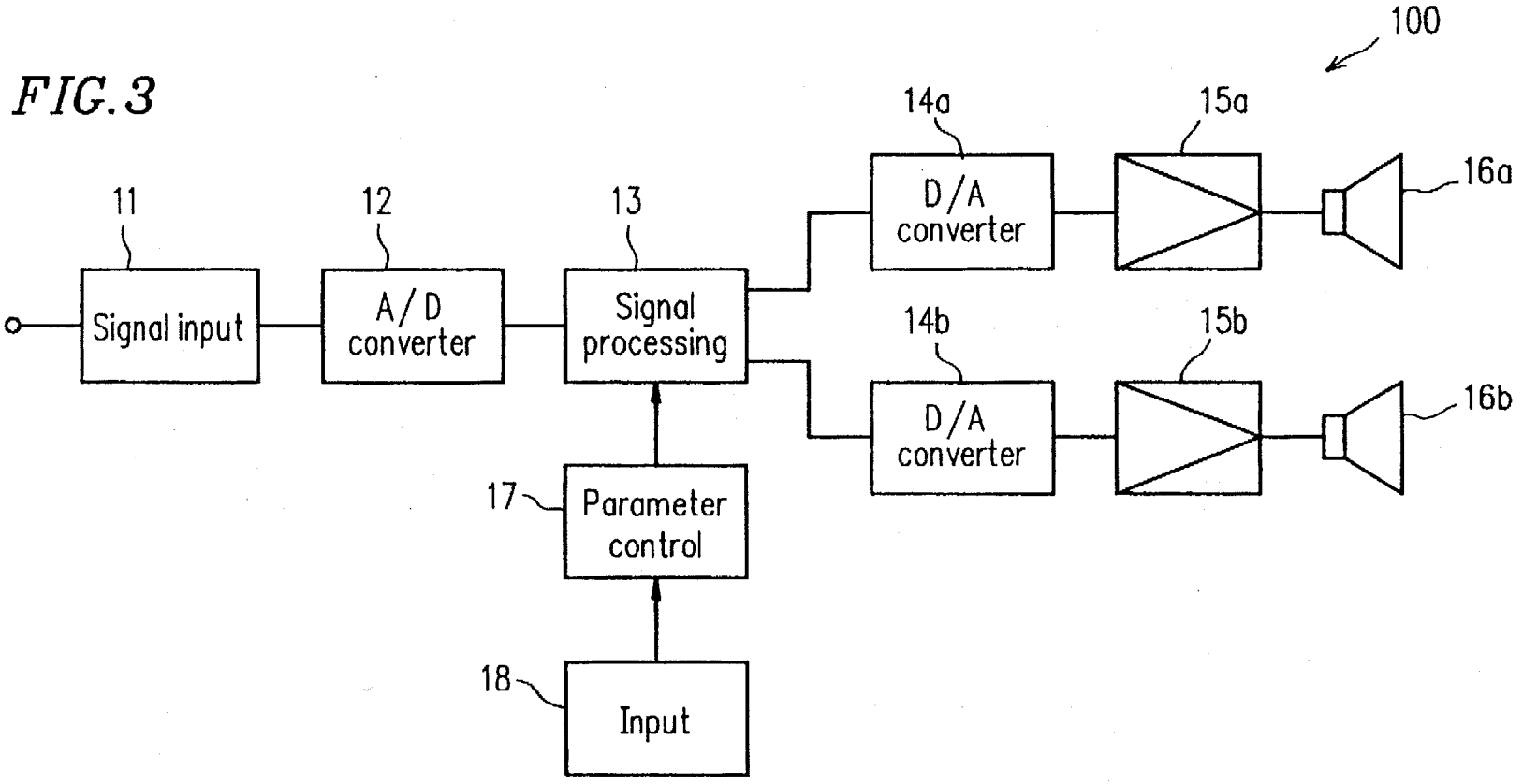
FIG. 3 is a block diagram of a sound field controller in Example 1 according to the invention.

Next, the present invention will be described by way of Example 1. FIG. 3 is a block diagram showing the whole construction of a sound field controller 100 in Example 1 according to the invention. As shown in FIG. 3, the sound field controller 100 includes a signal input device 11 for inputting an audio signal, an A/D converter 12, a signal processing section 13, a pair of D/A converters 14*a* and 14*b*, a pair of amplifiers 15*a* and 15*b*, a pair of loudspeakers 16*a* and 16*b*, a parameter controller 17, and an input device 18.

Through the input device 18, the position of a listener, the position at which the sound image is to be localized, the distance between the listener and the sound image, and the spatial size of the sound field are input. The output of the input device 18 is fed to the parameter controller 17. The parameter controller 17 controls the parameter which is set in the signal processing section 13, based on the conditions such as the positions, the distance, and the spatial size of the sound field which are fed from the input device 18. The parameter controller 17 previously stores convolution coefficients for localizing the sound image in any direction and at any positions with respect to the listener. The parameter controller 17 selects a value satisfying the input conditions among them, and sets the value in the signal processing section 13.

Figure 4:
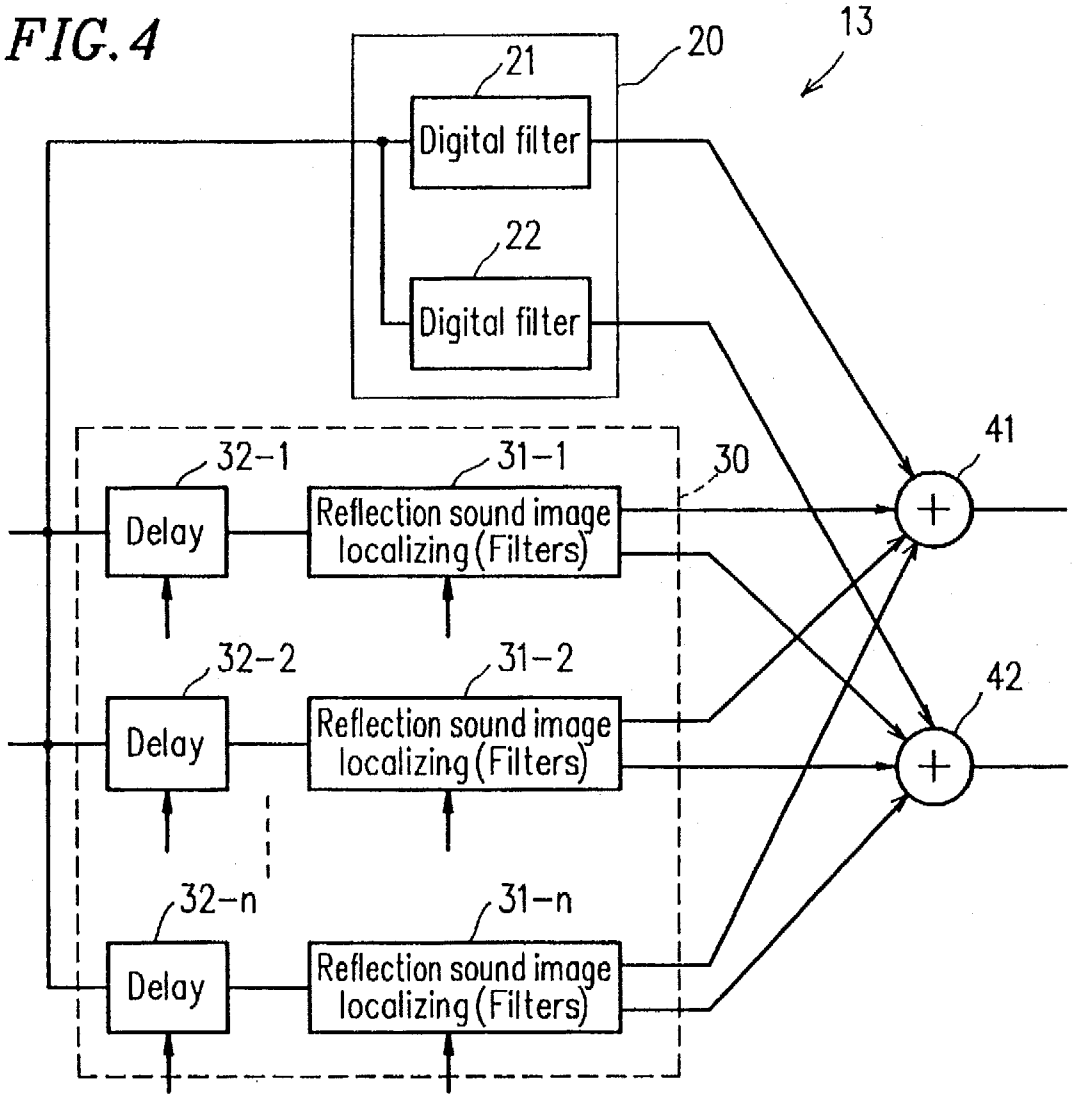
FIG. 4 is a block diagram showing an exemplary signal processing section in the sound field controller according to the invention.

FIG. 4 is a block diagram showing the construction of the signal processing section 13 in Example 1, in detail. The signal processing section 13 includes a direct sound processing section 20 for localizing the sound image of a direct sound, and a reflection sound processing section 30 for localizing the sound image of a reflection sound. As shown in FIG. 4, the output from the A/D converter 12 is input into the direct sound processing section 20 and the reflection sound processing section 30.

The direct sound processing section 20 includes a pair of digital filters 21 and 22, and localizes the sound image at the sound source position of the direct sound.

The reflection sound processing section 30 includes a plurality of filter portions 31-1 to 31-n and a plurality of delay circuits 32-1 to 32-n, and localizes the reflection sound images at positions corresponding to the reflecting positions of the first to n-th reflection sounds. Each of the delay circuits 32-1 to 32-n delays a signal for localizing a corresponding reflection sound, in accordance with the delay time set by the parameter controller 17. The outputs of the delay circuits 32-1 to 32-n are input to the filter portions 32-1 to 32-n, respectively. Each of the filter portions 32-1 to 32-n includes a pair of digital filters. As filter coefficients of the digital filters, the convolution coefficients corresponding to the positions of the sound images which are output from the parameter controller 17 are set. By setting the filter coefficients in accordance with the attenuation level output from the parameter controller 17, the signal for localizing the reflection sound is attenuated. In this way, a natural distance perspective in accordance with the input conditions can be supplied for the listener.

The number n of the filter portions and the delay circuits is determined on the basis of the positions at which the reflection sound images are to be localized. The digital filters used in the direct sound processing section 20 and the reflection sound processing section 30 have the same construction as that of the digital filter shown in FIG. 2. The right and left outputs from the respective filter portions 32-k (k=1 to n) of the reflection sound processing section 30 are applied to adders 41 and 42, respectively. The adder 41 adds the right sound signals to each other, and the adder 42 adds the left sound signals to each other. The outputs of the adders 41 and 42 are input into the D/A converters 14*a* and 14*b* shown in FIG. 3, respectively.

Next, the operation of the sound field controller in this example will be described. First, an audio signal is input into the signal input device 11. The input audio signal is converted into a digital signal by the A/D converter 12, and then applied to the signal processing section 13. For the signal input into the signal processing section 13, the sound image of the direct sound is localized by the direct sound processing section 20 and the sound images of the respective reflection sounds are localized by the reflection sound processing section 30.

From the input device 18, the positions of the listener and the sound image, the distance between them, the spatial size of the sound field, and the like are input. The parameter controller 17 sets the parameters used in the signal processing section 13 in order to obtain the characteristics in accordance with the conditions input through the input device 18, so as to control the directions of reflection sounds, the sound volume, the reverberation time, the frequency characteristic, and the position and the magnitude of the sound image of the direct sound. The respective right and left outputs from the direct sound processing section 20 and the reflection sound processing section 30 are added, and the added results are output from the signal processing section 13 as right and left signals. The signals processed by the signal processing section 13 are converted into analog signals by the D/A converters 14*a* and 14*b*, amplified by the amplifiers 15*a* and 15*b*, and then reproduced from the loudspeakers 16*a* and 16*b*, respectively. Accordingly, the sound image can be localized so that the listener can feel the intended distance perspective and sense of expansion.

Figure 5:
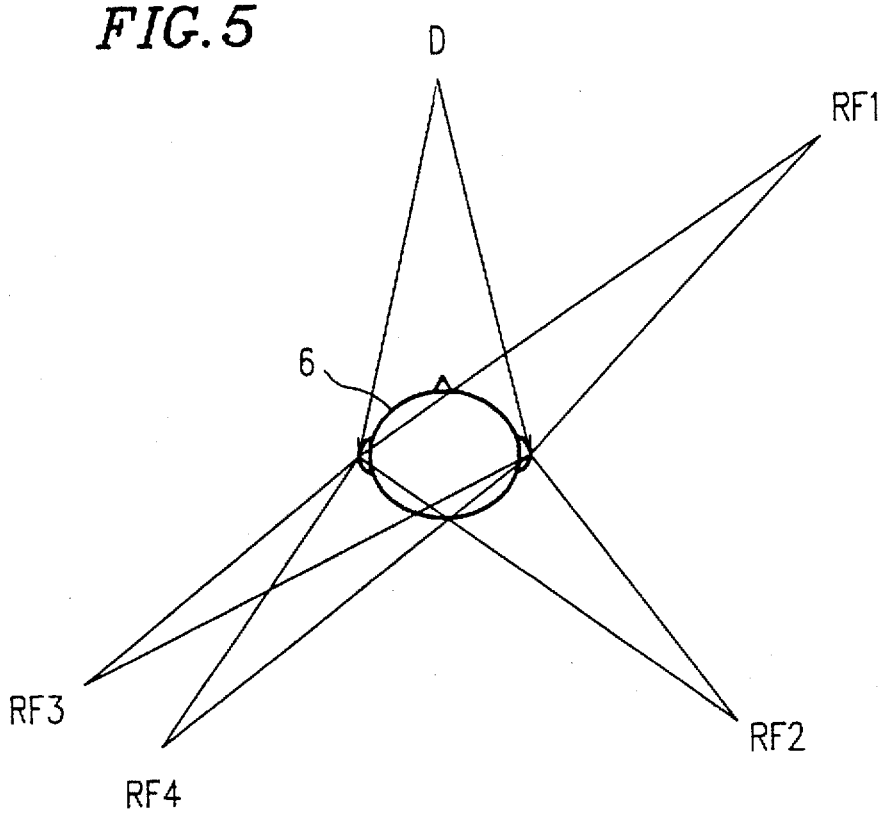
FIG. 5 is a diagram showing the relationship between a reflection sound and a direct sound.

Next, the parameter control in the signal processing section 13 will be described. As shown in FIG. 5, in the case where the listener 6 listens to a sound in a sound field, it is assumed that the number of directions of reflection sounds for a direct sound D is four. These reflection sounds are referred to as RF1, RF2, RF3, and RF4 numbered in the order that they reach the ears of the listener 6. The relationship between the time and the four reflection sounds are, for example, shown in FIG. 6. In accordance with the positional relationship between the listener 6 and the sound image, the following factors are changed: the volume valance between the direct sound D and the initial reflection sound RF1; the time period after the direct sound D occurs until the initial reflection sound RF1 occurs; and the level balances and the time intervals between the reflection sounds RF1 to RF4. By combining them, the listener 6 can psychologically feel the distance and expansion.

Figure 6A:
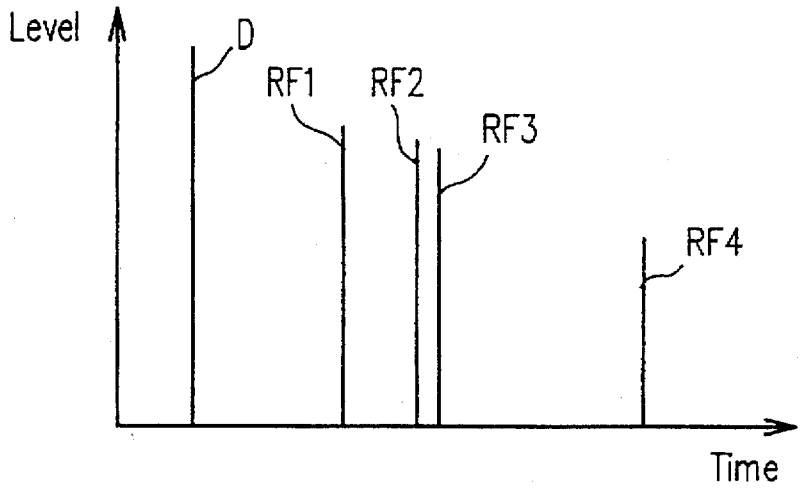
FIG. 6A is a graph showing the relationship between a level of a reflection sound and a time.

For example, in the case where there are four reflection sounds as shown in FIG. 6, the delay times and attenuation levels of the respective reflection sounds for the direct sound D are set as follows by means of the input device 18.

Initial reflection sound RF1:
Delay time 5.5 ms, Level 80%
Reflection sound RF2:
Delay time 7.3 ms, Level 77%
Reflection sound RF3:
Delay time 7.9 ms, Level 76%
Reflection sound RF4:
Delay time 17.4 ms, Level 50%

In accordance with these values, the delay time for each delay circuit 32-k (k=1 to 4) in the reflection sound processing section 20 is set by the parameter controller 17. Each of the delayed signals is input into a corresponding one of the filter portions 31-k (k=1 to 4). The parameter controller 17 sets the coefficients of the filter portions 31-k (k=1 to 4), so as to realize the direction of each reflection sound in the reflection sound series which are previously stored depending on the distances of the sound image. As a result, as described above, the positions of the sound images of the direct sound and each reflection sound are implemented by convolution operation by the digital filter, so that the sound image can be localized in a desired direction.

Figure 7:
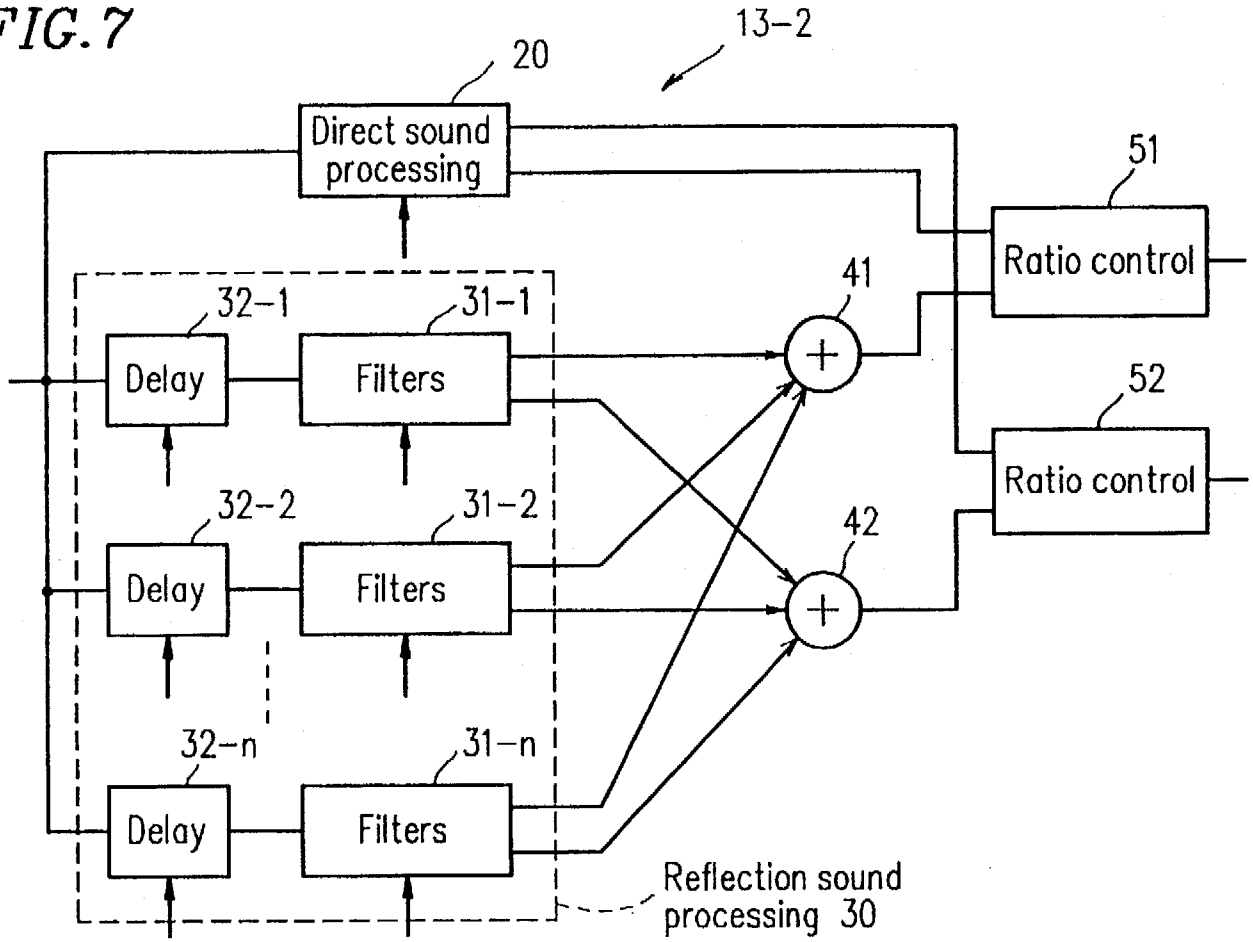
FIG. 7 is a block diagram showing a signal processing section in a sound field controller in Example 2 according to the invention.

FIG. 7 shows a signal processing section 13-2 of the sound field controller in Example 2. The sound field controller in Example 2 has the same construction as that of the sound field controller 100 in Example 1 shown in FIG. 3 except for the construction of the signal processing section 13. Components which are the same as those described in Example 1 are designated by the same reference numerals, and the detailed descriptions thereof are omitted. The signal processing section 13-2 further includes direct sound to reflection sound ratio controllers 51 and 52, in addition to the components of the signal processing section 13.

In the signal processing section 13-2, only the respective outputs of the reflection sound processing section 30 is added to each other in the adders 41 and 42. One of the output signals of the direct sound processing section 20 and the output signal of the adder 41 are input into the direct sound to reflection sound ratio controller 51. The direct sound to reflection sound ratio controller 51 controls the ratio of the direct sound to the reflection sound in the left channel. Similarly, the other output signal of the direct sound processing section 20 and the output signal of the adder 42 are input into the direct sound to reflection sound ratio controller 52. The direct sound to reflection sound ratio controller 52 controls the ratio of the direct sound to the reflection sound in the right channel.

The direct sound to reflection sound ratio controller 51 adds the signal input from the direct sound processing section 20 to the signal input from the reflection sound processing section 30 via the adder 41, while the output ratio is continuously varied. Accordingly, the continuous variation of the distance perspective can be attained. For example, in the case where the distance perspective up to about 1 m is desired, the ratio of the direct sound to the reflection sound is set to be 50:50. In the case where the distance perspective up to about 2 to 5 m is desired, the ratio of the direct sound to the reflection sound is set to be 30:70.

Figure 8:
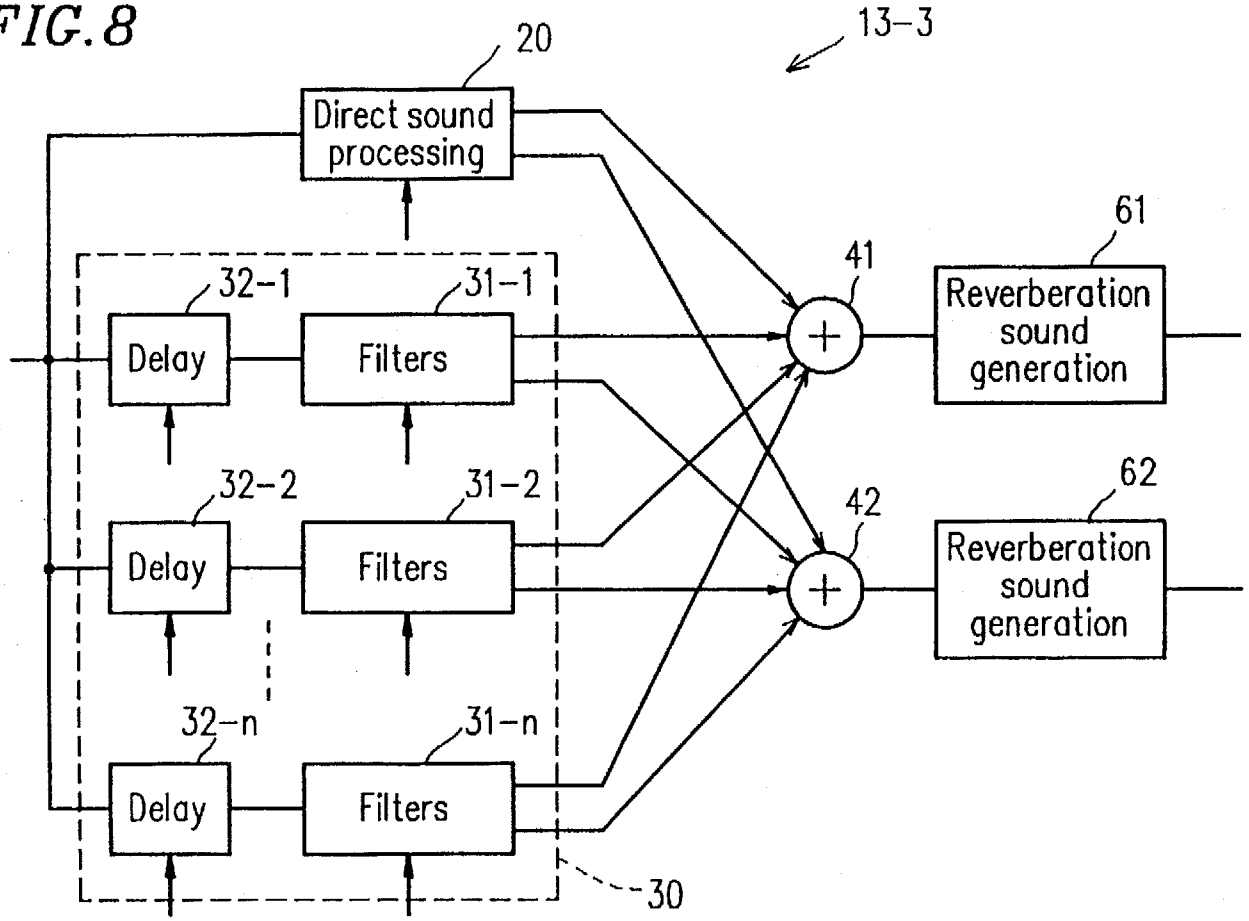
FIG. 8 is a block diagram showing a signal processing section in a sound field controller in Example 3 according to the invention.

FIG. 8 shows a signal processing section 13-3 of a sound field controller in Example 3. The sound field controller in Example 3 has the same construction as that of the sound field controller 100 in Example 1 shown in FIG. 3 except for the construction of the signal processing section 13. Like components to those described in Example 1 are designated by like reference numerals, and the detailed descriptions thereof are omitted. The signal processing section 13-3 further includes reverberation sound generators 61 and 62, in addition to the components of the signal processing section 13.

Figure 6B:
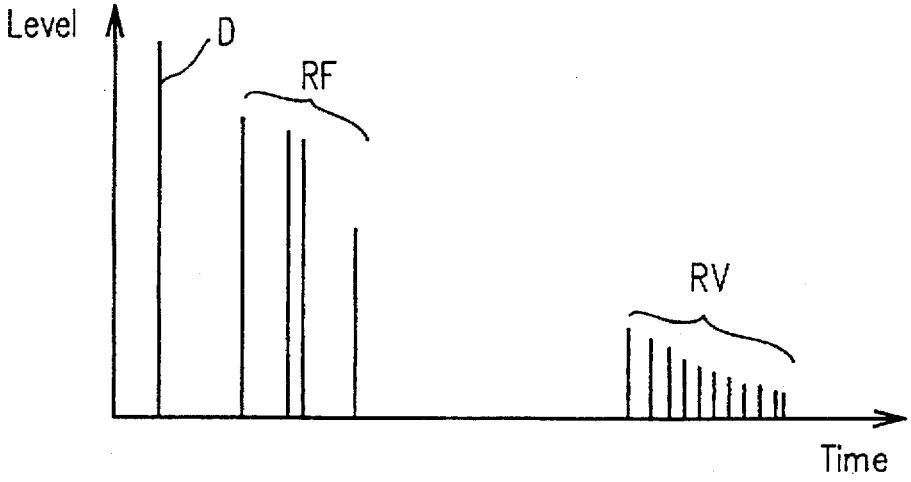
FIG. 6B is a graph showing the relationship between the level of a reverberation sound and a time.

The reverberation sound generators 61 and 62 add a reverberation sound in accordance with the spatial size of the sound field to the signals applied from the adders 41 and 42, respectively. Each of the reverberation sound generators 61 and 62 can be constructed, for example, by connecting a plurality of feedback echoes having respective different delay times in series. An example of the reverberation sound to be added is shown in FIG. 6B. The added reverberation sound is set in the following manner. In the case where a spatial expansion is required for a sound field signal which provides the distance perspective up to about 10 meters, the length of the reverberation time is set to be, for example, 0.25 to 0.35 s (seconds), and the delay time of the reverberation sound with respect to the direct sound is set to be 50 ms. In the case where a spatial expansion is required for a sound field signal which provides the distance perspective between 10 m and about 20 m, the length of the reverberation time is set to be, for example, 0.7 to 0.9 s, and the delay time of the reverberation sound with respect to the direct sound is set to be 50 ms. Alternatively, in the case where a sound field such as a large concert hall is to be reproduced, the reverberation time of the reverberation sound to be added is set to be relatively long, and the reverberation time of the lower frequency range is set to be longer than that of the higher frequency range.

Figure 9:
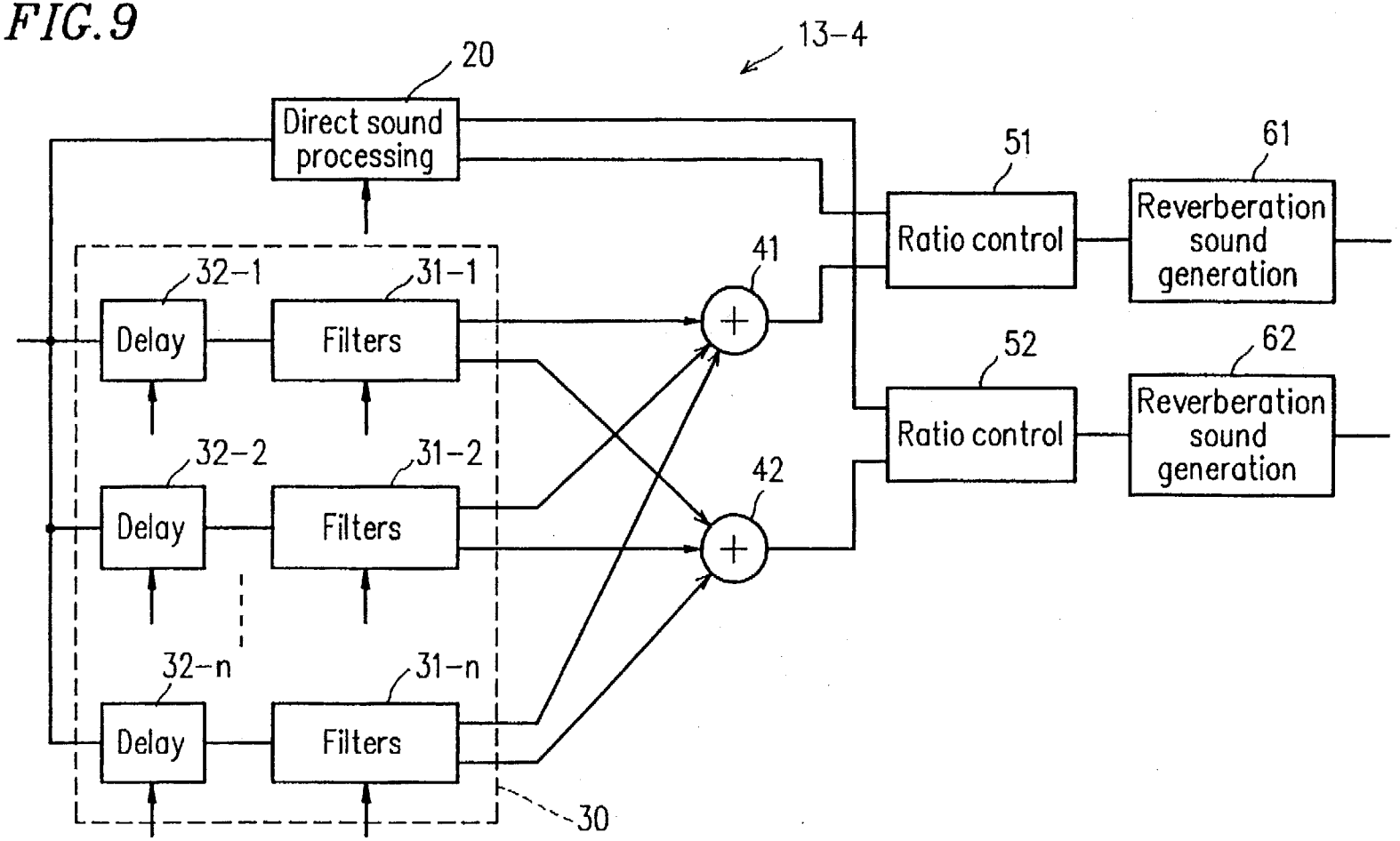
FIG. 9 is a block diagram showing a signal processing section in a sound field controller in Example 4 according to the invention.

FIG. 9 shows the signal processing section 13-4 of a sound field controller in Example 4. The sound field controller in Example 4 has the same construction as that of the sound field controller 100 in Example 1 shown in FIG. 3 except for the construction of the signal processing section 13. Like components to those described in the above-described examples are designated by like reference numerals, and the detailed descriptions thereof are omitted. The signal processing section 13-4 further includes reverberation sound generators 61 and 62, in addition to the components of the signal processing section 13-2 in Example 2. By using the signal processing section 13-4, the ratio of the direct sound to the reflection sound is continuously varied, and the reverberation sound can be generated and added in accordance with the spatial size of the sound field.

Figure 10:
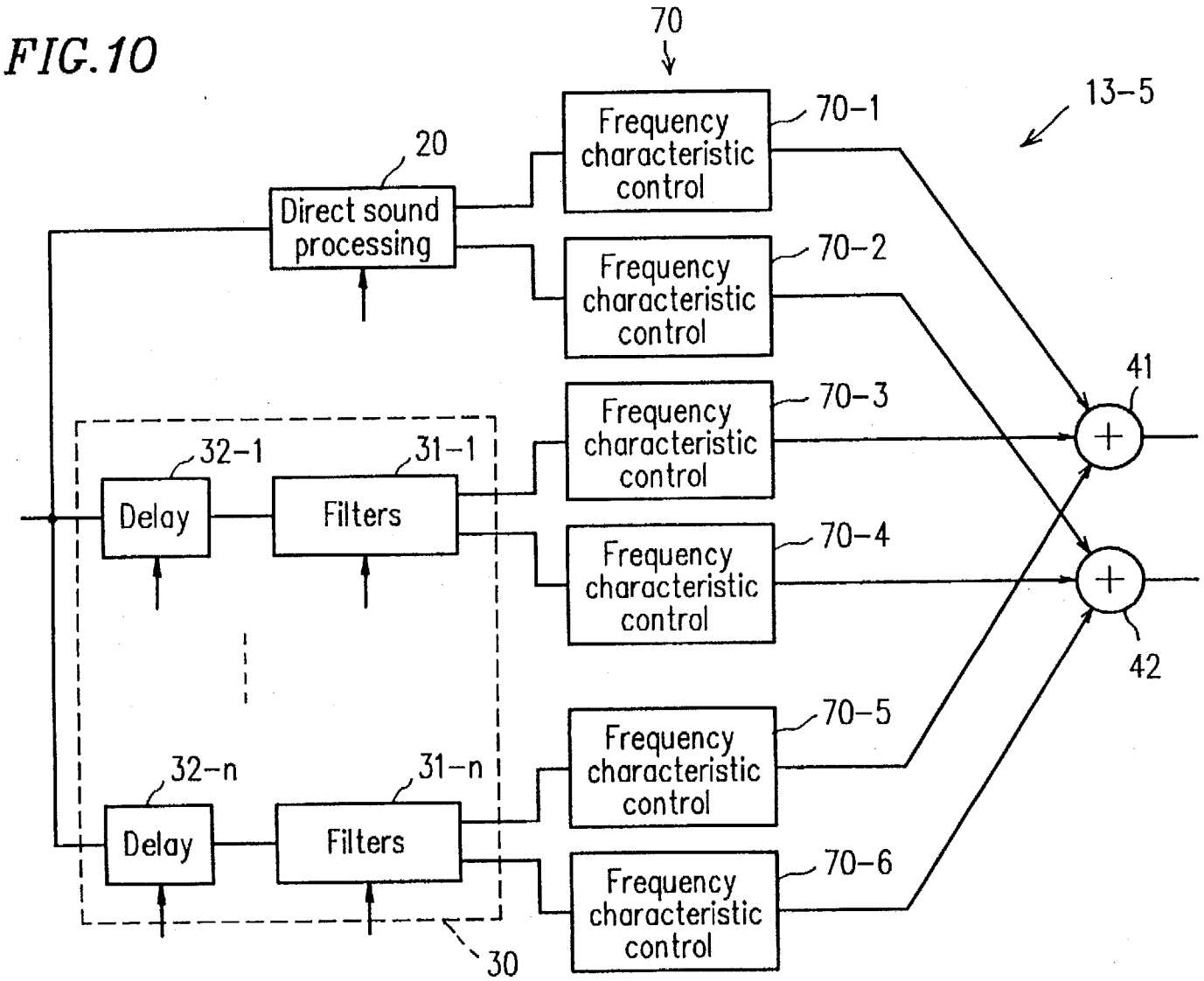
FIG. 10 is a block diagram showing a signal processing section in a sound field controller in Example 5 according to the invention.

FIG. 10 shows a signal processing section 13-5 of a sound field controller in Example 5. The sound field controller of Example 5 has the same construction as that of the sound field controller 100 in Example 1 shown in FIG. 3 except for the construction of the signal processing section 13. Like components to those described in the above-described examples are designated by like reference numerals, and the detailed descriptions thereof are omitted. The signal processing section 13-5 further includes a frequency characteristic controller 70, in addition to the components of the signal processing section 13 in Example 1.

As shown in FIG. 10, the frequency characteristic controller 70 includes portions 70-1 to 70-(2n+2) corresponding to the outputs from the direct sound processing section 20 and the reflection sound processing section 30, respectively. The frequency characteristic controller 70 controls the sound pressure characteristics of the input signals. For example, the sound is reflected by a wall of a room, various attenuation ratios occur depending on the frequency components of the sound. Therefore, in the case where the distance between the listener and the sound image is long, the distance perspective can be attained by lowering the sound pressure of the higher frequency range than that of the lower frequency range. In order to attain the distance perspective of 5 to 10 m, the frequency characteristics are controlled as follows, for example, after the addition of reflection sound.

Frequency: 4 kHz, Gain: +5 dB (⅓ oct)

Frequency: 8 kHz, Gain: +5 dB (⅓ oct)

The output signals from the frequency characteristic controller 70 are added by the adders 41 and 42 in each of the channels, and then supplied to the D/A converters 14*a* and 14*b*.

Figure 11:
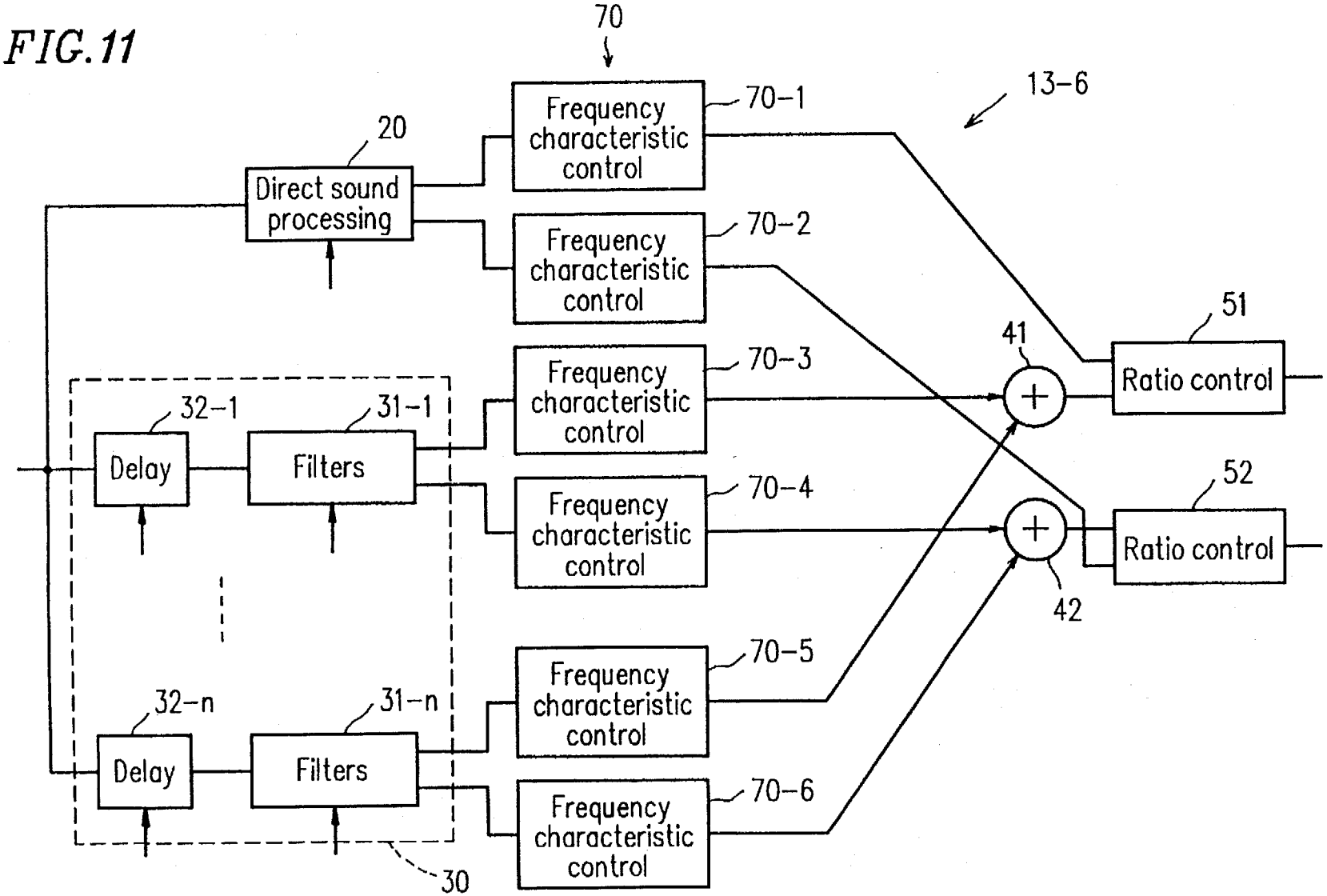
FIG. 11 is a block diagram showing a signal processing section in a sound field controller in Example 6 according to the invention.

FIG. 11 shows a signal processing section 13-6 of a sound field controller in Example 6. The sound field controller of Example 6 has the same construction as that of the sound field controller 100 in Example 1 shown in FIG. 3 except for the construction of the signal processing section 13. Like components to those described in the above-described examples are designated by like reference numerals, and the detailed descriptions thereof are omitted. The signal processing section 13-6 further includes direct sound to reflection sound ratio controllers 51 and 52 in addition to the components of the signal processing section 13-5 in Example 5. In the signal processing section 13-6, the outputs from the reflection sound processing section 30 are processed by the frequency characteristic controller 70 (70-3 to 70-(2n+2)), and then added by the adders 41 and 42 in each of the channels. Thereafter, the added results are supplied to the direct sound to reflection sound ratio controllers 51 and 52. The output signals of the direct sound processing section 20 are respectively input into the direct sound to reflection sound ratio controllers 51 and 52 in each channel. According to the invention, the frequencies can be controlled and the ratio of the direct sound to the reflection sound can be continuously varied.

Figure 12:
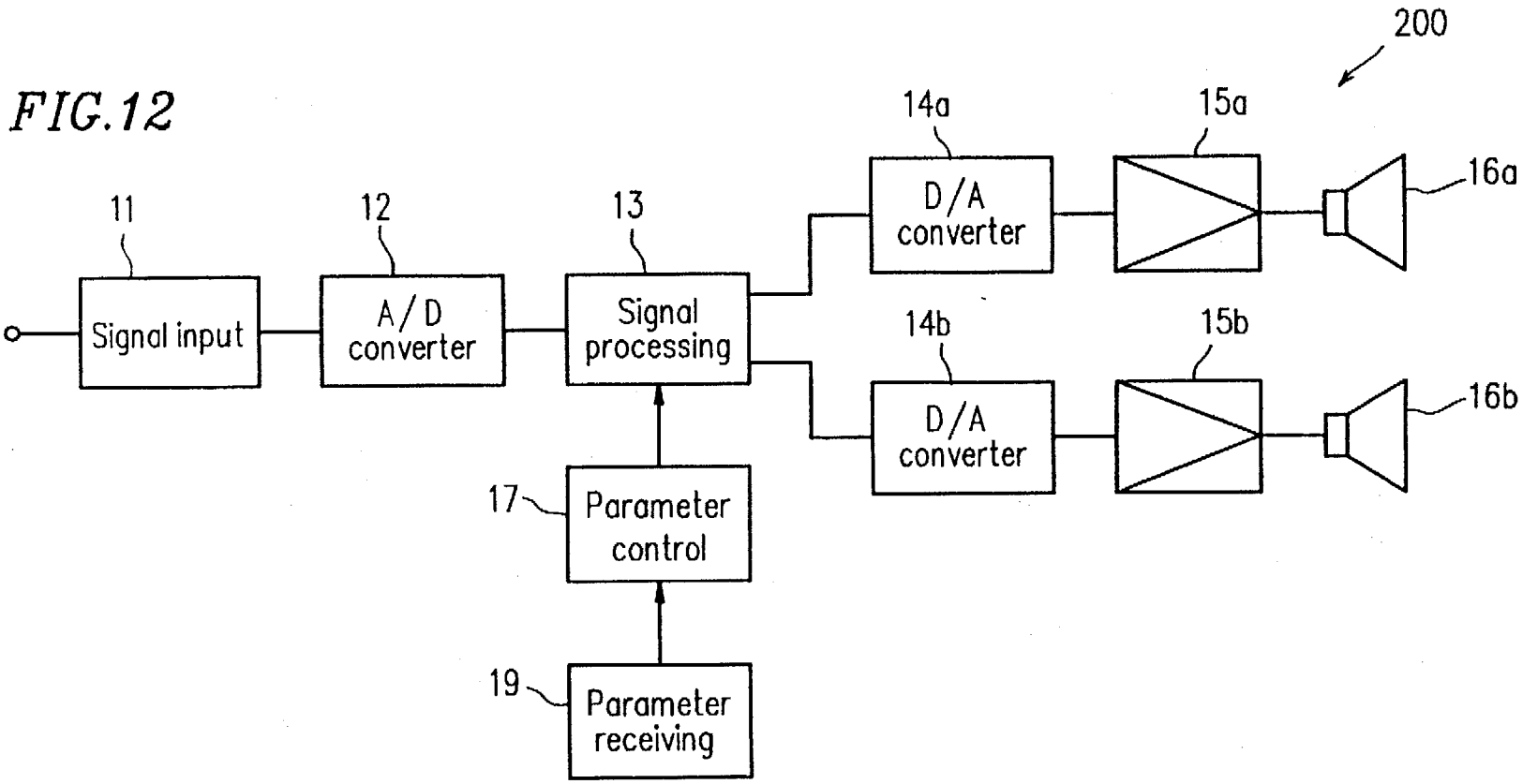
FIG. 12 is a block diagram showing a sound field controller in Example 7 according to the invention.

FIG. 12 shows a sound field controller 200 in Example 7 according to the invention. Like components of the sound field controller 200 in Example 7 to those of the sound field controller 100 described in Example 1 shown in FIG. 3 are designated by like reference numerals, and the detailed descriptions thereof are omitted. The sound field controller 200 includes a parameter receiving device 19 for receiving a control signal for controlling the distance perspective between the listener and the sound image and the sense of expansion of the sound field from the outside of the sound field controller 200.

The parameter receiving device 19 is coupled to external control equipment (not shown). The parameter receiving device 19 receives control signals including the conditions such as the distance perspective and the sense of expansion, for example, a parameter control signal for an audio signal synchronized with a video signal and a control signal which is previously programmed. Based on the received control signals, the parameter controller 17 sets the parameters for the signal processing section 13. The operation thereafter is the same as that described in the above-described examples.

As described above, in this example, the distance perspective and sense of expansion can be controlled by the external control signals. By using the previously programmed signals, the control can be performed repeatedly, and the combination with a video signal, and the distance perspective and sense of expansion depending on the scene of the video screen can be controlled.

Alternatively, instead of the reproduction loudspeakers 16*a* and 16*b*, a headphone can be used. In such a case, correction for crosstalk canceling is not required. In the above-described examples, the input signal is monophonic. It is appreciated that the invention can be readily applied to the case where the input signal is stereophonic.

Figure 13:
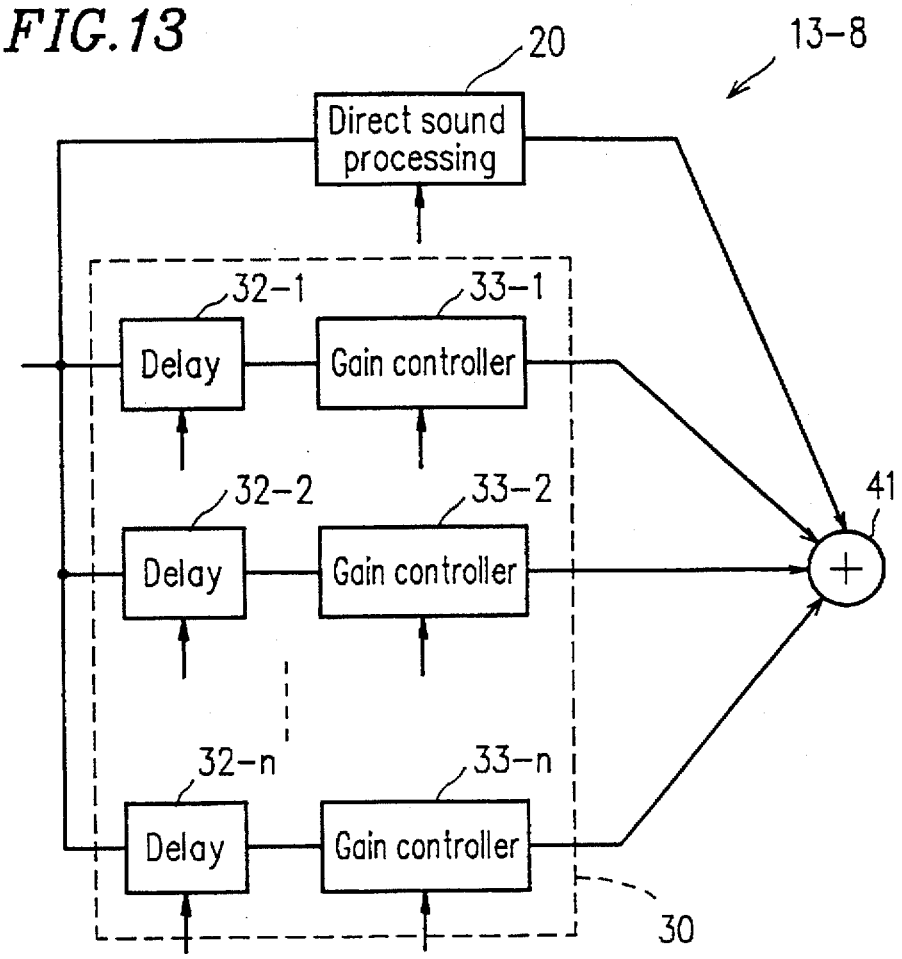
FIG. 13 is a block diagram showing a signal processing section in a sound field controller in Example 8 according to the invention.

FIG. 13 shows a signal processing section 13-8 of a sound field controller in Example 8. The sound field controller in Example 8 has the same construction as that of the sound field controller 100 in Example 1 shown in FIG. 3 except for the construction of the signal processing section 13. Like components to those in the above-described examples are designated by like reference numerals, and the detailed descriptions thereof are omitted. In the signal processing section 13-8, the convolution in the filter portions 31-k of the reflection sound processing section 30 is omitted. The signal processing section 13-8 provides the distance perspective with a more simplified circuit configuration. As shown in FIG. 13, the signal processing section 13-8 has no filter portions, and hence the convolution for localizing the sound image at a virtual position of a loudspeaker is not performed. Instead, the distance perspective is attained by using the difference between times at which the reflection sounds are received by the right and left ears of the listener and the difference between levels of the received reflection sounds.

The signal processing section 13-8 shown in FIG. 13 shows a signal processing circuit for one of either the right channel or the left channel. A signal processing circuit for the other channel is identical with that shown in FIG. 13, and hence the description thereof is omitted. The reflection sound processing section 30 includes delay circuits 32-1 to 32-n for delaying an input signal, and gain controllers 33-1 to 33-n for adjusting the amplitudes of the output signals of the delay circuits 32-1 to 32-n. The adder 41 adds the output of the direct sound processing section 20 which is not delayed to the outputs of the gain controllers 331- to 33-n.

Specific examples of the gain control will be described below. For example, it is assumed that the right and left ears of the listener receive four reflection sounds, respectively. The case where the distance perspective of about 5 m is provided by there reflection sounds is considered. Examples of the left and right reflection sounds set by the input device 18 are shown in FIGS. 14A and 14B, respectively. The delay times and attenuation levels of the respective reflection sounds for the direct sound D to the left ear shown in FIG. 14A are set as follows.

Reflection sound RF1: Delay time 5.5 ms, Level 80%

Reflection sound RF2: Delay time 7.3 ms, Level 77%

Reflection sound RF3: Delay time 7.9 ms, Level 76%

Reflection sound RF4: Delay time 17.4 ms, Level 50%

Similarly, the delay times and attenuation levels of the respective reflection sounds for the direct sound D to the right ear shown in FIG. 14B are set as follows.

Reflection sound RF1: Delay time 5.5 ms, Level 80%

Reflection sound RF2: Delay time 7.1 ms, Level 77%

Reflection sound RF3: Delay time 8.1 ms, Level 76%

Reflection sound RF4: Delay time 17.4 ms, Level 50%

In accordance with these values, the delay time for each delay circuit 32-k and the gain for each gain controller 33-k are set.

Figure 15:
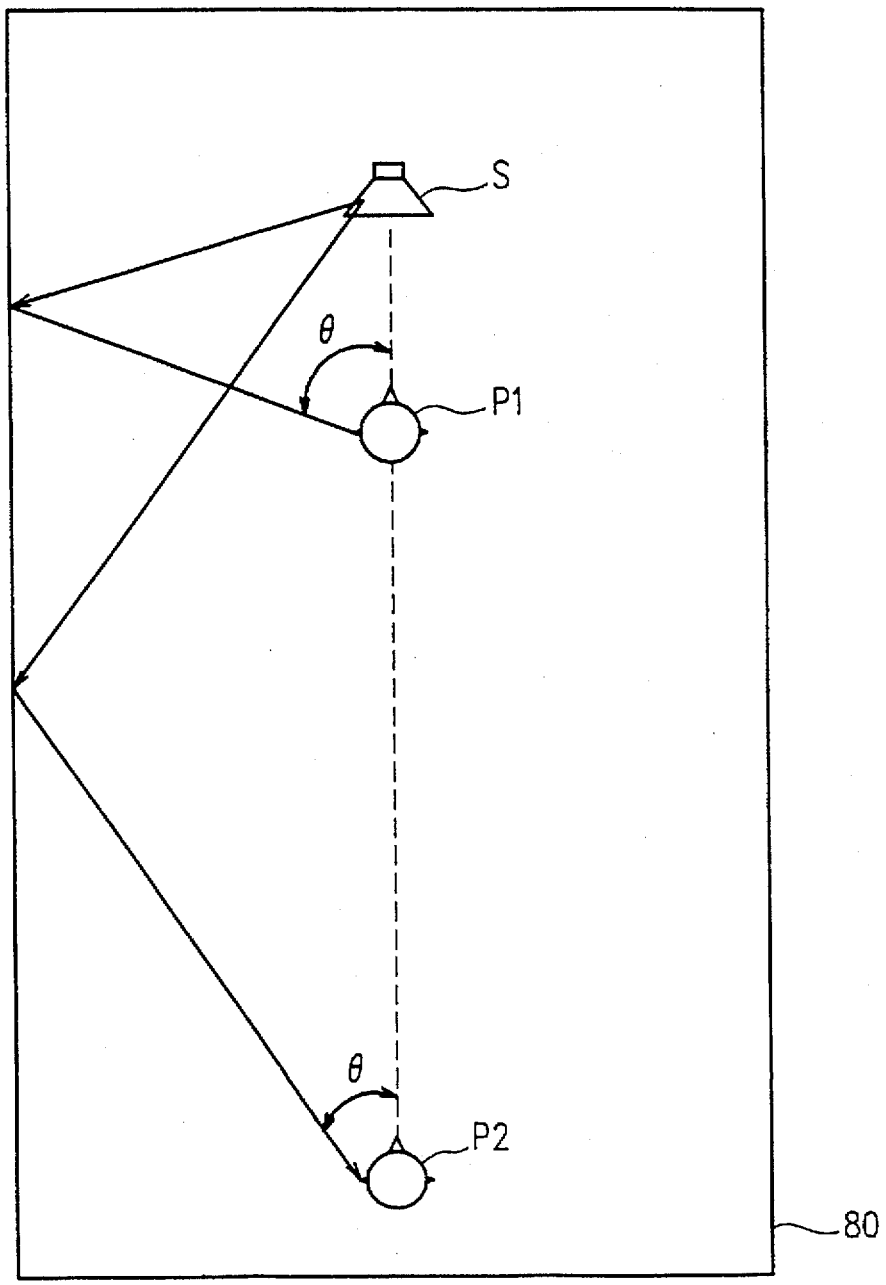
FIG. 15 is a diagram for illustrating the concept of parameter control in a sound field controller according to the invention.

By the input device 18 shown in FIG. 3, the spatial size of the sound field, and the position of the sound source are input, and hence the parameters for the signal processing section 13 are controlled. FIG. 15 is a diagram for illustrating an example of parameter control in the sound field controller in the above example. As shown in FIG. 15, it is assumed that, in a room 80, a sound generated from a sound source S is listened to by a listener P (P1 or P2). At this time, the distance between the listener P and the sound image (sound source) S is represented by a side reflection angle θ. For example, for the listener P2 who is far from the sound image (sound source) S, the value of θ is small. For the listener P1 who is positioned near the sound image S, the value of θ is large. In this way, by using the side reflection angle θ as a parameter, the distance from the sound image S can be represented. Depending on the value of θ output from the input device 18, the delay times and the convolution coefficients in the signal processing section 13 are controlled.

Figure 16:
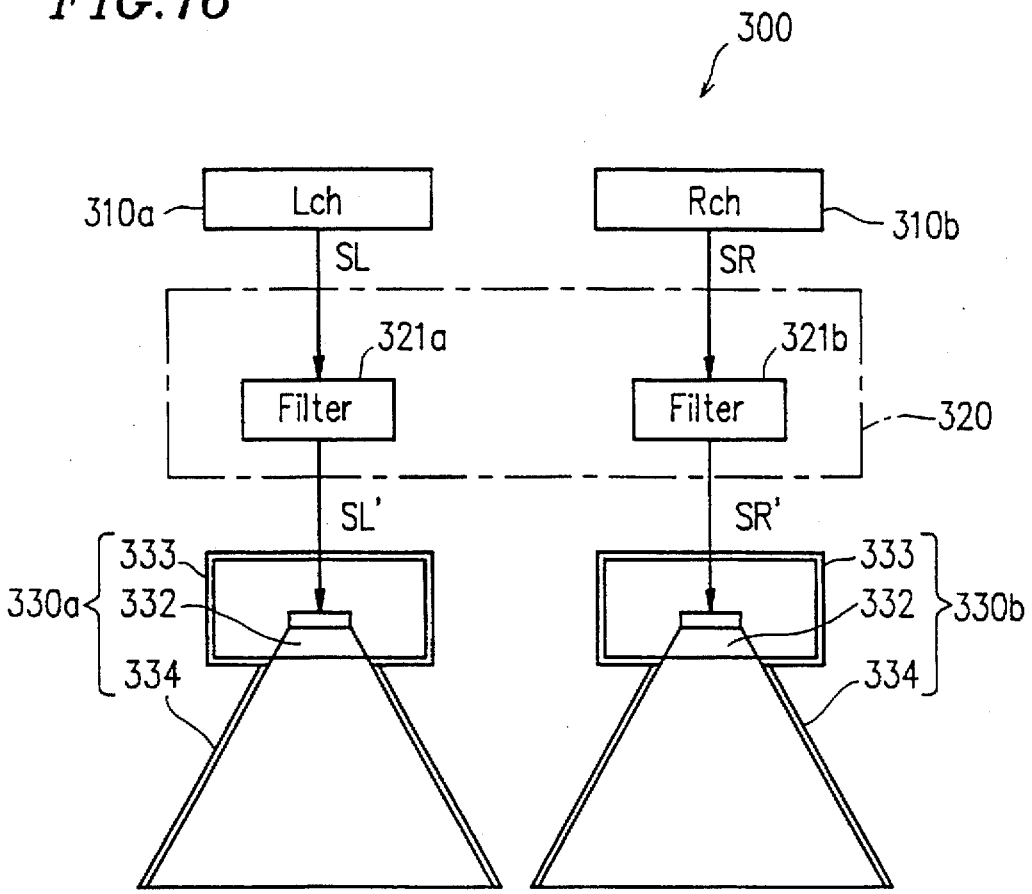
FIG. 16 is a block diagram schematically showing the construction of a sound field controller in Example 9 according to the invention.

FIG. 16 is a block diagram schematically showing the construction of a sound field controller 300 according to Example 9. Example 9 implements a sound field controller having a reproduced sound pressure frequency characteristic with less peak dips, considering the resonance phenomenon of the loudspeaker system.

As shown in FIG. 16, sound signals SL and SR from an L-channel (Lch) signal source 310*a* and a R-channel (Rch) signal source 310*b* are input into filters 321*a* and 321*b* of a signal processing section 320, respectively. Sound signals SL' and SR' processed in the signal processing section 320 are reproduced from loudspeaker systems 330*a* and 330*b*, respectively. The loudspeaker systems 330*a* and 330*b* are used for emitting the Lch and Rch sounds, respectively, and each of them includes a loudspeaker unit 332, a back cavity 333, and a horn 334.

Each of the filters 321*a* and 321*b* can be constructed, for example, by a BIQUAD n-stage serial-connection type IIR filter (n is a natural number) using a digital signal processor (DSP). The natural number n corresponds to the number of resonance frequencies to be attenuated. The filters 321*a* and 321*b* have a prescribed number of peak dips in a frequency band of the sound to be reproduced, and thus modify the sound pressures in predetermined frequencies of the sounds emitted from the loudspeaker systems 330*a* and 330*b* which are respectively connected to the filters 321*a* and 321*b*.

Figure 17:
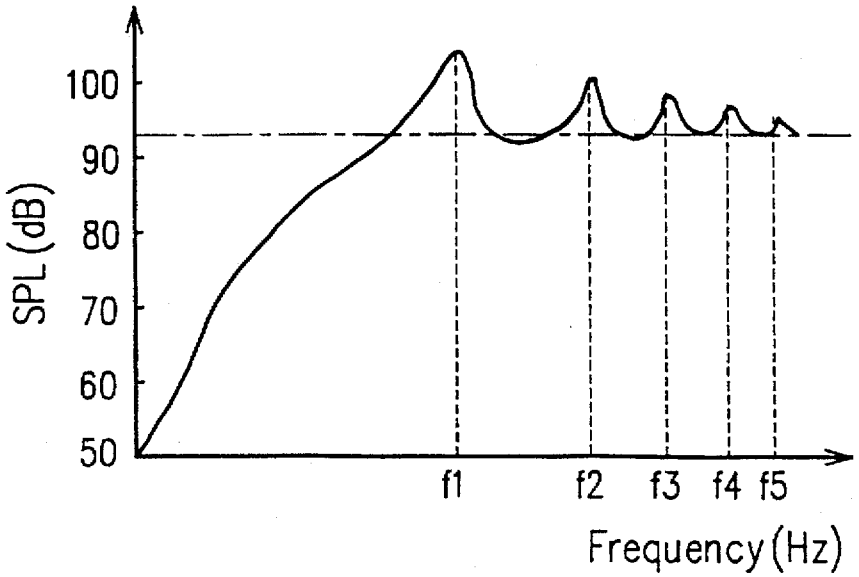
FIG. 17 is a graph showing a frequency characteristic of the loudspeaker system in Example 9.

FIG. 17 shows the reproduced sound pressure frequency characteristic in the case where the sound is reproduced by one loudspeaker system 330*a* (or one loudspeaker system 330*b*, hereinafter collectively referred to as a loudspeaker system 330) including the horn 334 without filters. Similar to the characteristic in the conventional loudspeaker system which has been described, peaks occur at resonance frequencies f1, f2, . . . caused by a standing wave generated in accordance with the length of the horn 334.

Figure 18:
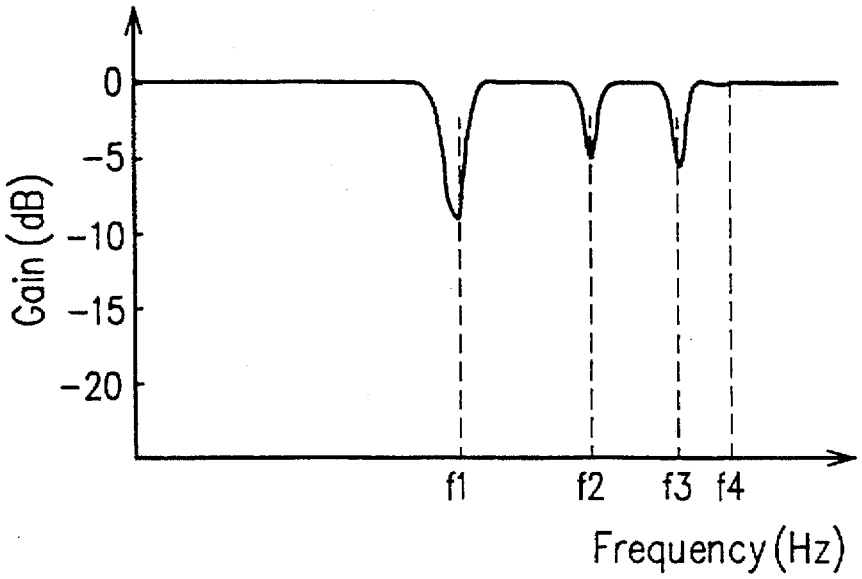
FIG. 18 is a graph showing a frequency characteristic of a filter used in the examples according to the invention.

FIG. 18 is a graph showing the frequency characteristic of the filter 321*a* (or 321*b*, hereinafter collectively referred to as a filter 321). This graph shows the output signal (SL' or SR') from the filter 321 of the signal processing section 320, when a sound signal having a frequency band of audible sound is output from the signal source 310*a* (or 310*b*) and processed by the corresponding filter 321. As shown in FIG. 18, the filter 321 reduces the gain of the signal to a desired level at the resonance frequencies f1, f2, . . . of the loudspeaker system 330.

Figure 19:
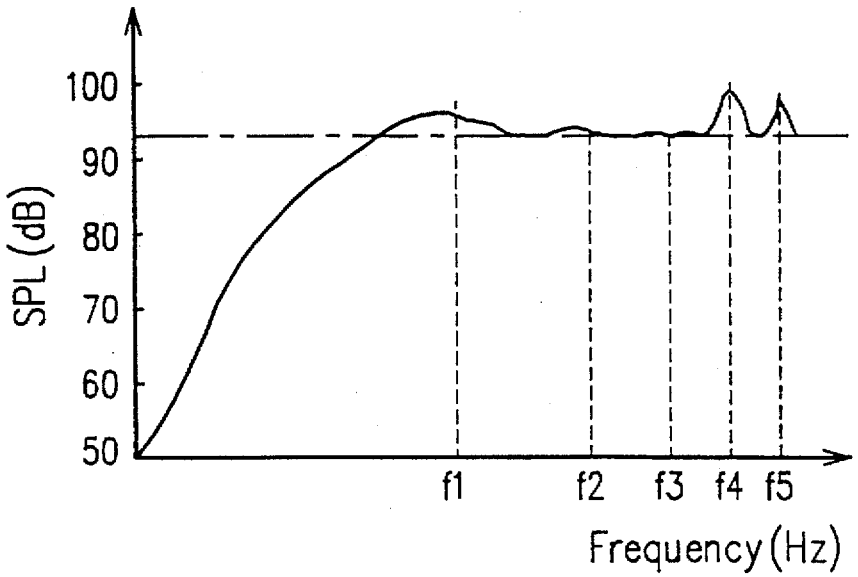
FIG. 19 is a graph showing a reproduce sound pressure frequency characteristic in the examples according to the invention.

The output signal of the signal processing section 320 is input into the loudspeaker system 330. The loudspeaker system 330 has the pressure frequency characteristic as shown in FIG. 17, so that the emitted sound reproduced from the loudspeaker system 330 has the output frequency characteristic shown in FIG. 19. The influence of the standing wave by the horn 334 is eliminated in the output frequency characteristic, so that a sound with high clarity can be obtained.

In this example, the filter 321 is constituted by a BIQUAD 3-stage serial connection type IIR filter. The gains supplied to the IIR filter are determined based on differences between the peak levels in the frequency characteristic of the loudspeaker system 330 and the desired output sound pressure levels at the resonance frequencies f1, f2, and f3 of the horn 334, so as to realize the dips at the respective resonance frequencies shown in FIG. 18 (in one channel). In this example, the peaks at the resonance frequencies f1 to f3 are removed. Alternatively, by increasing the number of stages of the IIR filter, the peaks at higher-order resonance frequencies can be removed. The manner for establishing the gains is not limited to the above-described specific one. The desired characteristic can alternatively be attained by a certain gain. In this example, the IIR filter is constituted by a digital filter using a DSP. Alternatively, the IIR filter may be an analog filter. In this example, the Lch and Rch signals from the stereophonic source are used. It is appreciated that if a monophonic signal is used, the same effects can be attained.

Figure 20:
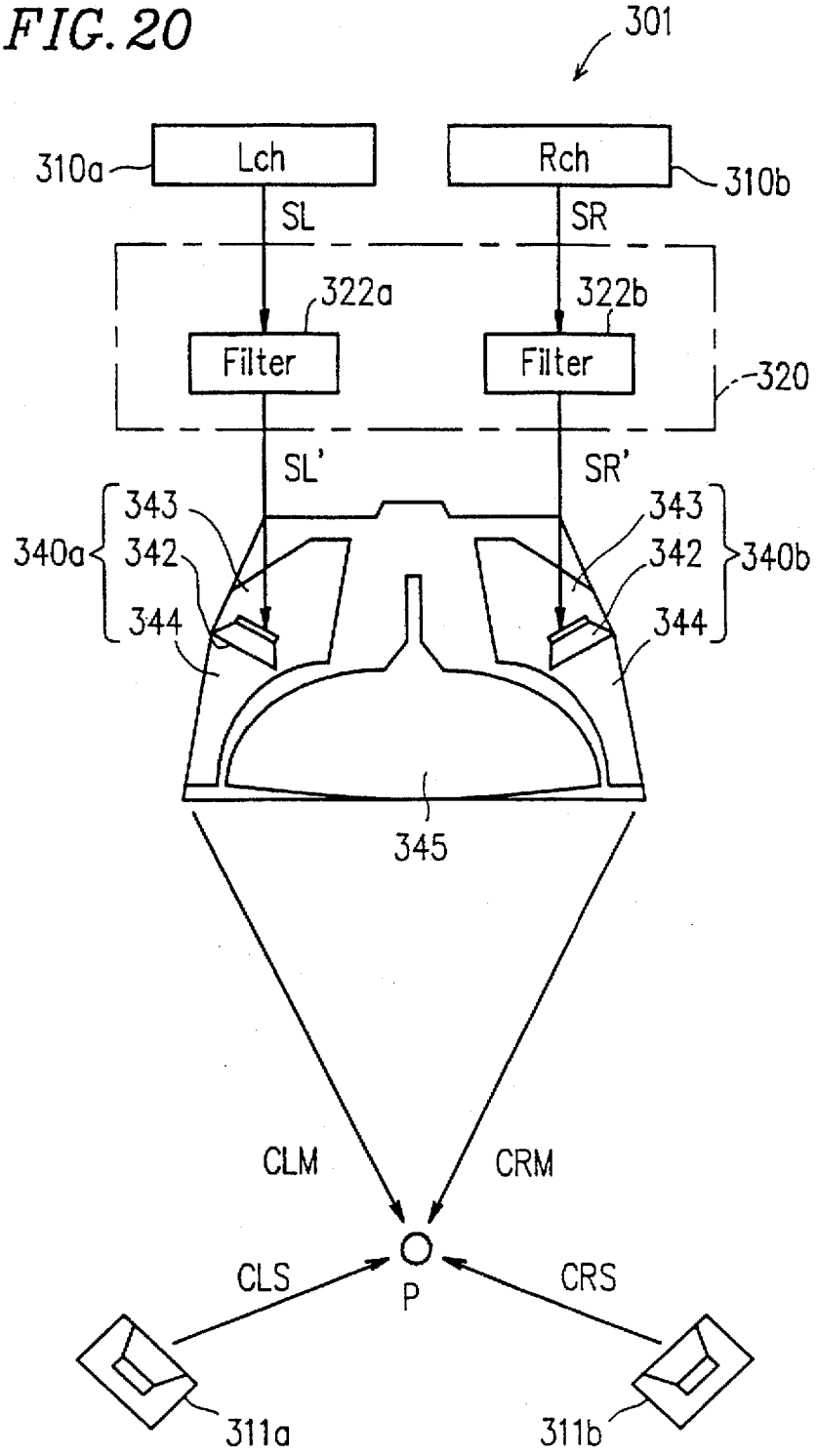
FIG. 20 is a diagram showing the construction of a sound reproducing apparatus in Example 10 according to the invention.

Next, a sound reproducing apparatus 301 in Example 10 according to the invention will be described with reference to the figures. FIG. 20 shows the construction of the sound reproducing apparatus 301 used in a television system. As shown in FIG. 20, the television system includes loudspeaker systems 340*a* and 340*b* mounted on the left and right sides of a cathode-ray tube 345. The loudspeaker systems 340*a* and 340*b* utilize the rear space and the slight spaces on the left and right sides of the cathode-ray tube 345, so that the shapes of a back cavity 343 and a horn 344 provided for a loudspeaker unit 342 are different from those of the back cavity 333 and the horn 334 shown in FIG. 16.

In an audio room for watching and listening to the television, rear loudspeakers 311*a* and 311*b* are provided on the left rear and right rear sides. The rear loudspeakers 311*a* and 311*b* are connected to the signal processing section 320 (not shown), respectively. Surround sounds are emitted from these rear loudspeakers.

The signals from the Lch signal source 310*a* and the Rch signal source 310*b* are input into filters 322*a* and 322*b* of the signal processing section 320, respectively. These filters 322*a* and 322*b* have the frequency characteristics shown in FIG. 18, similar to the filters 321*a* and 321*b* (in other words, have gain characteristics having dips at resonance frequencies of the loudspeaker systems 340*a* and 340*b*). The output of the filter 322*a* is applied to the loudspeaker system 340*a* and the output of the filter 322*b* is applied to the loudspeaker system 340*b*.

In the sound reproducing apparatus 301 having the above-described construction, the sound output from the loudspeaker system 340*a* reaches a listener P via the path of the transfer function CLM, and the sound output from the loudspeaker system 340*b* reaches the listener P via the path of the transfer function CRM. The signals of the surround sounds generated by the signal processing section 320 are reproduced from the rear loudspeakers 311*a* and 311*b*, and then received by the listener P via the paths of the transfer functions CLS and CRS. Thus, according to the sound reproducing apparatus 301, sounds with high clarity and flat frequency characteristics are output from the front loudspeaker systems 340*a* and 340*b* provided for the television system, and surround sounds with a rich sense of presence are output from the rear loudspeakers 311*a* and 311*b*.

The sound reproducing apparatus 301 shown in FIG. 20 requires the rear loudspeakers 311*a* and 311*b* for generating the surround sounds. However, the provision of rear loudspeakers of the television system causes the price of the apparatus to increase, and requires long wiring to a position remote from the television receiver. In the case of a wireless type rear loudspeaker with cells included therein, the exchange of the exhausted cell is a troublesome operation for the listener. Therefore, a sound reproducing apparatus which can provide the surrounding effect without using rear loudspeakers is required.

Figure 21:
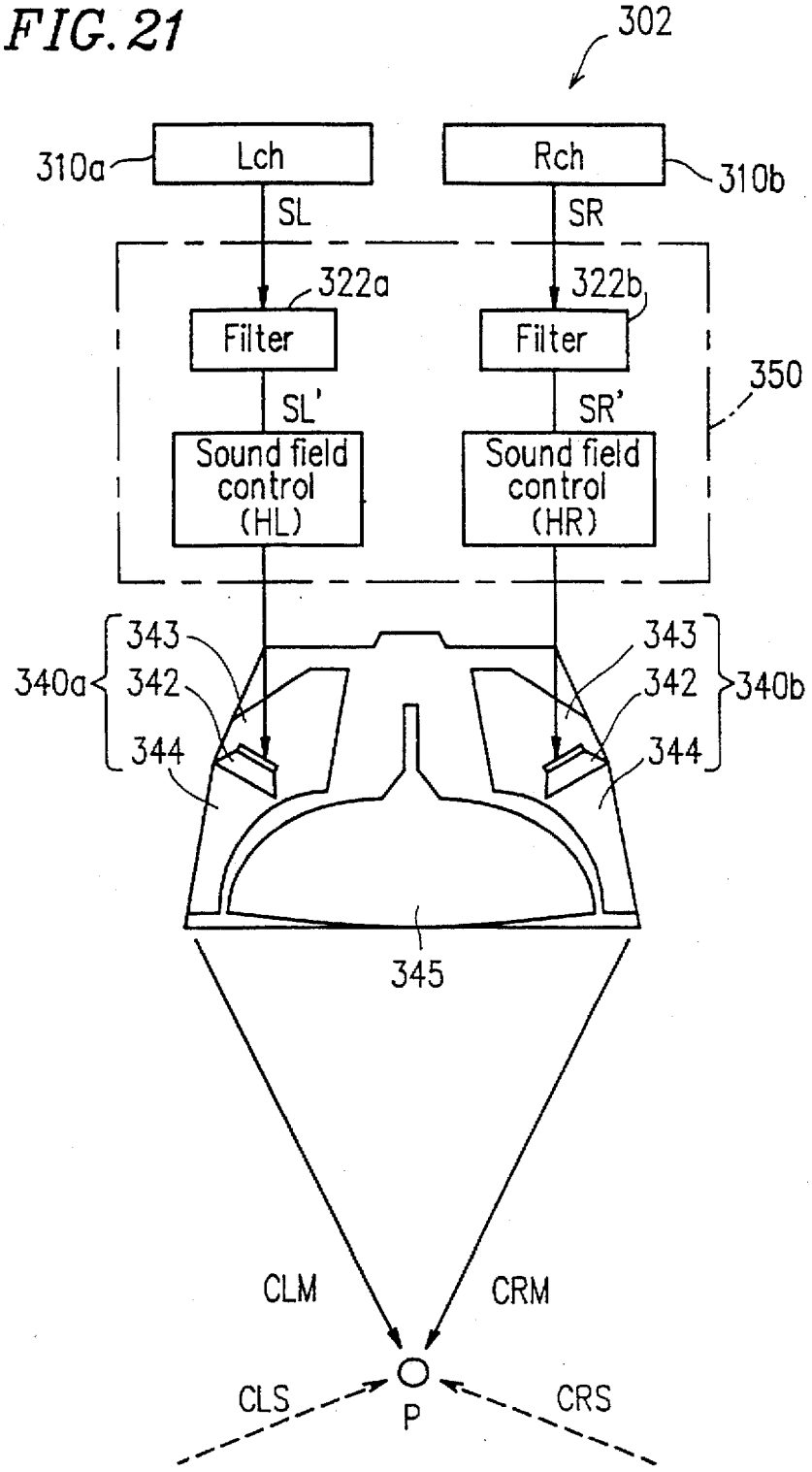
FIG. 21 is a diagram schematically showing the construction of a sound reproducing apparatus in Example 11 according to the invention.

A sound reproducing apparatus 302 in Example 11 according to the invention negates the above problems. FIG. 21 is a diagram schematically showing the construction of the sound reproducing apparatus 302. Components which are the same as those in the sound reproducing apparatus 301 shown in FIG. 20 are designated by the same reference numerals, and the descriptions thereof are omitted.

A signal processing section 350 of the sound reproducing apparatus 302 includes filters 322*a* and 322*b* and sound field control sections 351*a* and 351*b* for the left and right channels, respectively. The outputs of the sound field control sections 351*a* and 351*b* are applied to the loudspeaker systems 340*a* and 340*b*, respectively. The sound field control sections 351*a* and 351*b* can be constituted, for example, by a DSP, or the like, similar to the filters 322*a* and 322*b*. The transfer functions (filter coefficients) in the sound field control sections 351*a* and 351*b* transform the input sound signals so that the surround sounds can be reproduced from the front loudspeaker systems 340*a* and 340*b*. More specifically, the transfer function HL of the sound field control section 351*a* is set to be (1+CLS/CLM), and the transfer function HR of the sound field control section 351*b* is set to be (1+CRS/CRM).

The operation of the sound reproducing apparatus 302 having the above-described construction will be described. For the frequency characteristics of the filters 322*a* and 322*b*, similar to Example 10, the gains are set so as to remove the influence by the resonance frequencies of the loudspeaker systems 340*a* and 340*b*. The sound signal SL output from the signal source 310*a* is processed by the filter 322*a*, so as to generate a signal SL' in which the gains at the resonance frequencies of the horn 344 are reduced. The signal SL' is input into the sound field control section 351*a*, and multiplied by the transfer function HL=(1+CLS/CLM). Thus, a signal of SL·(1+CLS/CLM) is output (the symbol "·" indicates the multiplication).

The signal SL·(1+CLS/CLM) is input into the loudspeaker system 340*a*, and sound transformed by the loudspeaker unit 342. The frequency characteristic of the horn 344 is the same as that shown in FIG. 17, so that the sound wave emitted from the horn 344 is SL·(1+CLS/CLM). When the sound wave reaches the ears of the listener via the sound path of the transfer function CLM, the sound wave becomes SL·(1+CLS/CLM)·CLM=SL·(CLM+CLS). This value is equal to the synthetic sound of the front loudspeaker system 340*a* and the rear loudspeaker 311*a* shown in FIG. 20. Thus, the surrounding effect which is the same as that attained by the sound reproducing apparatus 301 in Example 10 can be attained. In the above description, the Lch signal SL is described. It is appreciated that the same description can be made for the Rch signal SR.

As described above, the Lch and Rch signals are listened to as coming from directions which are indicated by broken lines in FIG. 21 (i.e., from virtual loudspeakers), so that rear loudspeakers for reproducing surround sounds are not required.

As for the signals of stereophonic source, the frequency components of the standing wave depending on the lengths of the horns 344*a* and 344*b* are reduced by the filters 322*a* and 322*b*. Therefore, in the case where sounds are output from the horns 344*a* and 344*b*, the reproduced sound pressure frequency characteristics are not influenced by the standing wave by the horns. As a result, it is possible to supply sounds with high clarity to the listeners. In addition, by the sound field control sections 351*a* and 351*b*, it is possible to attain a surrounding effect with a rich sense of presence without providing rear loudspeakers.

Figure 22:
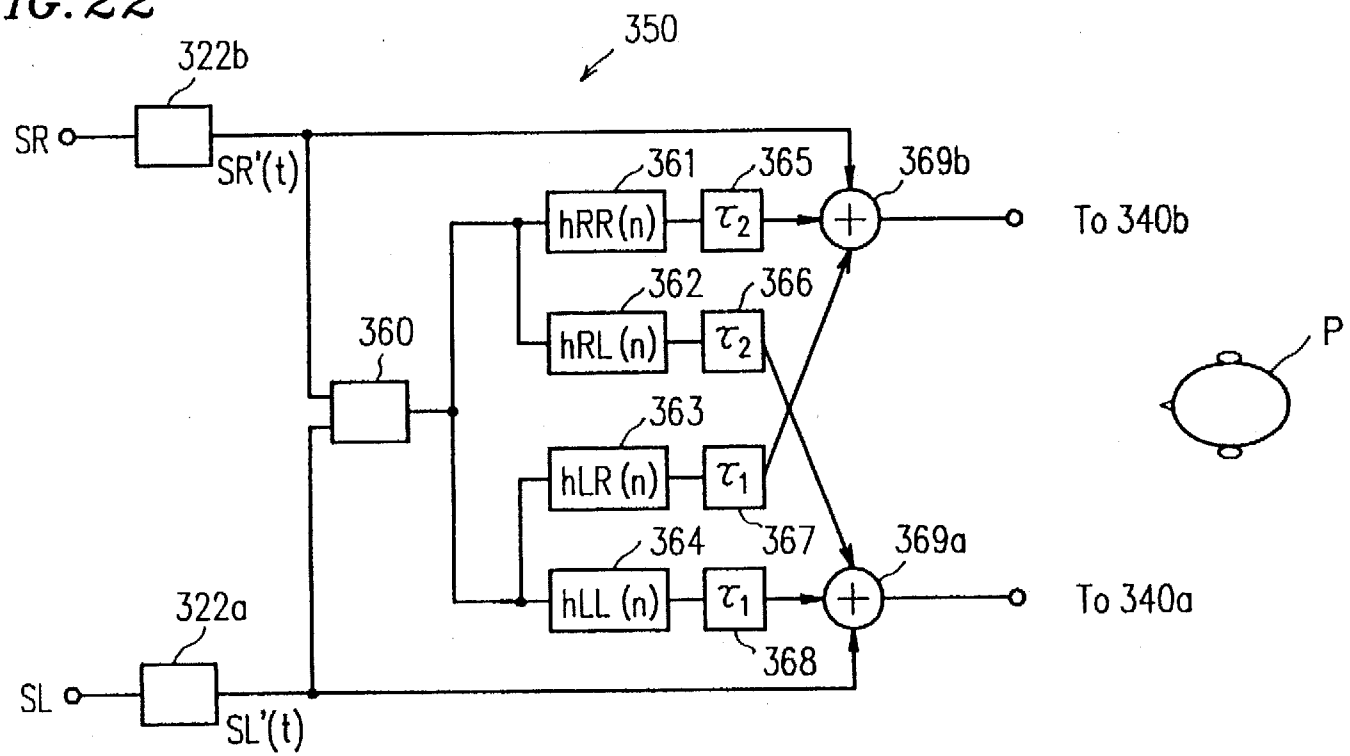
FIG. 22 is a block diagram showing the construction of a signal processing section in a sound reproducing apparatus in Example 12 according to the invention.

Next, the signal processing section 350 in the sound reproducing apparatus in Example 12 will be described. The sound reproducing apparatus has the same construction as that of the sound reproducing apparatus 302 shown in FIG. 21, except for the construction of the signal processing section 350. FIG. 22 is a block diagram showing the construction of the signal processing section 350 in Example 12. In FIG. 22, an output signal SL' from the filter 322*a* and an output signal SR' from the filter 322*b* are each divided into two branches. One of the branched signals of SL' and one of the branched signals of SR' are applied to a difference signal extractor 360 and the others to adders 369*a* and 369*b*, respectively. The difference signal extractor 360 calculates the difference between the two signals applied thereto, and outputs the difference signal to operational circuits 361, 362, 363, and 364.

Each of the operational circuits 361 and 362 comprises an FIR filter having an impulse response, whereby the sound image being localized on the right side or right rear of the listener P by FIR filtering. Each of the operational circuits 363 and 364 comprises an FIR filter having an impulse response which allows the sound image to be localized on the left side or left rear of the listener P by convolution.

In other words, the operational circuit 361 has an impulse response hRR(n), the operational circuit 362 an impulse response hRL(n), the operational circuit 363 an impulse response hLR(n), and the operational circuit 364 an impulse response hLL(n). The output of the operational circuit 361 is applied to the adder 369*b* via a delay circuit 365, the output of the operational circuit 362 to the adder 369*a* via a delay circuit 366, the output of the operational circuitry 363 to the adder 369*b* via a delay circuit 367, and the output of the operational circuitry 364 to the adder 369*a* through a delay circuit 368.

The delay circuits 365 and 366 delay the input signals by the delay time $\tau_1$, and the delay circuits 367 and 368 delay the input signals by the delay time $\tau_2$.

The adder 369*b* adds the signals output from the filter 322*b*, the delay circuit 365, and the delay circuit 367 to each other at an arbitrary ratio. The adder 369*a* adds the signals output from the filter 322*a*, the delay circuit 366, and the delay circuit 368 at an arbitrary ratio.

The added signals of the adders 369*a* and 369*b* are applied to loudspeaker systems 340*a* and 340*b*, respectively. Though not shown in the figure, the output signal of the adders 369*a* and 369*b* are output to the loudspeaker systems 340*a* and 340*b* via power amplifiers, respectively.

The operation of the signal processing section 350 in Example 12 having the above-mentioned construction will be described below.

First, signals SR' and SL' output from the filters 322*a* and 322*b* (e.g., audio signals such as a voice, sound, or music) are each divided into two branches. One of the branched signals of SL' and one of the branched signals of SR' are applied to a difference signal extractor 360 and the others to adders 369*a* and 369*b*, respectively. The difference signal extractor 360 calculates the difference between the two signals applied thereto, and outputs the difference signal to operational circuits 361, 362, 363, and 364.

In the difference signal calculated by the difference signal extractor 360, the centrally-localized signal may be substantially canceled and most of the components would be reverberation components of Lch and Rch signals which are inserted during recording or broadcasting. For example, when the input signals are music signals with the singing voice of a singer, the centrally-localized signal of the singer's voice signal is almost canceled by subtracting operation with the remainder of reverberation components in the difference signal. For this reason, the difference signal is sometimes called a surround signal.

The operational circuits 363 and 364 perform the convolution on the input signal to localize the sound image on the left side or left rear.

The output signals from the operational circuits 361 and 362 are applied to the delay circuits 365 and 366, respectively, and delayed by $\tau_2$. The output signals from the operational circuits 363 and 364 are applied to the delay circuits 367 and 368, respectively, and delayed by $\tau_1$. An optimal amount of the delay time is about 10 msec. with respect to the input signal, the amount being empirically obtained. An optimal difference between the delay times $\tau_1$ and $\tau_2$ is also experimentally obtained with an amount of about 10 msec. The difference between the delay times $\tau_1$ and $\tau_2$ in the respective phantoms to be localized on the left side and right side allows the phantoms to be distinguished as to whether a phantom is localized on the left side or the right side.

In the next step, the output signals from the delay circuits 365 and 367 are applied to the adder 369*b*, added to the signal SR' output from the filter 322*b*, and mixed with the signal SR' at a desirable ratio by the adder 369*b*. Similarly, the output signals from the delay circuits 366 and 368 are applied to the adder 369*a*, added to and mixed with the signal SL' output from the filter 322*a* at a desirable ratio by the adder 369. The resulting signals are acoustically reproduced by the loudspeaker systems 340*a* and 340*b*, respectively.

Figure 23:
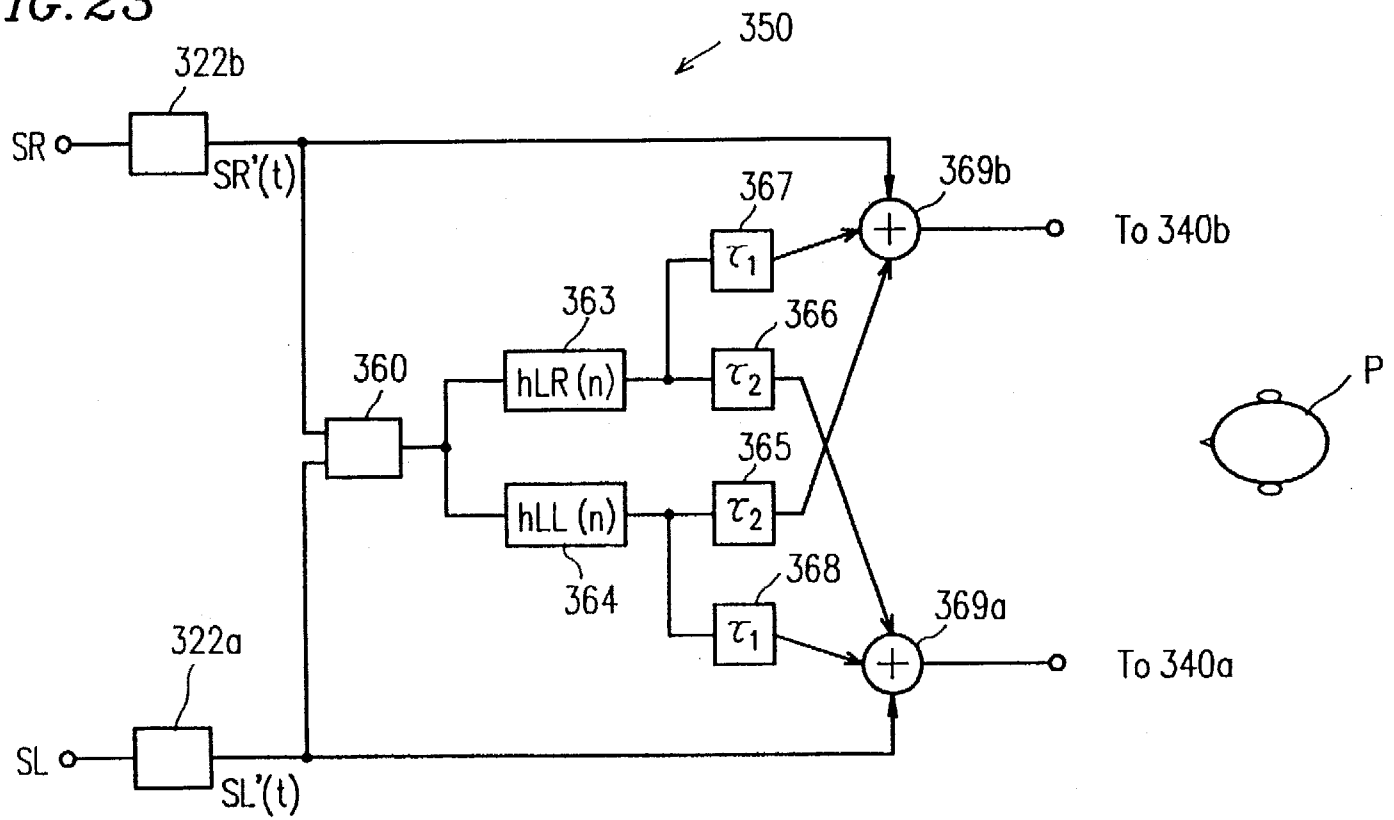
FIG. 23 is a block diagram showing the construction of a sound processing section in a sound reproducing apparatus in Example 13 according to the invention.

Next, the signal processing section 350 in a sound reproducing apparatus in Example 13 will be described. The sound reproducing apparatus in Example 13 is the same as the sound reproducing apparatus in Example 12 shown in FIG. 21, except for the construction of the signal processing section 350. FIG. 23 is a block diagram showing the construction of the signal processing section 350 in Example 13. In FIG. 23, the output signal SL' from the filter 322*a* and the output signal SR' from the filter 322*b* are each divided into two branches. One of the branched signals of SL' and one of the branched signals of SR' are applied to a difference signal extractor 360. The difference signal extractor 360 outputs a difference signal to operational circuits 363 and 364. The output signals of the operational circuits 363 and 364 are each divided into two branches, and input into delay circuits 365, 366, 367, and 368. Thereafter, the signals are output from loudspeaker systems 340*a* and 340*b* via the adders 369*a* and 369*b*.

The operation of the signal processing section 350 in Example 13 having the above-described construction is different in the following points.

Each of the output signals of the operational circuits 363 and 364 is divided into two branches. Two output signals of the operational circuit 363 are applied to the delay circuits 367 and 366, and two output signals of the operational circuit 364 are applied to the delay circuits 365 and 368.

In the case where the sound images are to be localized on the left and right sides of the listener P, by setting the two impulse responses hLL(n) and hLR(n) for localizing the sound image on the left side inversely in the respective signals, the sound image can be localized rightward in simple manner. The above-mentioned configuration is based on the assumption that the impulse responses at the left and right ears of the listener P are laterally symmetric. Under this condition, it is possible to reduce the size of the operational circuits for localizing the left and right sound images by applying one branched signal of each of the operational circuits 363 and 364 straight to the corresponding adder and the other crosswise to the other adder via the delay circuits 365 to 368 as shown in FIG. 23. Thereafter, the operation is the same as that in Example 12.

Figure 24:
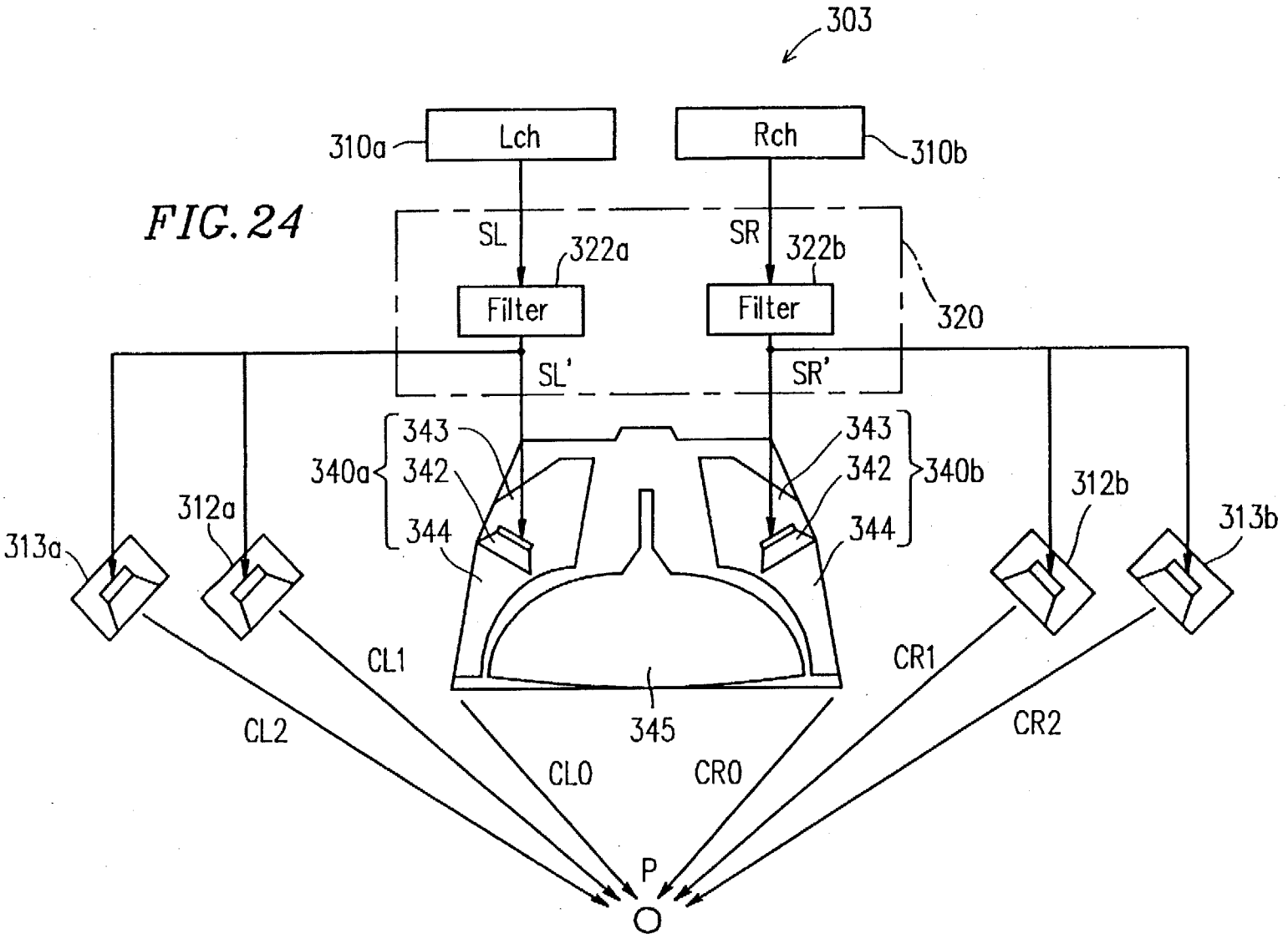
FIG. 24 is a diagram schematically showing the construction of a sound reproducing apparatus in Example 14 according to the invention.

Next, a sound reproducing apparatus 303 in Example 14 according to the invention will be described with reference to the figures. The sound reproducing apparatus 303 is provided for a television system, so as to attain an effect for expanding the sound image. In the sound reproducing apparatus 303 as shown in FIG. 24, similar to Example 10, right and left loudspeaker systems 340*a* and 340*b* are mounted on the right and left sides of a cathode-ray tube 345 of the television system. Also in Example 14, in the loudspeaker systems 340*a* and 340*b*, back cavities 343 and horns 344 are provided by utilizing the rear space and the right and left slight side spaces of the cathode-ray tube 345.

In an audio room for watching and listening to the television, on the left and right sides of the television system, effect loudspeakers 312*a*, 313*a*, 312*b*, and 313*b* are provided. The effect loudspeaker 312*a* is located inside on the left side, and the effect loudspeaker 313*a* is located outside on the left side of the loudspeaker system 340*a*. Similarly, the effect loudspeaker 312*b* is located inside on the right side, and the effect loudspeaker 313*b* is located outside on the right side of the loudspeaker system 340*b*. These effect loudspeakers are used for expanding the output space for the sound, and for reproducing the moving of the sound image.

The output of the filter 322*a* of the signal processing section 320 is connected to the loudspeaker system 340*a* and the effect loudspeakers 312*a* and 313*a*. The output of the filter 322*b* is connected to the loudspeaker system 340*b* and the effect loudspeakers 312*b* and 313*b*. The transfer functions of the sound paths from the loudspeaker system 340*a* and effect loudspeakers 312*a* and 313*a* to the listener P are denoted by CL0, CL1, and CL2, respectively. Similarly, the transfer functions of the sound paths from the loudspeaker system 340*b* and effect loudspeakers 312*b* and 313*b* to the listener P are denoted by CR0, CR1, and CR2, respectively.

In the sound reproducing apparatus 303 having the above-described construction, the sound output from the loudspeaker system 340*a* reaches the listener P via the path of the transfer function CL0, and the sound outputs from the effect loudspeakers 312*a* and 313*a* reach the listener P via the paths of the transfer functions CL1 and CL2, respectively. Accordingly, the synthetic sound of the Lch which reaches the listener P is SL·(CL0+CL1+CL2). Similarly, the synthetic sound of the Rch which reaches the listener P is SR·(CR0+CR1+CR2). In this way, the sound field is expanded and reproduced.

The sound reproducing apparatus 303 shown in FIG. 24 requires the effect loudspeakers 312*a*, 313*a*, 312*b*, and 313*b* for generating a surround sound which is expanded in left and right directions. However, the provision of effect loudspeakers for the television system is disadvantageous in terms of space and price. Therefore, a sound reproducing apparatus which uses no effect loudspeakers for exhibiting an effect of sound expansion is also required.

Figure 25:
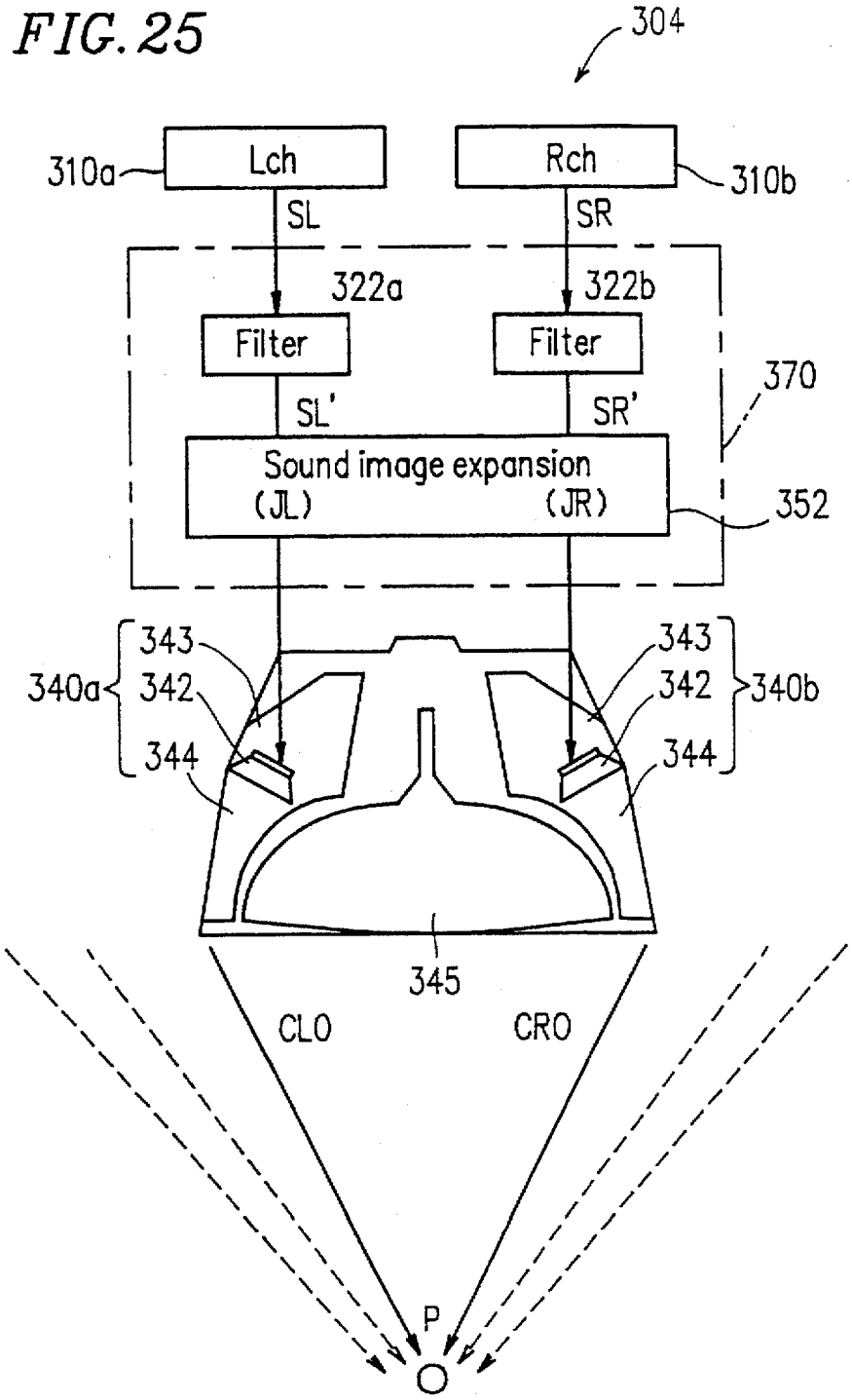
FIG. 25 is a diagram schematically showing the construction of a sound reproducing apparatus in Example 15 according to the invention.

Next, a sound reproducing apparatus 304 in Example 15 is described. The sound reproducing apparatus 304 in Example 15 is improved in view of the above problem. FIG. 25 is a diagram schematically showing the construction of the sound reproducing apparatus 304. Components which are the same as those in the sound reproducing apparatus 303 shown in FIG. 24 are designated by the same reference numerals, and the descriptions thereof are omitted.

A signal processing section 370 of the sound reproducing apparatus 304 includes filters 322*a* and 322*b* for the respective left and right channels, and a sound image expanding section 352. The outputs of the sound image expanding section 352 are applied to the loudspeaker systems 340*a* and 340*b*, respectively. The sound image expanding section 352 can be constructed, for example, by a DSP, and the like, similar to the filters 322*a* and 322*b*. The transfer function (filter coefficient) in the sound image expanding section 352 transforms the input sound signal so that the effect sound can be reproduced from only the front loudspeaker systems 340*a* and 340*b*. More specifically, the transfer function JL of the Lch in the sound image expanding section 352 is set to be (CL0+CL1+CL2)/CL0, and the transfer function JR of the Rch is set to be (CR0+CR1+CR2)/CR0.

Figure 26:
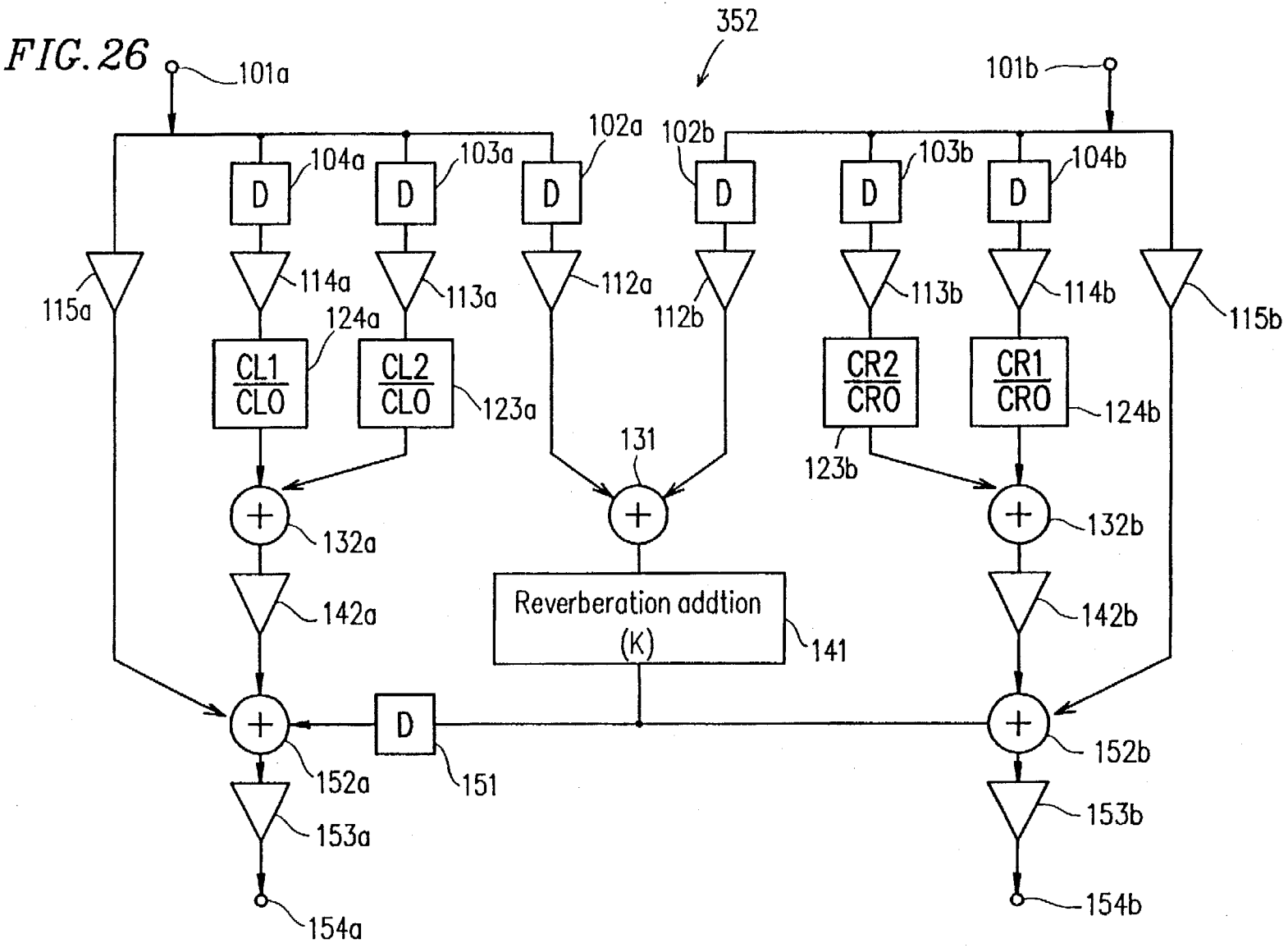
FIG. 26 is a diagram showing a specific example of a sound image expanding section in Example 15.

FIG. 26 shows an exemplary specific construction for the sound image expanding section 352. In FIG. 26, the Lch and Rch signals are applied to input terminals 101*a* and 101*b*, respectively. The signal input through the input terminal 101*a* is branched into four signals. Three of the four signals are connected to delay circuits (delay: D) 102*a*, 103*a*, and 104*a*. Similarly, the signal input through the input terminal 101*b* is branched into four signals. Three of the four signals are connected to delay circuits (delay: D) 102*b*, 103*b*, and 104*b*. The outputs of the delay circuits 102*a*, 103*a*, and 104*a* and the remaining one of the four signals from the input terminal 101*a* are connected to gain adjusters 112*a*, 113*a*, 114*a*, and 115*a*, respectively. Similarly, the outputs of the delay circuits 102*b*, 103*b*, and 104*b* and the remaining one of the four signals from the input terminal 101*b* are connected to gain adjusters 112*b*, 113*b*, 114*b*, and 115*b*, respectively.

The outputs of the gain adjusters 112*a* and 112*b* are applied to an adder 131, the outputs of the gain adjusters 113*a*, 114*a*, 113*b*, and 114*b* are applied to operational circuits 123*a*, 124*a*, 123*b*, and 124*b*, respectively.

The transfer function of the operational circuit 123*a* is CL2/CL0, and the transfer function of the operational circuit 124*a* is CL1/CL0. Similarly, the transfer function of the operational circuit 123*b* is CR2/CR0, and the transfer function of the operational circuit 124*b* is CR1/CR0. These operational circuit 123*a*, 124*a*, 123*b*, and 124*b* are circuits which perform operations for producing signals for moving and expanding the sound image. The outputs of the operational circuits 123*a* and 124*a* are applied to an adder 132*a*. The outputs of the operational circuits 123*b* and 124*b* are applied to an adder 132*b*. The outputs of the adders 132*a* and 132*b* are applied to adders 152*a* and 152*b* via gain adjusters 142*a* and 142*b*, respectively.

On the other hand, the output of the adder 131 is applied to a reverberation adding circuit 141. The reverberation adding circuit 141 is constructed, for example, by a Schroeder circuit or the like, and adds the reverberation sound. The output signal of the reverberation adding circuit 141 is directly supplied to an adder 152*b*, and supplied to an adder 152*a* via a delay circuit 151.

The adder 152*a* is a circuit for adding the direct sound signal which is the Lch input signal output via the gain adjuster 115*a*, the sound image moving signal output from the gain adjuster 142*a*, and the reverberation sound signal output from the delay circuit 151 to each other. Similarly, the adder 152*b* is a circuit for adding the direct sound signal which is the Rch input signal output via the gain adjuster 115*b*, the sound image moving signal output from the gain adjuster 142*b*, and the reverberation sound signal output from the reverberation adding circuit 141 to each other.

The synthetic Lch sound signal generated by the adder 152*a* is output from an output terminal 154*a* via a gain adjuster 153*a*. The synthetic Rch sound signal generated by the adder 152*b* is output from an output terminal 154*b* via a gain adjuster 153*b*.

The operation of the sound reproducing apparatus 304 including the sound expanding section 352 with the above-described construction will be described. Similar to the case in Example 10, as for the frequency characteristics of the filters 322*a* and 322*b* shown in FIG. 25, the gains are set so as to remove the influence by the resonance frequencies of the loudspeaker systems 340*a* and 340*b*. The sound signal SL output from the signal source 310*a* is processed by the filter 322*a*, so as to produce a signal SL' with reduced gains at the resonance frequencies f1, f2, f3, . . . of the horn 344. The signal SL' is input into the sound image expanding section 352. Similarly, the sound signal SR output from the signal source 310*b* is processed by the filter 322*b*, so as to produce a signal SR' with reduced gains at the resonance frequencies f1, f2, f3, . . . of the horn 344. The signal SR' is input into the sound image expanding section 352.

In FIG. 26, the signal SL' input to the input terminal 101*a* is processed by the delay circuit and the gain adjuster, as described above. Then, the processed signal SL' is input into the adder 132*a* via the operational circuit 123*a* and 124*a*. At this time, the output of the adder 132*a* is SL'·(CL1/CL0)+SL'·(CL2/CL0). When the transfer function of the reverberation adding circuit 141 is K/CL0, and the delay of the delay circuit 151 is indicated by a transfer function D, the output of the adder 152*a* is represented by:

$$SL'\cdot\{(1+(CL1/CL0)+(CL2/CL0)+(K/CL0)\cdot D\}$$

This synthetic signal is output from the output terminal 154*a* to the loudspeaker system 340*a* (FIG. 25). The output sound wave of the synthetic signal is represented by:

$$SL'\{(1+(CL1/CL0)+(CL2/CL0)+(K/CL0)\cdot D\}$$

Therefore, the sound wave which reaches the ears of the listener is represented by:

$$SL\cdot\{(1(CL1/CL0)+(CL2/CL0)\leftrightharpoons(K/CL0)\cdot D\}\cdot CL0=SL\cdot\{CL0+CL1+CL2+K\cdot D\}$$

Thus, it is possible to attain the same expanded sound effect as that in the case of the sound reproducing apparatus 303 shown in FIG. 24. In the above description, only the Lch signal SL has been described. In the same way, the sound wave for the Rch signal SR can be obtained as SR·{CR0+CR1+CR2+K}.

In this way, prescribed transfer functions are set for the operational circuits 123*a*, 124*a*, 123*b*, and 124*b*, so that the sound can be listened to by the listener P in directions indicated by broken lines in FIG. 25, even if effect loudspeakers are not used. In the signals from a stereo source, frequency components of the standing wave due to the length of the horn 344 are reduced by the filters 322*a* and 322*b*. Then, the signals are reproduced from the loudspeaker system 340. In the reproduced sound pressure frequency characteristic, the influence by the standing wave due to the horn 344 is removed, as in the characteristic shown in FIG. 19. As a result, a sound wave with high clarity can be output.

In addition, by the sound image expanding section 352, a sound image moving effect with a rich sense of presence can be attained without locating effect loudspeakers.

Figure 27:
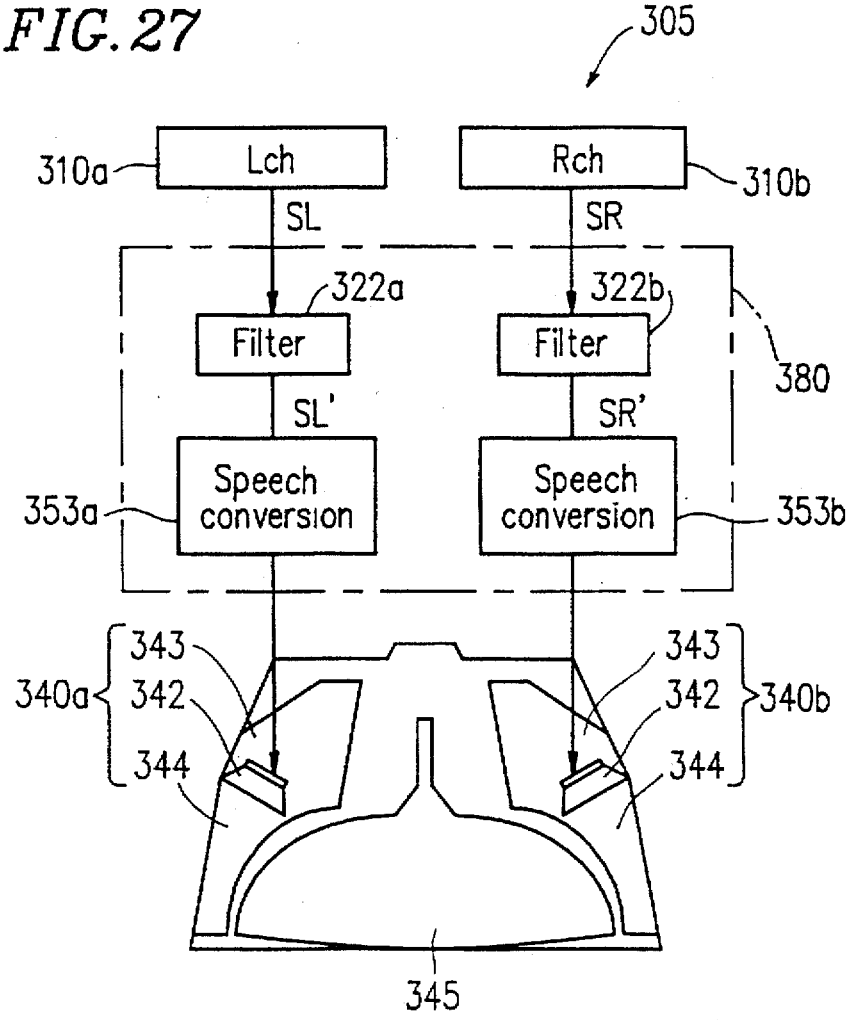
FIG. 27 is a diagram schematically showing a sound reproducing apparatus in Example 16 according to the invention.

Next, a sound reproducing apparatus 305 in Example 16 will be described with reference to the relevant figures. The sound reproducing apparatus 305 is provided for a television system, and has an effect for converting the reproducing velocity of speech signals. As shown in FIG. 27, in the sound reproducing apparatus 305, a signal processing section 380 includes filters 322*a* and 322*b* and speech converter 353*a* and 353*b* for the left and right channels, respectively. Similar to the above-described examples, the loudspeaker systems 340*a* and 340*b* are mounted on the left and right sides of a cathode-ray tube 345 of the television system. In Example 16, in each of the loudspeaker systems 340*a* and 340*b*, a small-size back cavity 343 and a horn 344 are provided by utilizing the rear space and the left and right slight spaces of the cathode-ray tube 345. Components which are the same as those in the sound reproducing apparatus 302 in the above-described example are designated by the same reference numerals, and the detailed descriptions thereof are omitted.

Signals from an Lch signal source 310*a* and a Rch signal source 310*b* are input into the filters 322*a* and 322*b*, respectively. These filters 322*a* and 322*b* have the same frequency characteristic as that shown in FIG. 18. The outputs of the filters 322*a* and 322*b* are applied to speech converters 353*a* and 353*b*, respectively. Each of the speech converters 353*a* and 353*b* is a circuit for converting the reproducing velocity so that the speech to be reproduced is easy to listen to when a speech signal to be reproduced is input, for example, in a double-velocity mode. In the case where the speech signal is input in a normal mode, the reproducing velocity of the speech signal may also be converted so as to be increased or decreased. The outputs of the speech converter 353*a* and 353*b* are applied to the loudspeaker systems 340*a* and 340*b*, respectively.

The operation of the sound reproducing apparatus 305 having the above-described construction will be described. As for the frequency characteristic of the filters 322*a* and 322*b*, similar to the above-described examples, the gains are set so as to remove influence by the resonance frequencies of the loudspeaker systems 340*a* and 340*b*. The sound signals SL and SR output from the signal sources 310*a* and 310*b* are processed by the filters 322*a* and 322*b*, respectively, so as to generate signals SL' and SR' with reduced gains at the resonance frequencies f1, f2, f3, . . . of the horn 344.

Figure 28:
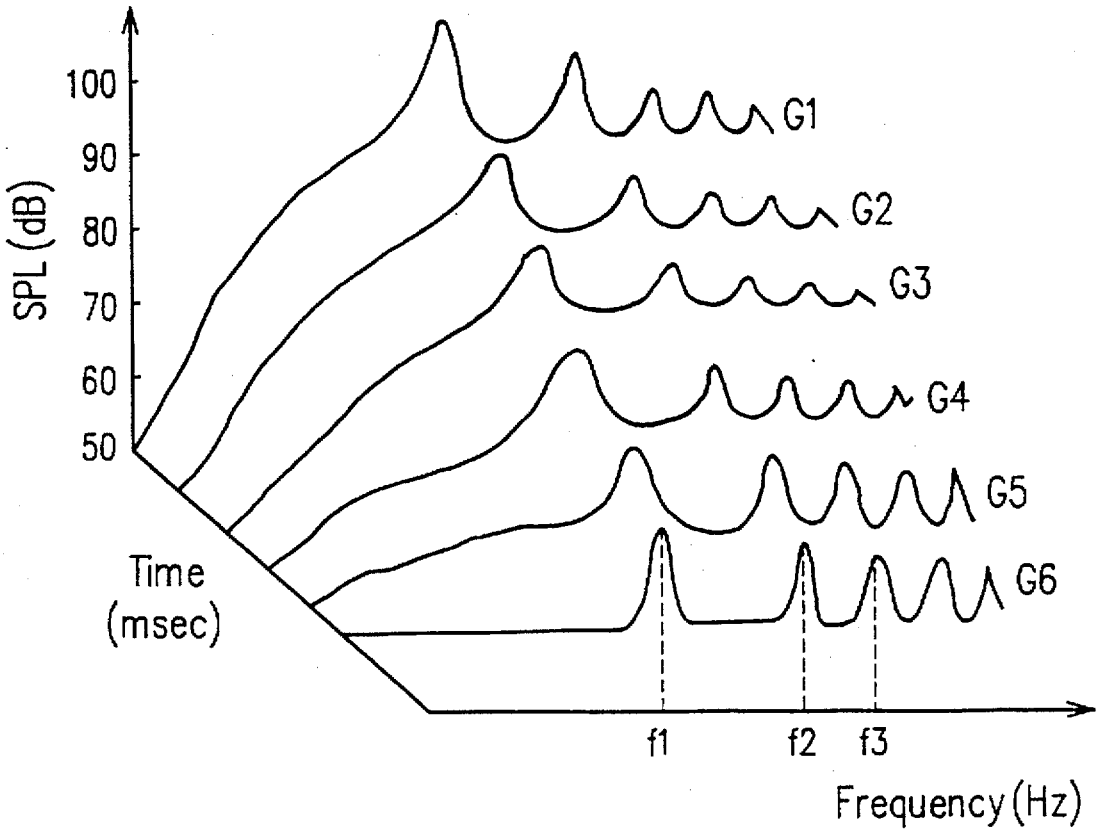
FIG. 28 is a graph showing an accumulated spectrum of a frequency characteristic (the falling characteristic) of a loudspeaker system including a horn.

In general, a speech signal is greatly affected by an accumulated spectrum of the falling characteristic of the reproduce sound pressure frequency characteristic of the loudspeaker system, when the Velocity of the speech signal is converted. FIG. 28 is a graph showing the reverberation frequency characteristic of the loudspeaker system 340*a* (and 340*b*) including the horn 344. For example, curve G1 in FIG. 28 indicates the reproduction frequency characteristic in the case where the length of the horn of the loudspeaker system is not sufficient.

If a resonance due to the horn occurs in the frequency range of the reproduced sound, the sound pressure is abruptly increased at the resonance frequencies f1, f2 . . . If a random signal is shut out in this state, a reverberation vibration occurs in the horn and the diaphragm, so that the intensity of the output spectrum is gradually decreased as time elapses, as shown by curves G2, G3, . . . G6 in FIG. 28. Though the sound signal from the signal source is blocked, the peaks of sound pressure are retained at the resonance frequencies f1, f2, . . . for a short time period in curves G2 to G6. Such a phenomenon degrades the clarity of reproduced sound, so that so-called "sharpness" of the reproduced sound may be poor.

Figure 29:
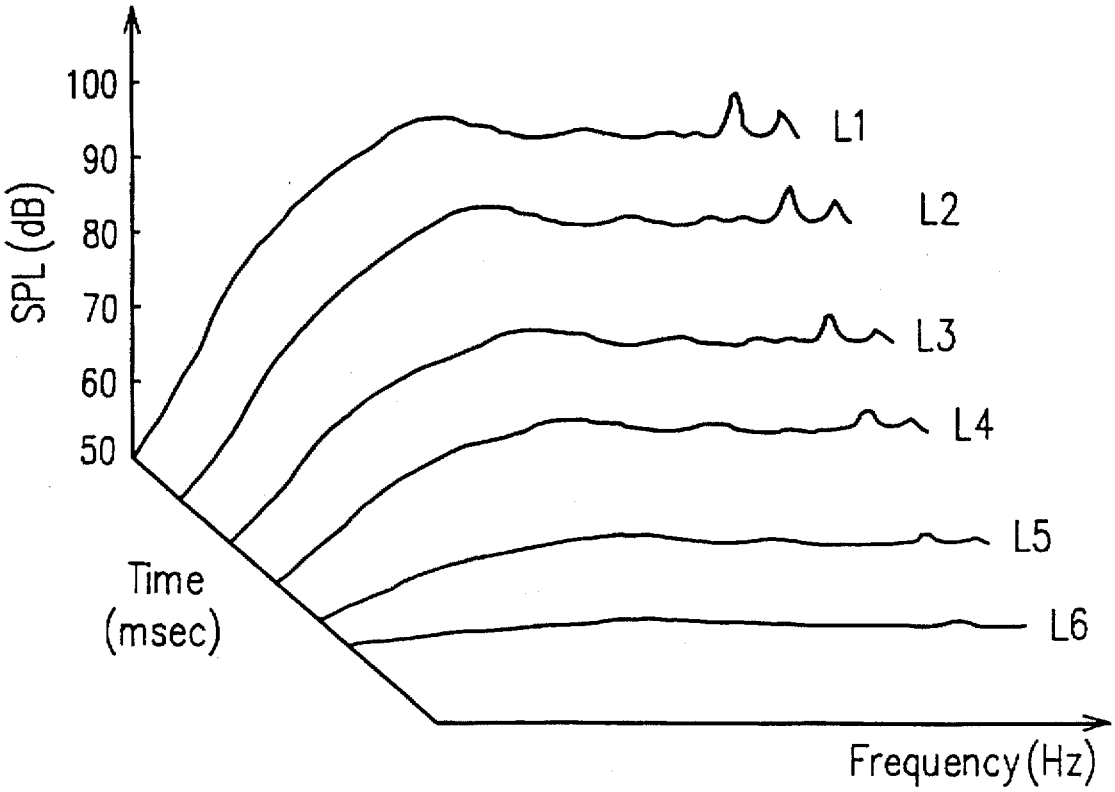
FIG. 29 is a graph showing an accumulated spectrum of a reproduced sound pressure frequency characteristic (the falling characteristic) in Example 16.

The signals from the signal sources 310*a* and 310*b* are processed by the filters 322*a* and 322*b*, respectively, so that the reproduced sound pressure frequency characteristic can be obtained as shown in FIG. 29. As is seen from curves L2 to L6 in FIG. 29, the signal amplitude of the sound source abruptly becomes zero as time elapses, the reverberation sound which reaches the listener includes no sound pressure peaks at the resonance frequencies. The reproduced sound is uniformly damped over the entire frequency band. As a result, music or speech can be clearly listened to. As described above, the signals of the stereo source can be reproduced after the resonance frequency components of the loudspeaker system (the frequency components of the standing wave due to the length of the horn 344) are reduced by the filters 322*a* and 322*b*. Accordingly, as shown in FIG. 29, the falling characteristic of the reproduce sound pressure frequency characteristic of the reproduced sound can be improved. As a result, a sound with high clarity can be reproduced even when the speech velocity is converted.

Figure 30:
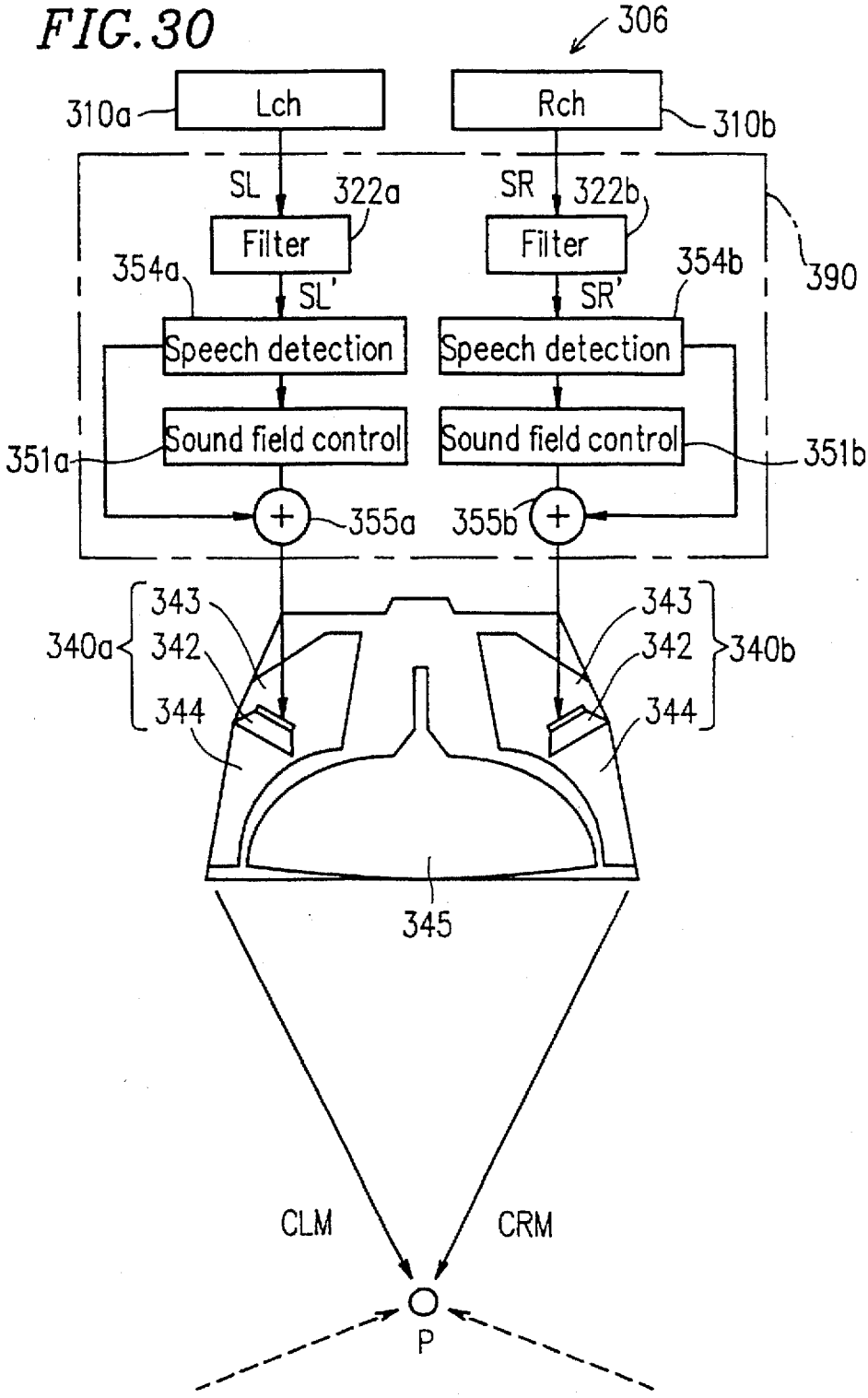
FIG. 30 is a diagram schematically showing a sound reproducing apparatus in Example 17 according to the invention.

Next, a sound reproducing apparatus 306 in Example 17 of the invention will be described. The sound reproducing apparatus 306 is provided for a television system, and attains an effect for converting the reproducing velocity of speech signals. As shown in FIG. 30, in the sound reproducing apparatus 306, a signal processing section 390 includes filters 322*a* and 322*b*, speech detectors 354*a* and 354*b*, sound field control sections 351*a* and 351*b*, and adders 355*a* and 355*b* for the left and right channels, respectively. Similar to the above-described examples, the loudspeaker systems 340*a* and 340*b* are mounted on the left and right sides of a cathode-ray tube 345 of the television system. In Example 17, in each of the loudspeaker systems 340*a* and 340*b*, a small-size back cavity 343 and a horn 344 are provided by utilizing the rear space and the left and right slight spaces of the cathode-ray tube 345. Components which are the same as those in the sound reproducing apparatus 302 in the above-described example are designated by the same reference numerals, and the detailed descriptions thereof are omitted.

Signals from an Lch signal source 310*a* and an Rch signal source 310*b* are input into the filters 322*a* and 322*b*, respectively. These filters 322*a* and 322*b* have the same frequency characteristic as that shown in FIG. 18. The outputs of the filters 322*a* and 322*b* are applied to speech detectors 354*a* and 354*b*, respectively. The speech detectors 354*a* and 354*b* are circuits for judging whether the input signal is a speech signal or a non-speech signal. If the Lch input signal is determined to be a non-speech signal by the speech detector 354*a*, the output is applied to the sound field control section 351*a*. If the Lch input signal is determined to be a speech signal, the output is applied to the adder 355*a*. Similarly, if the Rch input signal is determined to be a non-speech signal by the speech detector 354*b*, the output is applied to the sound field control section 351*b*. If the Rch input signal is determined to be a speech signal, the output is applied to the adder 355*b*. The outputs of the adders 355*a* and 355*b* are applied to the loudspeaker systems 340*a* and 340*b*, respectively.

The sound field control sections 351*a* and 351*b* are the same as those described in Example 11, and the sound field control sections 351*a* and 351*b* generate signals of surround sound. The adder 355*a* adds the speech signal output from the speech detector 354*a* to the surround (non-speech) signal output from the sound field control section 351*a*. Similarly, the adder 355*b* adds the speech signal output from the speech detector 354*b* to the surround (non-speech) signal output from the sound field control section 351*b*. Each of the filters 322*a* and 322*b*, the speech detectors 354*a* and 354*b*, and the sound field control sections 351*a* and 351*b* can be constructed by a DSP.

The operation of the sound reproducing apparatus 306 having the above-described construction will be described. The operations of the filters 322*a* and 322*b* are the same as those described in the above examples, so that the descriptions thereof are omitted. The stereo signals output from the signal sources 310*a* and 310*b* are processed by the filters 322*a* and 322*b*, and then classified into speech signals and non-speech signals by the speech detectors 354*a* and 354*b*. Speech signals are not subjected to the sound field control, but output to the loudspeaker systems 340*a* and 340*b* via the adders 355*a* and 355*b*. Thus, the location of the speech is clearly perceived.

Non-speech signals are converted into surround signals by the sound field control sections 351*a* and 351*b*. Due to the Lch and Rch surround signals, similar to Example 11, the listener P can listen in such a manner that sound waves are virtually emitted in the directions indicated by broken lines shown in FIG. 30. Accordingly, for the non-speech signal such as a music signal, the surrounding effect can be attained without using the additional surround loudspeakers.

As described above, the signals of a stereo source can be reproduced after the resonance frequency components of the loudspeaker system (the frequency components of the standing wave due to the length of the horn 344) are reduced by the filters 322*a* and 322*b*. As a result, for the speech signals, a sound with high clarity can be clearly localized. On the other hand, for the non-speech signals, the surrounding effect is added by the sound field control sections 351*a* and 351*b*, and a sound effect with a rich sense of presence can be realized.

Figure 31:
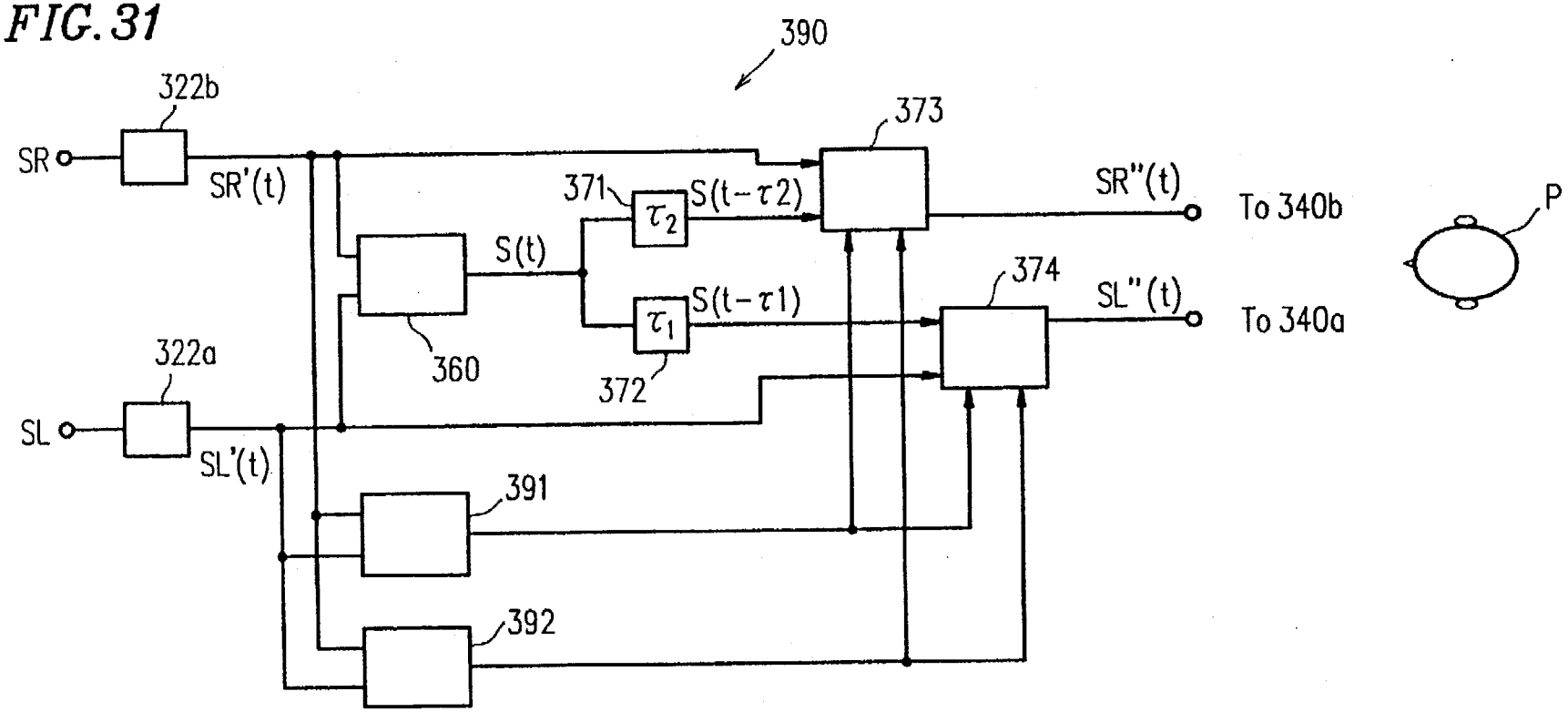
FIG. 31 is a block diagram showing the construction of a signal processing section in Example 18 according to the invention.

Next, a sound reproducing apparatus in Example 18 will be described. The construction of the sound reproducing apparatus in Example 18 is the same as that of the sound reproducing apparatus 306 in Example 17, except for the construction of a signal processing section 390. FIG. 31 is a block diagram showing the construction of the signal processing section 390 in Example 18. Components having the same functions as those in the signal processing section 350 in Example 12 are designated by the same reference numerals, and the detailed descriptions thereof are omitted.

In FIG. 31, the output signal SL'(t) from the filter 322*a* and the output signal SR'(t) from the filter 322*b* are applied a difference signal extractor 360 which outputs a difference signal S(t). The difference signal S(t) is input into delay circuits 371 and 372. The delay circuits 371 and 372 delay the difference signal S(t) by delay times $\tau_2$ and $\tau_1$, respectively.

The signals SL'(t) and SR'(t) are applied to a signal judging circuit 391 and a correlator 392. The signal judging circuit 391 detects a blank period (i.e. a silent interval where the signal is essentially zero) of the input signal, and judges whether the input signal is a speech signal or non-speech signal. The correlator 392, on the other hand, is a circuit for determining the correlation ratio between input signals.

An output signal S(t-τ1) from the delay circuit 372, and an output signal S(t-τ2) from the delay circuit 371 are applied to adders 374 and 373, respectively.

The output signals of the delay circuits 371 and 372 and the signals SL'(t) and SR'(t) are input into adders 373 and 374. The adders 373 and 374 add the input signals to each other with respective ratios based on the calculated result obtained from the signal judging circuit 391 and the correlator 392. The resulting signals are output to the loudspeaker systems 340*a* and 340*b*, respectively.

The operation of the signal processing section 390 in Example 18 with the above-described construction will be described as to the different portions from the previous examples.

The signal judging circuit 391 adds the input signals SR'(t) and SL'(t) to obtain a sum signal, detects the frequency of the blank periods (i.e. how frequently the signal interruptions occur) in the sum signal, and judges whether the input signal is a speech signal or not according to the frequency of the blank periods.

Figure 32:
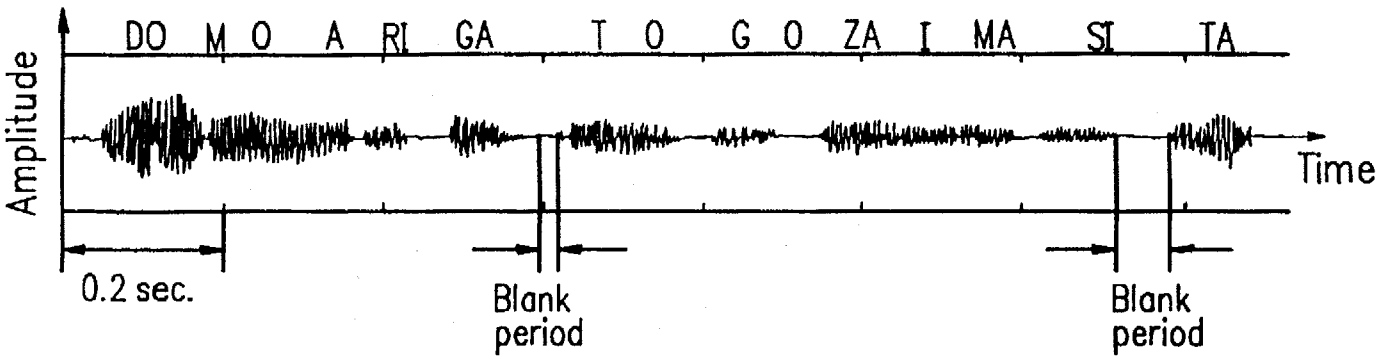
FIG. 32 is an example of a waveform of a speech signal.

FIG. 32 shows the waveform of a speech signal. In FIG. 32, the horizontal axis of the coordinate represents the time and the vertical axis of the coordinate represents the amplitude. This sound wave was obtained from the spoken words "DOMO ARIGATO GOZAIMASITA (Thank you very much)" in Japanese as indicated over the waveform. As can be seen from FIG. 32, there will always be a certain number of blanks (silent periods) within a certain period of time in a speech signal (in this example there are two blanks in one second period). The signal judging circuit 391 uses this property of the speech signal to determine whether the input signal is a speech signal or a non-speech signal based on the blank period frequency, and controls the summation ratio of the adders 373 and 374. A judging value A is set as follows:

for a non-speech signal A=(A+ΔA)

for a speech signal A=(A−ΔA)

where ΔA is a constant for varying the amount of the judging value according to whether the signal is a speech signal or not.

When the input signal is determined to be a non-speech signal, the judging value A is increased by the constant ΔA, while when the input signal is determined to be a speech signal, the judging value A is decreased by the constant ΔA. This operation is successively repeated at a predetermined interval and the judging value A is updated at each judgment. In this manner, the input signal is judged by variation ΔA of the judging value A from a previously judged value, and not judged by the value 0 or 1 for each judgment. This updating method allows the sound field controller to handle judging error to prevent any significant effect on the output signals. The judging value A thus determined is applied to the adders 373 and 374.

The correlator 392 calculates the correlation ratio between the input signals according to following Equation (28) as described below.

$$\alpha=|SL'(t)-SR'(t)|/|SL'(t)+SR'(t)| \tag{28}$$

In the case where the input 2ch signals are a monaural signal or an approximately monaural signal (i.e. the 2ch signals SR'(t) and SL'(t) are strongly correlated with each other), the nominator of the equation is zero or decreases to zero, and the value a becomes nearly zero. When the input 2ch signals are a stereo signal (i.e. the 2ch signals SR'(t) and SL'(t) have no or little correlation each other), the nominator increases, and the value α is also increased.

The summation ratio of the signals in the adders 373 and 374 is controlled based on the values obtained by the signal judging circuit 391 and the correlator 392.

The adders 373 and 374 perform the summation expressed in the following equations:

$$SR''(t)=SR'(t)\cdot(1-\alpha\cdot A)+S(t-\tau 2)\cdot\alpha\cdot A \tag{29}$$

$$SL''(t)=SL'(t)\cdot(1-\alpha\cdot A)+S(t-\tau 1)\cdot\alpha\cdot A \tag{30}$$

where SR"(t) and SL"(t) are output signals from the adders 373 and 374, respectively.

In these equations, the summing ratios of signals SL'(t) and SR'(t) which are to be localized forwardly, and the respective surround signal are adjusted to produce a natural presence. In other words, the correlation ratio between the input signals is small (i.e. giving a listener a large stereophonic feeling), the signal processed by the difference signal extractor 360 is reproduced large, while when the correlation ratio between the input signals is large (i.e. giving a listener a small stereophonic feeling), the signal processed by the difference signal extractor 360 is reproduced small. Furthermore, the speech signal may be reproduced clearly since the judgment of the input signal to be a speech signal or not is performed at the same time and the summation ratio is adjusted.

Although c given by Equation (28) is used with a direct form in Equations (29) and (30), in practice, the value $\alpha$ may be converted into a value in a range of about 0 to 1. Furthermore, this value may be varied depending on the desirable magnitude of the stereophonic effects.

In this example, signals SL'(t) and SR'(t) are multiplied by a factor $(1-\alpha\cdot A)$ in order to suppress the change in the total volume of SL"(t) and SR"(t) according to the change of the value a. However, when the total volume is allowed to change, the input signal is not required to be multiplied by $(1-\alpha\cdot A)$. That is, when a variation of volume can be acceptable, the multiplication is not required.

The value $\alpha\cdot A$ is updated at a timing with certain time intervals, since the updating operation may cause a fluctuation in the effect.

The value $\alpha$ indicating the correlation ratio may be used in another form of correlation value instead of the exact form. Similarly to the speech judging value A, the correlation value B may be defined as:

when $\alpha>X$, $B=(B+\Delta B)$ when $\alpha<X$, $B=(B-\Delta B)$, where X is a predetermined value and $\Delta B$ is a constant for varying the correlation value B. The operation using this correlation value is also able to prevent the output signals from fluctuations caused by the updating timing of $\alpha$ or an erroneous judgment.

According to this example, the input signal is judged to be a speech signal or a non-speech signal by the signal judging circuit 391 based on the frequency of the blank periods. Alternatively, other methods may be used for judgment such as a determining method based on the inclination of the envelope of a rising edge or falling edge of the input signal waveform, or a combination of this determining method with the method in this example.

In this example, the sum signal of the input signals is judged by the signal judging circuit 391. Alternatively, each input signal may be judged without summation. Thereafter, the operation is the same as that in Example 1.

Figure 33:
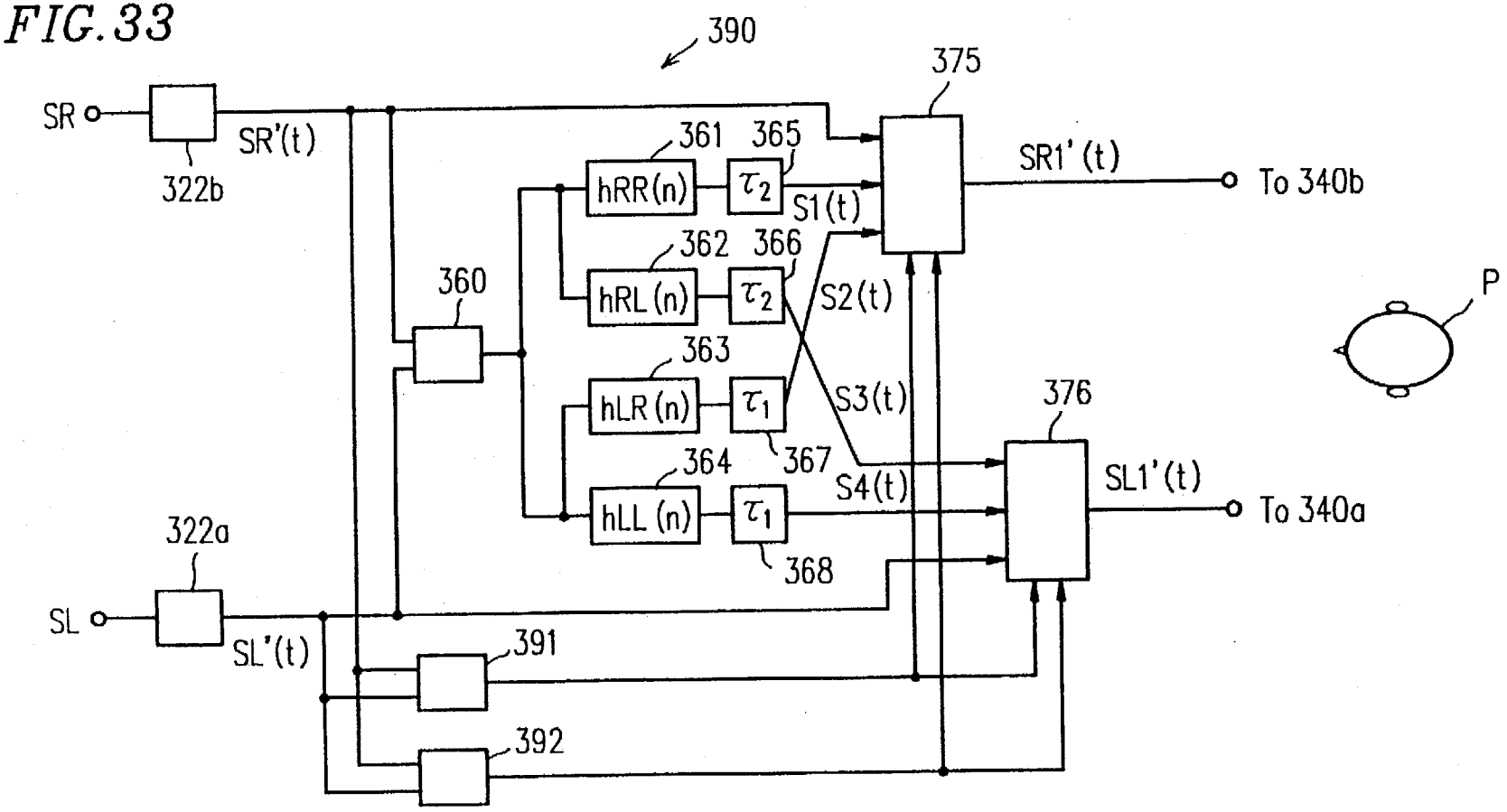
FIG. 33 is a block diagram showing the construction of a signal processing section in Example 19 according to the invention.

Next, a sound reproducing apparatus in Example 19 will be described. The construction of the sound reproducing apparatus in Example 19 is the same as that of the sound reproducing apparatus 306 in Example 17, except for the construction of a signal processing section 390. FIG. 33 is a block diagram showing the construction of the signal processing section 390 in Example 19. Components having the same functions as those in the signal processing sections 350 and 390 in the above-described examples are designated by the same reference numerals, and the detailed descriptions thereof are omitted.

In FIG. 33, the output signal SL'(t) from the filter **322*a* and the output signal SR'(t) from the filter 322*b* are each divided into two branches. One of the branched signals of SL'(t) and one of the branched signals of SR'(t) are applied to a difference signal extractor 360 and the others to adders 375 and 376, respectively. The output of the difference signal extractor 360 is applied to operational circuits 361, 362, 363, and 364**.

The other branched signals of SL'(t) and SR'(t) are applied to a signal judging circuit 391 and a correlator 392.

The signal judging circuit 391 judges whether the input signal is a speech signal or a non-speech signal. The correlator 392 is a circuit for determining the correlation ratio between input signals.

The respective output signals S1(t), S2(t), S3(t), and S4(t) of the operational circuits 361, 362, 363, and 364 are applied to the adders 375 and 376 via the delay circuits 365, 366, 367, and 368.

The adder 375 weights and adds the input signal SR'(t) from the filter **322*b*, and the output signals of the delay circuits 365 and 367 with respective ratios based on the calculated result obtained from the signal judging circuit 391 and the correlator 392. The adder 376 weights and adds the input signal SL'(t) from the filter 322*a*, the output signals of the delay circuit 366 and 368 with respective ratios based on the calculated result obtained from the signal judging circuit 391 and the correlator 392. The output signals SR1'(t) and SL1'(t) are the signals output from the adders 375 and 376**.

The results of the adders 375 and 376 are output to the loudspeaker systems **340*a* and 340*b***, respectively.

The operation of the signal processing section 390 in Example 19 with the above-described construction will be described as to the different portions from the previous examples.

This example is similar to Example 12 except for the signal judging circuit 391 and the correlator 392. Also the operation is basically the same as that in Example 12. The signal judging circuit 391 and the correlator 392 operate the same way as that of the corresponding components of Example 18. The operation of the adders 375 and 376, however, is somewhat different from that of Example 18.

The adder 375 performs the summing operation according to the following equation:

$$SR1'(t)=SR'(t)\cdot(1-\alpha\cdot A)+(S1(t)+S2(t))\cdot\alpha\cdot A \quad (31)$$

In a similar manner, the adder 376 performs summing operation as shown in following equation:

$$SL1'(t)=SL'(t)\cdot(1-\alpha\cdot A)+(S3(t)+S4(t))\cdot\alpha\cdot A \quad (32)$$

The operations of other circuits are similar to those of the previous examples. Also, in order to simplify the structure of the sound field controller, the circuits other than the signal judging circuit 391, the correlator 392, and the adders 375 and 376 may be modified to the corresponding circuits as described in Example 18.

Figure 34:
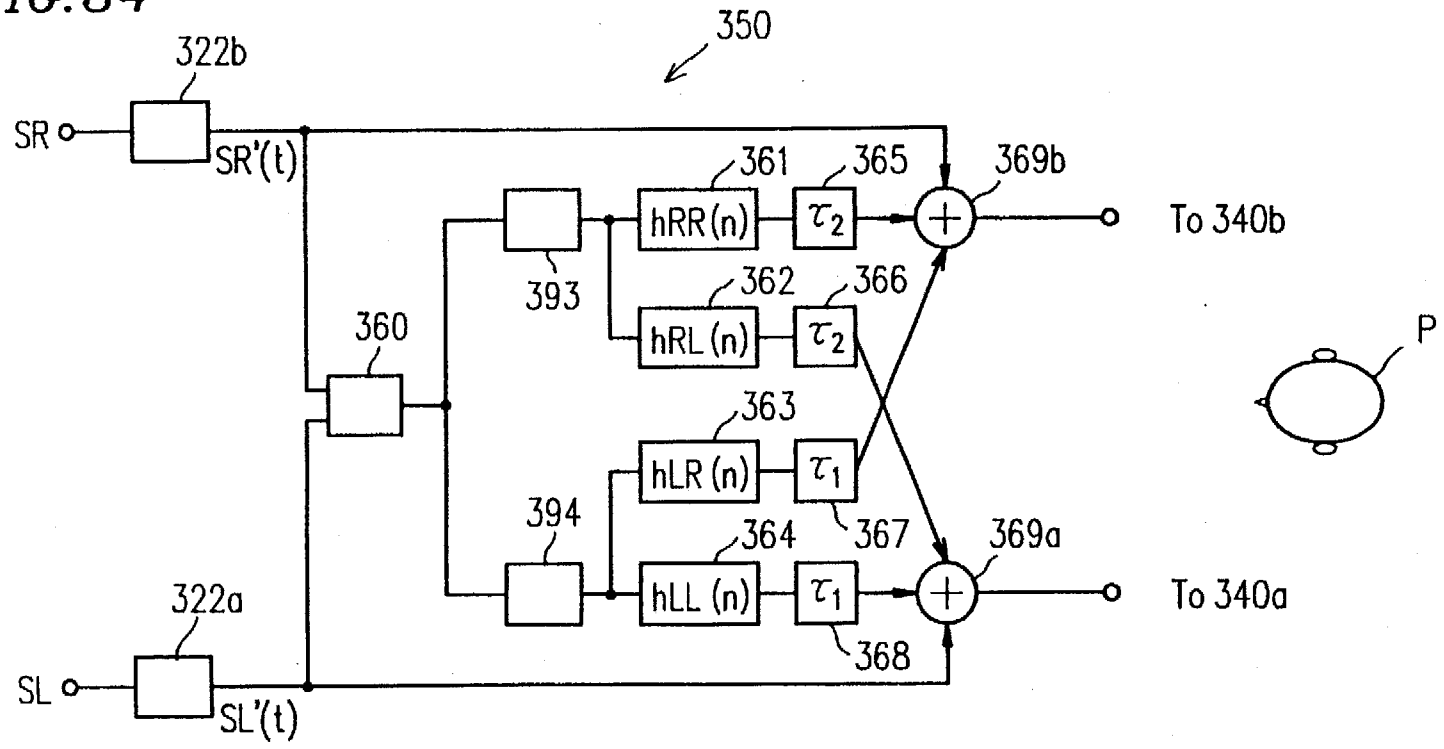
FIG. 34 is a block diagram showing the construction of a signal processing section in Example 20 according to the invention.

Next, a sound reproducing apparatus in Example 20 will be described. The construction of the sound reproducing apparatus in Example 20 is the same as that of the sound reproducing apparatus 302 in Example 11, except for the construction of a signal processing section 390. FIG. 34 is a block diagram showing the construction of the signal processing section 350 in Example 20. Components having the same functions as those in the signal processing sections 350 and 390 in the above-described examples are designated by the same reference numerals, and the detailed descriptions thereof are omitted.

In FIG. 34, the output signal SL'(t) from the filter 322*a* and the output signal SR'(t) from the filter 322*b* are each divided into two branches. One of the branched signals of SL'(t) and one or the branched signals of SR'(t) are applied to a difference signal extractor 360 and the others to adders 369*a* and 369*b*, respectively. The output signal of the difference signal extractor 360 is supplied to reflection sound generation circuits 393 and 394 which generate a reflection sound and a reverberation sound by simulating the sound field in a music hall, etc.

The outputs of the reflection sound generation circuits 393 and 394 are applied to the operational circuits 361 to 364. The outputs of the operational circuits 361 to 364 are applied to adders 369*a* and 369*b* via delay circuits 365 to 368.

The adder 369*a* adds the output signal of the filter 322*a*, and the output signals of the delay circuits 365 and 367 with respective ratios, while the adder 369*b* adds the output signal of the filter 322*b*, and the output signals of the delay circuits 366 and 368 with respective ratios.

The outputs from the adders 369*a* and 369*b* are output to the loudspeaker systems 340*a* and 340*b*, respectively.

The operation of the signal processing section 350 in Example 20 having the above-described construction will be described as to the different portions from Example 12.

The difference signal produced from the difference signal extractor 360 is applied to the reflection sound generation circuits 393 and 394. The reflection sound generation circuits 393 and 394 generate a reflection sound or a reverberation sound obtained by simulating the sound field in a music hall, etc.

Figure 35A:
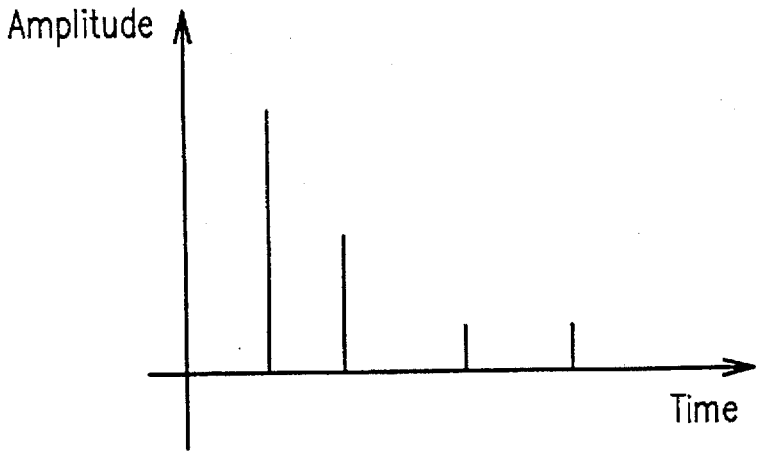
FIGS. 35A and 35B are diagrams schematically showing the reflection sound series generated by a reflection sound generation circuit in Example 20.
Figure 35B:
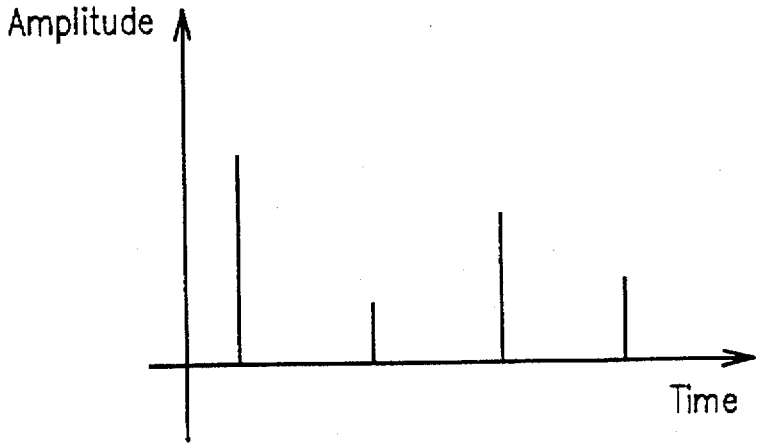

FIGS. 35A and 35B schematically show a reflection sound series generated by the reflection sound generation circuits 393 and 394. The horizontal axis of the coordinate represents the time, and the vertical axis of the coordinate represents the amplitude. These reflection sound series are determined by measurement in an actual music hall or by simulation utilizing the sound ray method.

Figure 36A:
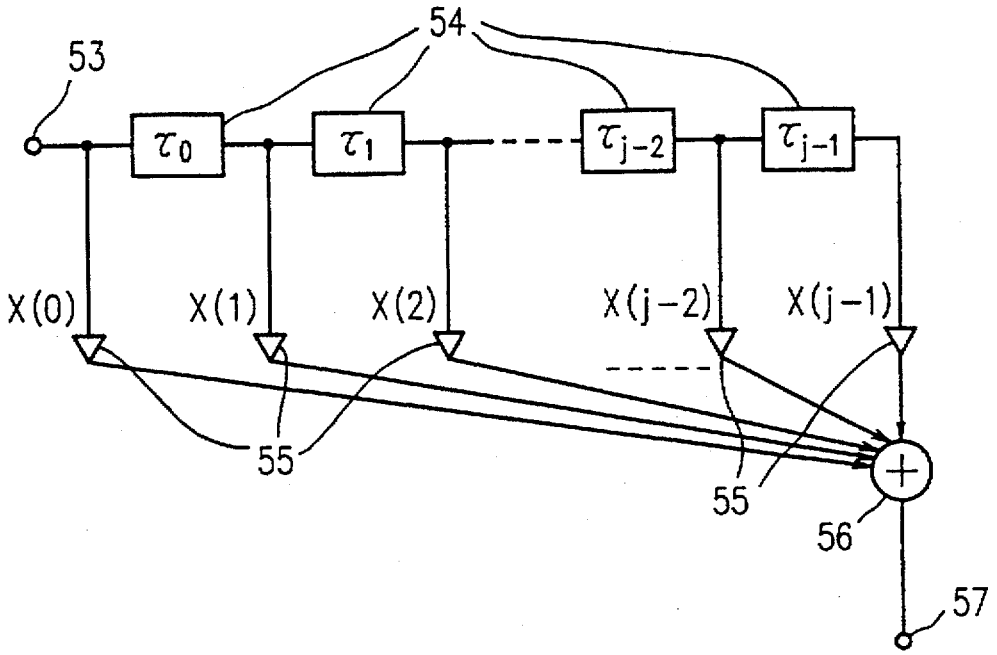
FIGS. 36A and 36B are block diagrams for explaining the reflection sound generation circuits in Example 20.
Figure 36B:
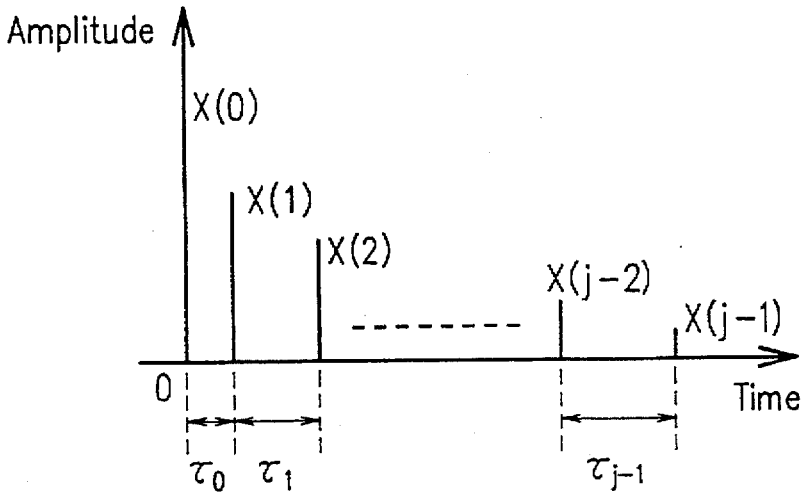

FIGS. 36A and 36B show diagrams for explaining the reflection sound generation circuits 393 and 394. In FIG. 36A, the signal is applied to a signal input terminal 53 and Goes through serially connected delay elements 54. Each of delay elements 54 delays the signal by $\tau_i$ (i=0 to j−1; i represents a suffix number as in all the following cases). Signals output from the delay elements 54 are multiplied by tap coefficients indicated by X(i) by multipliers (taps) 55. All the signals output from the respective taps are added to each other by an adder 56. The added (sum) signal is output via an output terminal 57. The above-mentioned operation is expressed with digital signals. When analog signals are handled in practice, an A/D converter and a D/A converter are to be provided in order to convert the analog signals into digital signals before being applied to the reflection sound generation circuits 393 and 394, and to convert the digital signals output from the reflection sound generation circuits 393 and 394 to analog signals (these converters are not shown in the figures). These reflection sound generation circuits 393 and 394 comprise the delay elements 54 and the taps 55 as described above, similarly to the operational circuits 361 to 364 in the above-described examples. In this case, the reflection sound series as shown in FIG. 36B can be obtained. In order to set a desirable reflection sound series such as shown in FIG. 36B, it is sufficient to appropriately set the delay times $\tau_i$ and the tap coefficients X(i) to the taps and delay elements shown in FIG. 36A. The reflection sound generation circuits 393 and 394 may be implemented by using a dynamic random access memory (DRAM) and a digital signal processor (DSP), or the like. Since the reflection sound generation circuits 393 and 394, and the operational circuits 361 to 364 are configured in the same manner, the functional characteristics of the reflection sound generation circuits 393 and 394 can be included in those of the operational circuits 361 to 364.

As mentioned above, by adding the reflection sound signal to the difference signal (surround signal), the surround feeling given by the difference signal can be emphasized.

The output signals of the reflection sound generation circuits 393 and 394 are branched into two signals, respectively, and then input into the operational circuits 361 to 364. The operations of other circuits are similar to those of Example 12.

Also, to simplify the structure of the sound reproducing apparatus, circuits other than the reflection sound generation circuits 393 and 394 may be modified to the corresponding circuits as described in Example 13.

Figure 37:
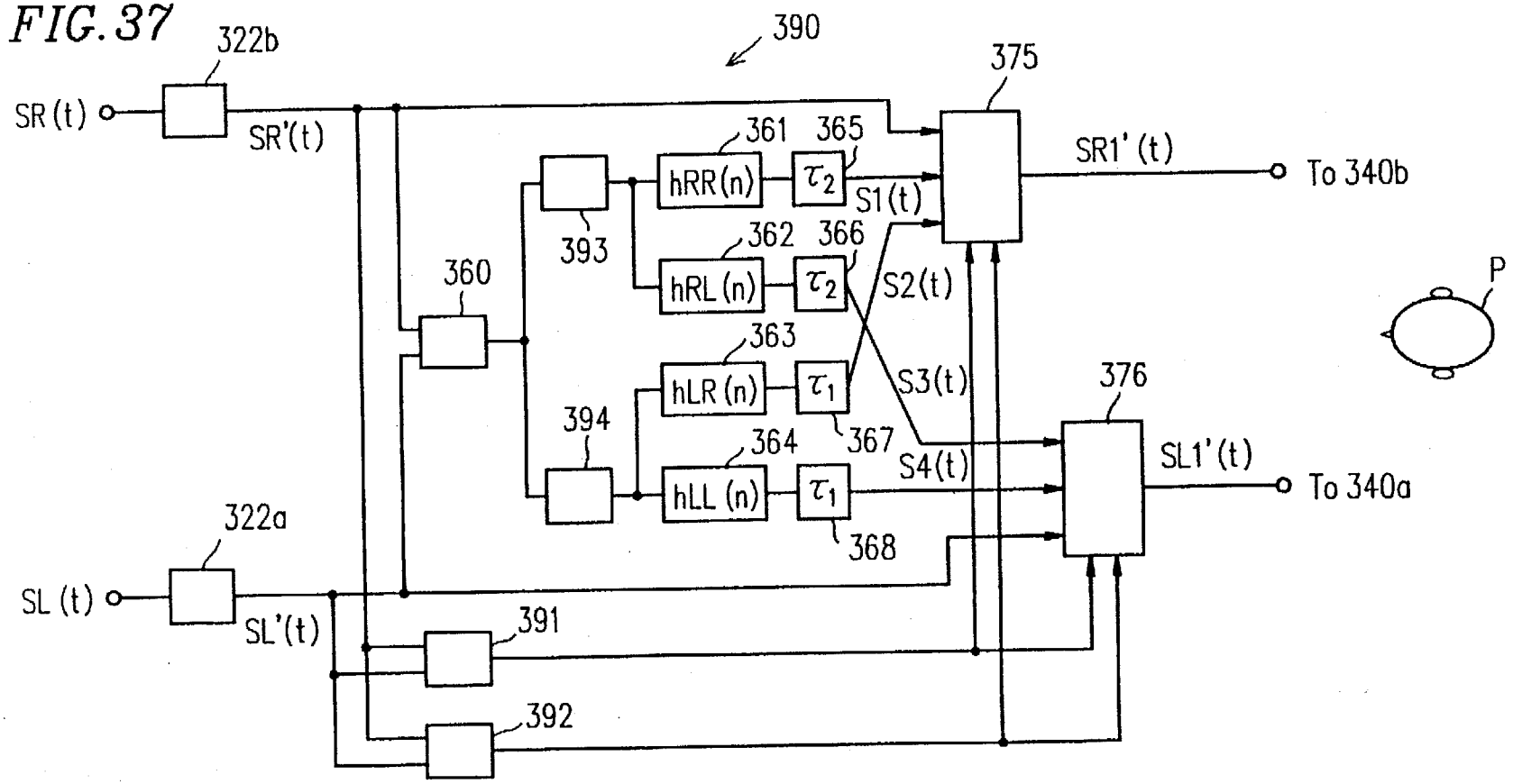
FIG. 37 is a block diagram showing the construction of a signal processing section in Example 21 according to the invention.

Next, a sound reproducing apparatus in Example 21 will be described. The construction of the sound reproducing apparatus in Example 21 is the same as that of the sound reproducing apparatus 306 in Example 17, except for the construction of a signal processing section 390. FIG. 37 is a block diagram showing the construction of the signal processing section 390 in Example 21. Components having the same functions as those in the signal processing sections 350 and 390 in the above-described examples are designated by the same reference numerals, and the detailed descriptions thereof are omitted.

In FIG. 37, the output signal SL'(t) from the filter 322*a* and the output signal SR'(t) from the filter 322*b* are each divided into two branches. One of the branched signals of SL'(t) and one of the branched signals of SR'(t) are applied to a difference signal extractor 360 and the others to adders 375 and 376, respectively. The other branched signals of SL'(t) and SR'(t) are applied to a signal judging circuit 391 for judging whether the input signal is a speech signal or a non-speech signal, and a correlator 392 for obtaining a correlation ratio between the input signals.

The output of the difference signal extractor 360 is applied to reflection sound generation circuits 393 and 394 which generate a reflection sound and a reverberation sound by simulating the sound field in a music hall, etc. The outputs of the reflection sound generation circuits 393 and 394 are applied to operational circuits 361 to 364. The outputs of the operational circuits 361 to 364 are applied to adders 375 and 376 via delay circuits 366 to 368.

The adder 375 weighs and adds the output signals from the filter 322*b*, and the delay circuits 365 and 367 with respective ratios based on the calculated result obtained from the signal judging circuit 391 and the correlator 392. The adder 376 weighs and adds the output signals from the filter 322*a*, and the delay circuits 366 and 368 with respective ratios based on the calculated result obtained from the signal judging circuit 391 and the correlator 392. The outputs from the adders 375 and 376 are output to the loudspeaker systems 340*b* and 340*a*, respectively.

The operation of the sound reproducing apparatus of this example is basically similar to that of Example 19 except that each of the signals processed by the operational circuits 361 to 364 is a sum signal of the difference signal from the difference signal extractor 360 and the reflection sound signal produced by the reflection sound generation circuit 393 or 394.

Figure 38:
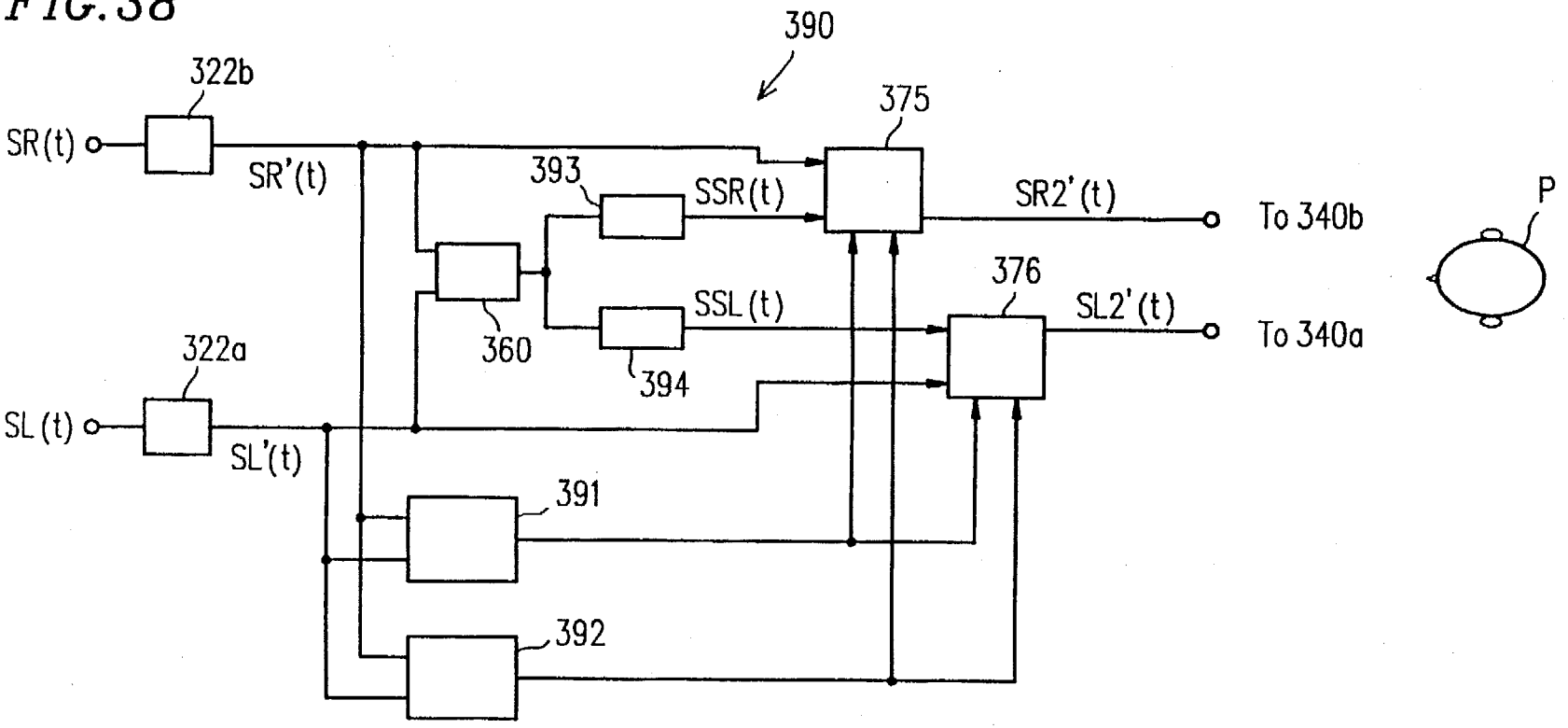
FIG. 38 is a block diagram showing the construction of a signal processing section in Example 22 according to the invention.

Next, a sound reproducing apparatus in Example 22 will be described. The construction of the sound reproducing apparatus in Example 22 is the same as that of the sound reproducing apparatus 306 in Example 17, except for the construction of a signal processing section 390. FIG. 38 is a block diagram showing the construction of the signal processing section 390 in Example 22. Components having the same functions as those in the signal processing sections 350 and 390 in the above-described examples are designated by the same reference numerals, and the detailed descriptions thereof are omitted.

In FIG. 38, the output signal SL'(t) from the filter 322*a* and the output signal SR'(t) from the filter 322*b* are each divided into two branches. One of the branched signals of SL'(t) and one of the branched signals of SR'(t) are applied to a difference signal extractor 360 and the others to adders 375 and 376, respectively. The signals SL'(t) and SR'(t) are also input into a signal judging circuit 391 for judging whether the input signal is a speech signal or a non-speech signal, and a correlator 392 for obtaining a correlation ratio between the input signals.

The output of the difference signal extractor 360 is supplied to reflection sound generation circuits 393 and 394. The signals SSR(t) and SSL(t) output from the reflection sound generation circuits 393 and 394 are applied to loudspeaker systems 340*b* and 340*a* via adders 375 and 376, respectively. The signals SR2'(t) and SL2'(t) are the output signals of the adders 375 and 376.

To the difference signal obtained from the difference signal extractor 360, reflection sounds are added in the reflection sound generation circuits 393 and 394. The adder 375 weights and adds the output signals from the filter 322*b* and the reflection sound generation circuit 393 with respective ratios based on the calculated result obtained from the signal judging circuit 391 and the correlator 392. The adder 376 weights and adds the output signals from the filter 322*a* and the reflection sound generation circuit 394 with respective ratios based on the calculated result obtained from the signal judging circuit 391 and the correlator 392. The summing operation is performed according to the equations below in a manner similar to Example 19.

$$SR2'(t)=SR'(t)\cdot(1-\alpha\cdot A)+SSR(t)\cdot\alpha\cdot A \quad (33)$$

$$SL2'(t)=SL'(t)\quad(1-\alpha\quad A)+SSL(t)\cdot\alpha\cdot A \quad (34)$$

The outputs of the adders 375 and 376 are output to the loudspeaker systems 340*b* and 340*a*, respectively.

Figure 39:
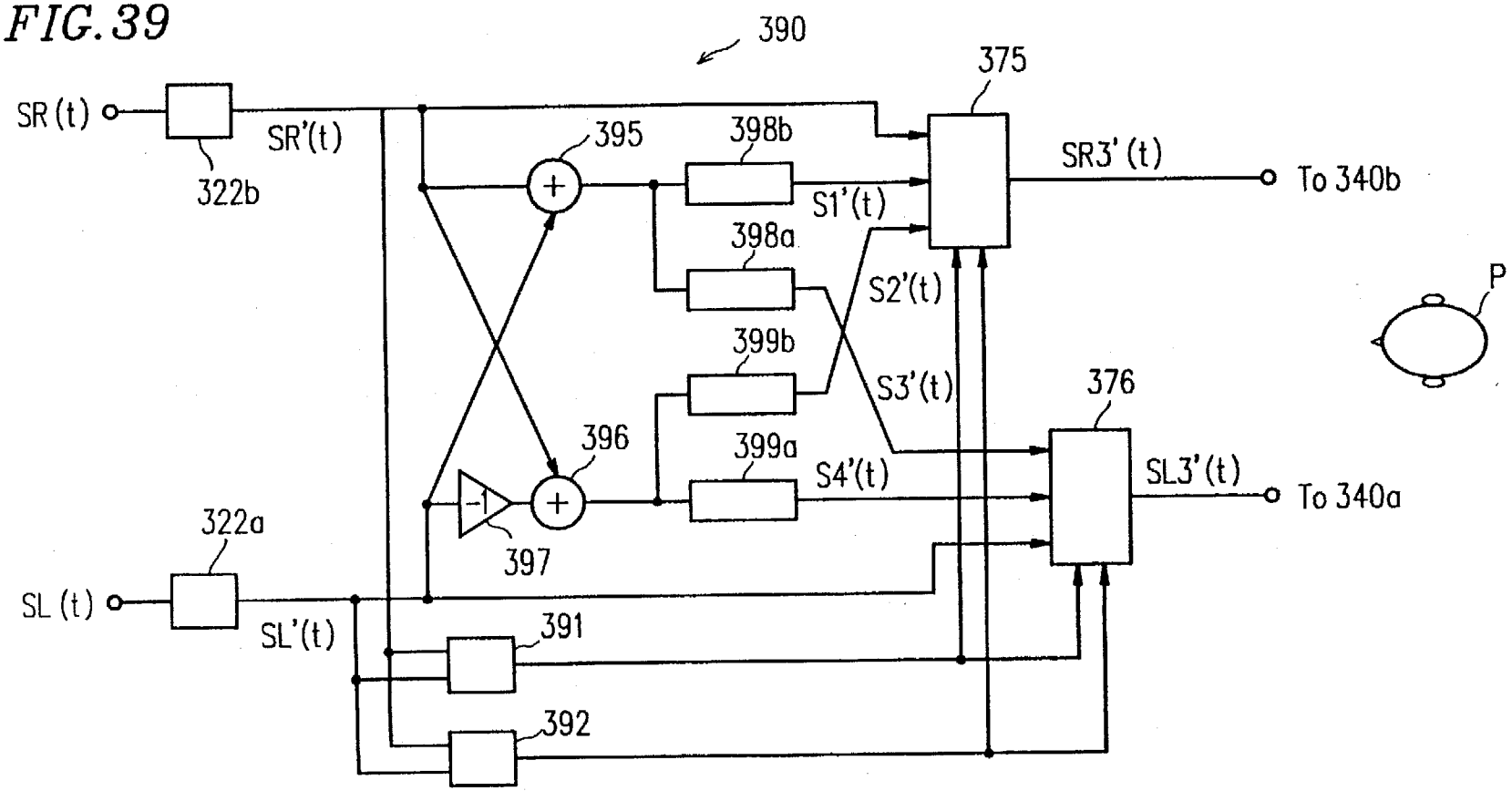
FIG. 39 is a block diagram showing the construction of a signal processing section in Example 23 according to the invention.

Next, a sound reproducing apparatus in Example 23 will be described. The construction of the sound reproducing apparatus in Example 23 is the same as that of the sound reproducing apparatus 306 in Example 17, except for the construction of a signal processing section 390. FIG. 39 is a block diagram showing the construction of the signal processing section 390 in Example 23. Components having the same functions as those in the signal processing sections 350 and 390 in the above-described examples are designated by the same reference numerals, and the detailed descriptions thereof are omitted.

In FIG. 39, a multiplier 397 multiplies an input signal by −1, and an adder 396 adds the output signal from the filter 322*a* to the output signal from the multiplier 397. An adder 395 sums the output signals from the filters 322*a* and 322*b*. Reflection sound generation circuits 398*a* and 398*b* add a reflection sound to the output from the adder 395 and reflection sound generation circuits 399*a* and 399*b* add a reflection sound to the output from the adder 396.

The adders 375 and 376 weigh and add the input signals with respective ratios based on the calculated results obtained from the signal judging circuit 391 and the correlator 392. The output signals from the reflection sound generation circuits 398*b*, 398*a*, 399*b*, and 399*a* are denoted by S1'(t), S3'(t), S2'(t), and S4'(t), respectively. The output signals of the adders 375 and 376 are denoted by SR3'(t) and SL3'(t), respectively. These output signals are fed to the loudspeaker systems 340*b* and 340*a*.

The operation of the signal processing section 390 in Example 23 having the above-described construction will be described as to the different portions from the previous examples.

The signal SR'(t) output from the filter 322*b* is divided into four signals. Three of the four signals are input into the adders 395, 396, and 376, respectively. The signal SL'(t) output from the filter 322*a* is divided into four signals. Among the four signals, one is applied to the adder 395, one is first multiplied by −1 in the multiplier 397 and then applied to the adder 396, and one is applied to the adder 376.

The adder 396 adds the signals SR'(t) and −SL'(t) to each other, and the result, i.e., SR'(t)−SL'(t) is output. That is, the multiplier 397 and the adder 396 function as a difference signal extractor. The output from the adder 396 is divided into two signals which are fed to the reflection sound generation circuits 399*b* and 399*a*. Thus, the signal SR'(t) −SL'(t) is added to a reflection sound, and the result is input into the adders 375 and 376.

Similarly, the adder 395 adds the signals SR'(t) and SL'(t) to each other, and the result, i.e., SR'(t)+SL'(t) is output. That is, the adder 395 functions as a sum signal generation means. The output from the adder 395 is divided into two signals which are fed to the reflection sound generation circuits 398*b* and 398*a*. Thus, the signal SR'(t)+SL'(t) is added to a reflection sound, and the result is input into the adders 375 and 376.

The adder 375 receives the output signals S1'(t) and S2'(t) of the reflection sound generation circuits 398*b* and 399*b* and the output signal SR'(t) of the filter 322*b*. The adder 376 receives the output signals S3'(t) and S4'(t) of the reflection sound generation circuits 398*a* and 399*a* and the output signal SL'(t) of the filter 322*a*. The adders 375 and 376 perform the summation in the same manner as Example 19 as follows:

$$SR3'(t)=SR'(t)\cdot(1-\alpha\cdot A)+(S1'(t)+S2'(t))\cdot\alpha\cdot A \quad (35)$$

$$SL3'(t)=SL'(t)\cdot(1-\alpha\cdot A)+(S3'(t)+S4'(t))\cdot\alpha\cdot A \quad (36)$$

The reflection sound generation circuits 398*a*, 398*b*, 399*a*, and 399*b* have the same functions as those of the reflection sound generation circuits 393 and 394 described in Example 20.

By providing the reflection sound generation circuits and adding the reflection sound to the difference signal of the input signals as described above, a sound field can be reproduced with natural expansion and natural presence without the antiphase feeling. Furthermore, providing two reflection sound generation circuits for each channel makes it possible to reproduce a sound field in which the signals produced from the loudspeaker systems 340*a* and 340*b* have different reflection sounds. That is, the reflection sound can be added in stereo. Furthermore, by varying the amount of delay time of the delay element or changing the coefficient of the multiplier in the reflection sound generation circuit, various sound fields such as a sound field with plenty of reverberation sounds or a sound field with a little amount of reflection sound can be reproduced.

Figure 40:
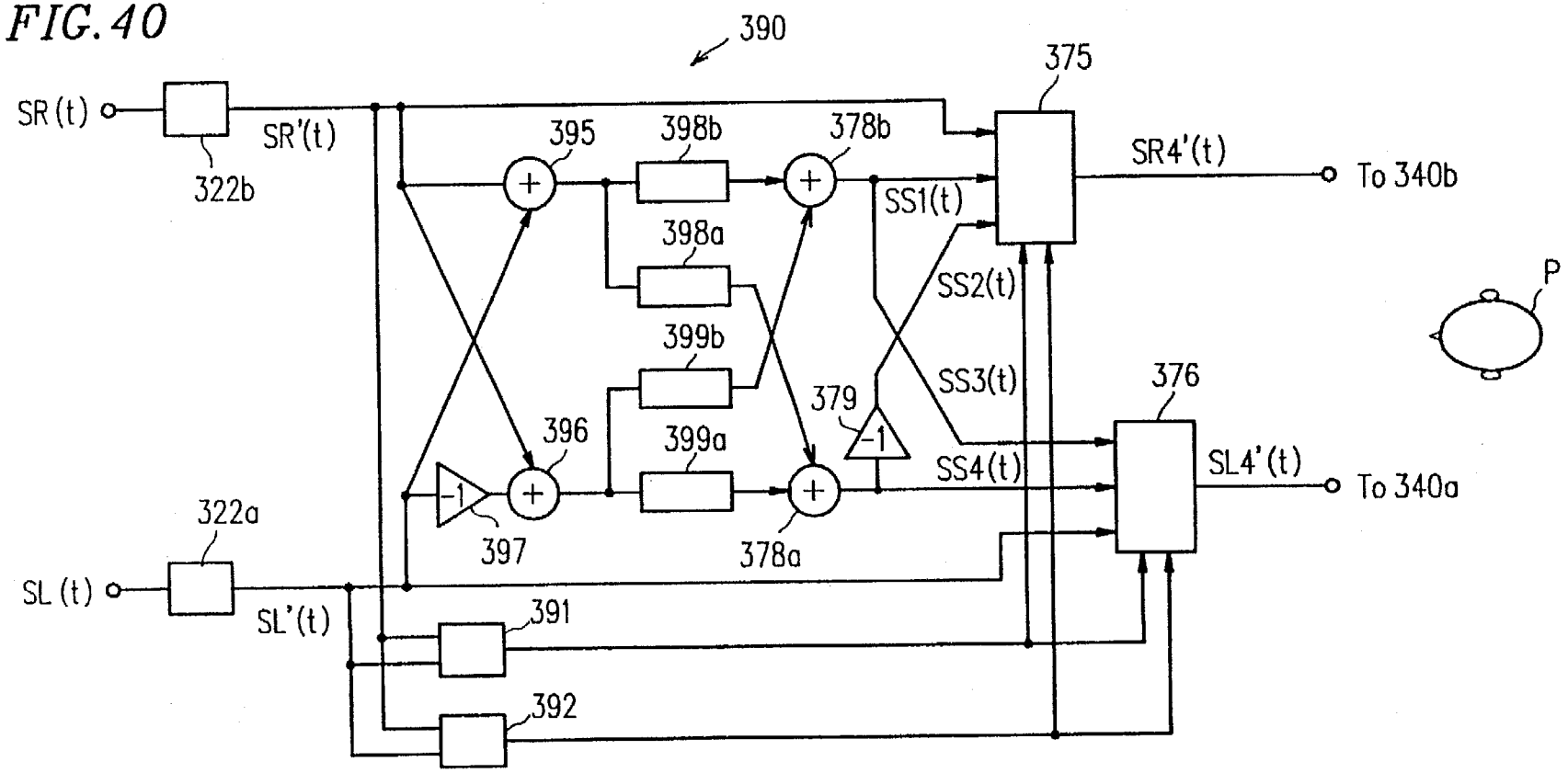
FIG. 40 is a block diagram showing the construction of a signal processing section in Example 24 according to the invention.
Figure 41:
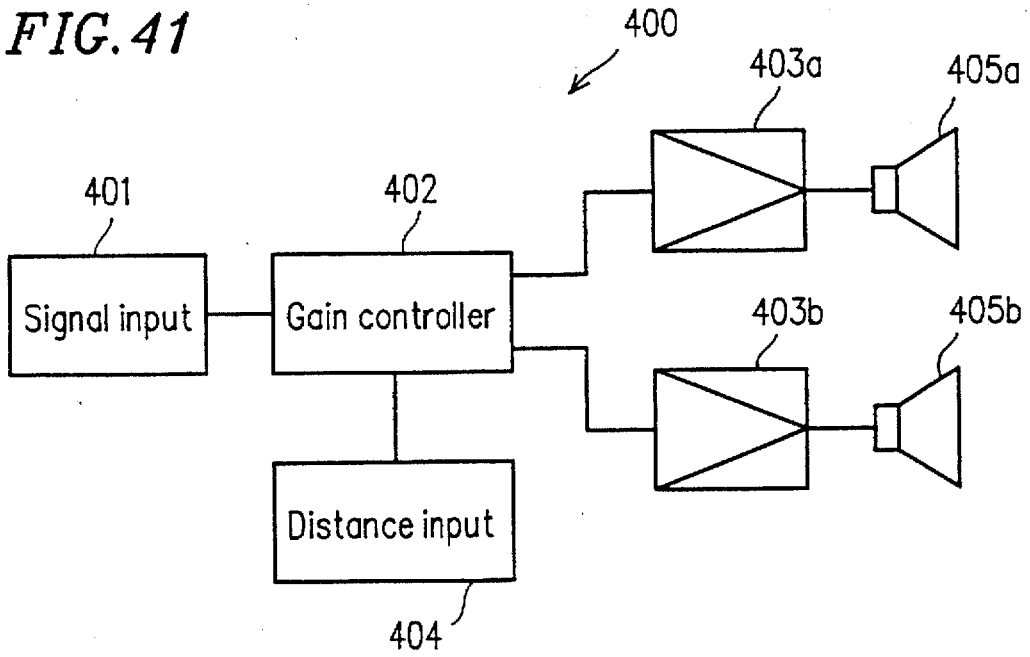
FIG. 41 is a block diagram showing a conventional sound field controller which controls the distance perspective.
Figure 42A:
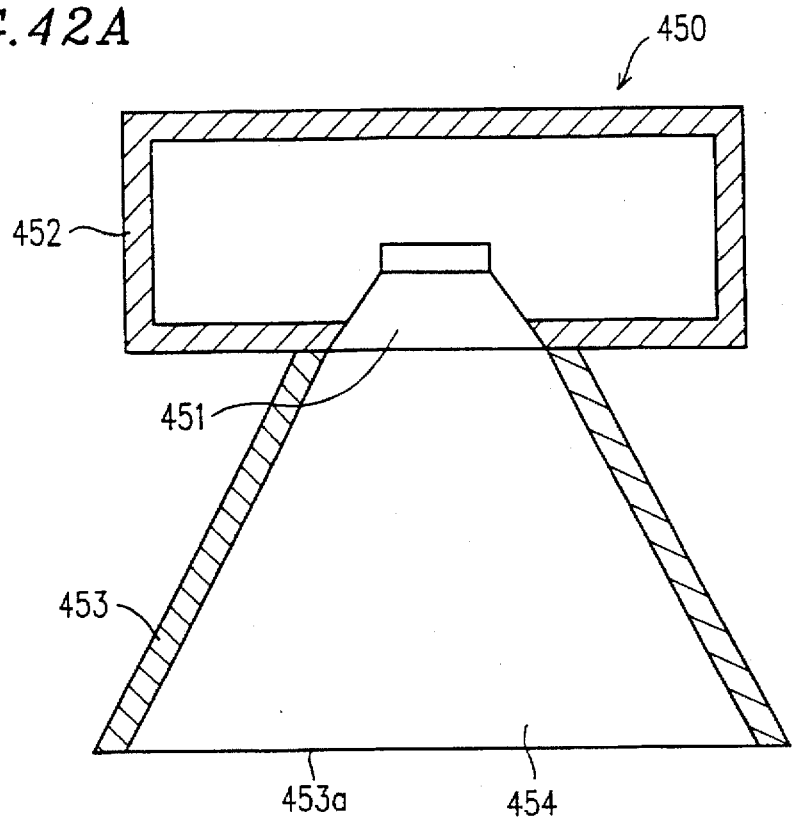
FIGS. 42A and 42B are a transverse cross-sectional view and a vertical cross-sectional view, respectively, showing a loudspeaker system used in sound reproducing apparatus of the prior art and the invention.
Figure 42B:
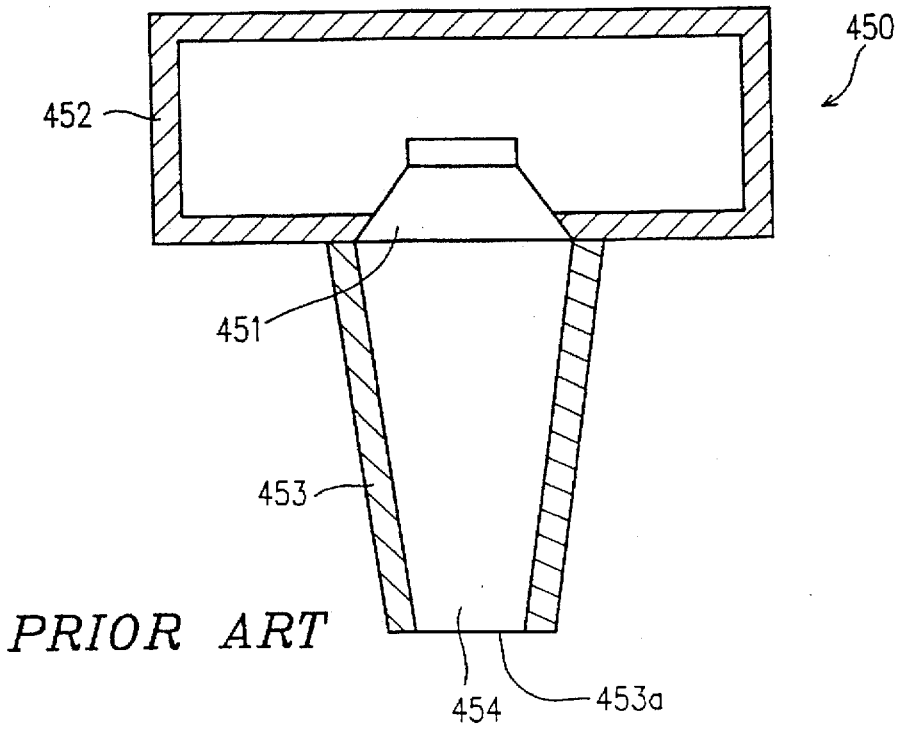
PRIOR ART FIG. 42B
Figure 43:
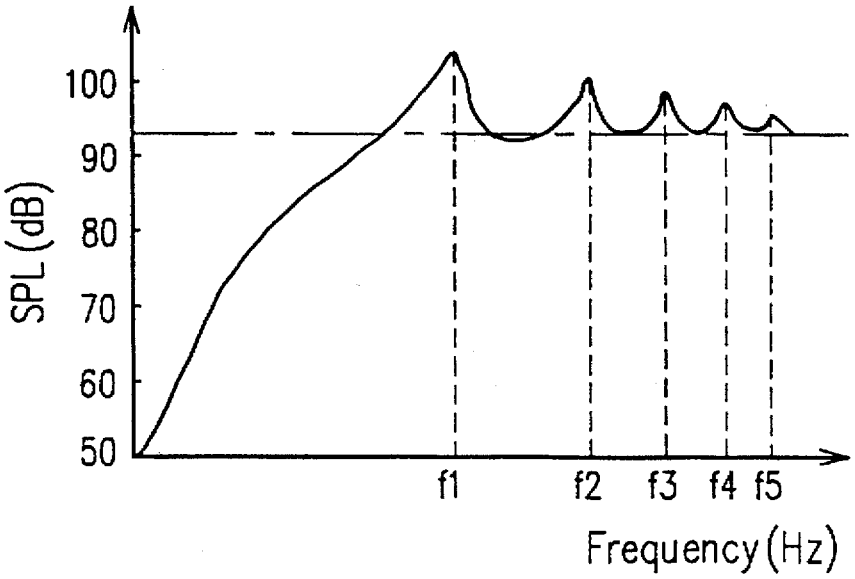
FIG. 43 is a diagram showing a frequency characteristic of a reproduced sound pressure in a conventional sound reproducing apparatus.
Figure 44:
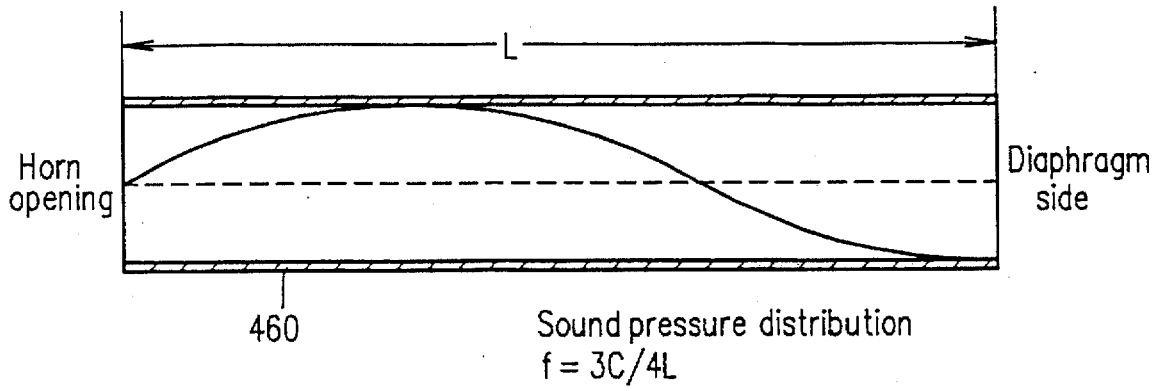
FIG. 44 is a diagram for illustrating the sound pressure distribution in a sound tube used in a loudspeaker system.
Figure 45:
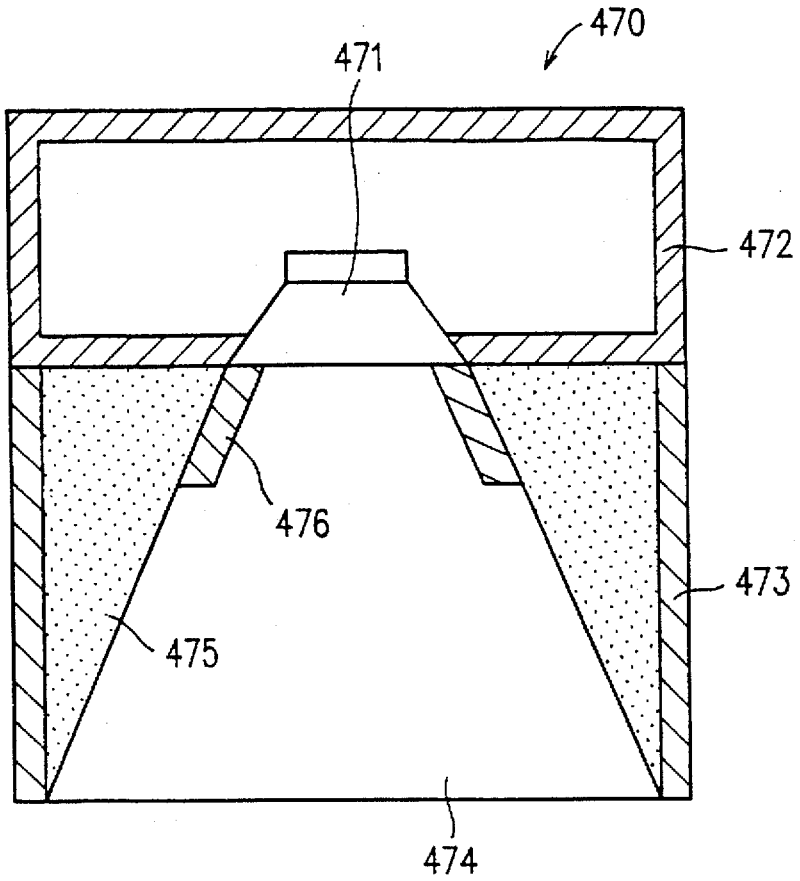
FIG. 45 is a cross-sectional view showing another construction of a loudspeaker system used in a conventional sound reproducing apparatus.

Next, a sound reproducing apparatus in Example 24 will be described. The construction of the sound reproducing apparatus in Example 24 is the same as that of the sound reproducing apparatus 306 in Example 17, except for the construction of a signal processing section 390. FIG. 40 is a block diagram showing the construction of the signal processing section 390 in Example 24. Components having the same functions as those in the signal processing sections 350 and 390 in the above-described examples are designated by the same reference numerals, and the detailed descriptions thereof are omitted.

In FIG. 40, a multiplier 397 multiplies an input signal by −1, and adders 375 and 376 weigh and add the input signals with respective ratios based on the calculated results obtained from the signal judging circuit 391 and the correlator 392. The output signals of the adders 375 and 376 are denoted by SR4'(t) and SL4'(t), respectively. The output signals of the adder **378*b* are denoted by SS1(t) and SS3(t), the output signal of the multiplier 379 is denoted by SS2(t), and the output signal of the adder 378*a*** is denoted by SS4(t).

The operation of the signal processing section 390 in Example 24 having the above-described construction will be described as to the different portions from Example 23.

The output signals from the reflection sound generation circuits **398*a*, 398*b*, 399*a*, and 399*b* are fed to the adders 378*b* and 378*a*. The adder 378*b* adds the outputs of the reflection sound generation circuits 398*b* and 399*b* to each other. The result is divided into two signals. One of the two signals is fed to the adder 375 and the other is fed to the adder 376**.

The adder **378*a* adds the outputs of the reflection sound generation circuits 398*a* and 399*a* to each other. The result is divided into two signals. One of the two signals is fed to the multiplier 379, and the other is fed to the adder 376. In the multiplier 379, the output of the adder 378*a* is multiplied by −1, and the result is applied to the adder 375**.

The adder 375 receives the output signal SS1(t) of the adder **378*b*, the output signal SS2(t) of the multiplier 379, and the signal SR'(t) output from the filter 322*b*. The adder 376 receives the output signal SS3(t) of the adder 378*b*, the output signal SS4(t) of the adder 378*a*, and the output signal SLY(t) output from the filter 322*a***. The summation is performed in a manner similar to Example 19.

$$SR4'(t)=SR'(t)\cdot(1-\alpha\cdot A)+(SS1(t)+SS2(t))\cdot\alpha\cdot A \quad (37)$$

$$SL4'(t)=SL'(t)\cdot(1-\alpha\cdot A)+(SS3(t)+SS4(t))\cdot\alpha\cdot A \quad (38)$$

The output signals SR4'(t) and SL4'(t) are reproduced from the loudspeaker systems **340*b* and 340*a***.

In this way, the outputs of the reflection sound generation circuits **398*b* and 399*b* are reproduced from the loudspeaker system 340*b* in the same phase (i.e., inphase) with each other. On the other hand, the outputs of the reflection sound generation circuits 398*a* and 399*a* are reproduced from the loudspeaker system 340*a*** in antiphase.

As described above, the difference signal and the sum signal of the stereo signals are each divided into two portions. One portion of the difference signal and one portion of the sum signal are reproduced in inphase, and the other portion of the difference signal and the other portion of the sum signal are reproduced in antiphase. Consequently, the feeling of expansion is obtained by antiphase reproduction, and at the same time, any uncomfortable antiphase feeling can be reduced by adding the inphase signals to the antiphase signals to be reproduced.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A sound field controller for reproducing a sound field, comprising:

an A/D converter for converting an input audio signal into a digital signal;

signal processing means for receiving the digital signal and processing the digital signal using predetermined parameters, thereby generating a sound signal;

input means for inputting conditions including a position of a sound image to be localized, a distance between the sound image and a listener, and a spatial size of the sound field;

parameter control means for setting the parameters used in the signal processing means based on the conditions provided from the input means, whereby the sound signal generated in the signal processing means has characteristics corresponding to the conditions;

a D/A converter for converting the sound signal output from the signal processing means into an analog signal; and reproduction means for receiving the analog signal from the D/A converter and for amplifying and reproducing the analog signal, thereby generating a sound field providing a distance perspective in accordance with the position of the sound image with respect to the listener and a sense of expansion to the listener.

2. A sound field controller according to claim 1, wherein the signal processing means includes:

direct sound processing means for receiving the digital signal and generating a direct sound signal by which a sound image of a direct sound is localized in a direction toward a sound source;

reflection sound processing means including delay means for receiving the digital signal and delaying the digital signal in accordance with a reflection time of a reflection sound, and means for generating a reflection sound signal by which a sound image of the reflection sound is localized in a direction in which the reflection sound is reflected; and adding means for adding the direct sound signal to the reflection sound signal.

3. A sound field controller according to claim 2, wherein the means for generating a reflection sound signal includes filter means, and the parameter control means sets a delay time in the delay means and filter coefficients for the filter means, based on the position of the sound image and the distance from the listener.

4. A sound field controller according to claim 2, wherein the signal processing means further includes summation ratio control means for continuously changing ratios of the direct sound signal and the reflection sound signal to be added.

5. A sound field controller according to claim 2, wherein the signal processing means further includes reverberation sound generating means for adding a reverberation sound to a signal output from the adding means, the conditions input from the input means further includes an expansion of a sound field, and the parameter control means sets a parameter for the reverberation sound generating means based on the expansion of the sound field.

6. A sound field controller according to claim 2, wherein the signal processing means includes frequency characteristic control means for changing frequency characteristics of the direct sound signal and the reflection sound signal.

7. A sound field controller according to claim 6, wherein the signal processing means further includes summation ratio control means for continuously changing summation ratios of the direct sound signal and the reflection sound signal to be added.

8. A sound field controller according to claim 6, wherein the conditions include a side reflection angle which is formed by a direction of a reflection sound which reaches the listener after being emitted from a sound source and then reflected from a Hall of an audio space with respect to a direction from the sound source to the listener, and the parameter control means converts the side reflection angle into a parameter of a position of a listener and/or a parameter of a position of a sound image, and inputs the parameter into the signal processing means.

9. A sound field controller according to claim 1, wherein the conditions input from the input means includes the position of the sound image, the distance from the listener, and an expansion of a sound field, and the signal processing means includes:

direct sound processing means for receiving the digital signal and generating a direct sound signal by which a sound image of a direct sound is localized in a direction toward a sound source;

reflection sound processing means including delay means for receiving the digital signal and delaying the digital signal in accordance with a reflection time of a reflection sound, and means for generating a reflection sound signal by which a sound image of the reflection sound is localized in a direction in which the reflection sound is reflected;

summation ratio control means for adding the direct sound signal to the reflection sound signal by continuously changing summation ratios thereof, and outputting a sum signal; and reverberation sound generating means for adding a reverberation sound to the sum signal output from the summation ratio control means.

10. A sound field controller according to claim 1, wherein the input means is parameter receiving means for receiving sound field control signals supplied from the outside of the sound field controller.

11. A sound field controller according to claim 1, wherein the signal processing means includes:

direct sound processing means for receiving the digital signal and generating a direct sound signal;

reflection sound processing means including a plurality of delay means for receiving and delaying the digital signal in accordance with respective reflection times of a plurality of reflection sounds and generating a plurality of delay signals, and means for outputting reflection sound signals by adjusting respective gains for the delay signals; and adding means for adding the direct sound signal to the reflection sound signals.

12. A sound field controller according to claim 1, wherein the parameter control means stores a plurality of values of the parameters for localizing the sound image at a respective position in a respective direction with respect to the listener, and selects respective values of the parameters which satisfy the input conditions from among the plurality of values stored in the storing means.

13. A sound field control method for reproducing a sound field, comprising the steps of:

converting an input audio signal into a digital signal;

processing the digital signal using predetermined parameters, thereby generating a sound signal;

setting conditions including a position of a sound image to be localized, a distance between the sound image and a listener, and a spatial size of the sound field;

controlling the parameters used in the signal processing step based on the conditions provided in the condition setting step, whereby the sound signal generated in the processing step has characteristics corresponding to the conditions;

converting the sound signal into an analog signal; and amplifying and reproducing the analog signal, thereby generating a sound field providing a distance perspective in accordance with the position of the sound image with respect to the listener and a sense of expansion to the listener.

14. A sound field control method according to claim 13, wherein the signal processing step includes the steps of:

processing the digital signal so as to generate a direct sound signal for localizing a sound image of a direct sound in a direction toward a sound source;

delaying the digital signal in accordance with a reflection time of a reflection sound, and processing the delayed digital signal so as to generate a reflection sound signal for localizing a sound image of the reflection sound in a direction in which the reflection sound is reflected; and adding the direct sound signal and the reflection sound signal.

15. A sound field control method according to claim 14, wherein the step of generating a reflection sound signal includes a filtering step, and the step of controlling the parameters includes a step of setting a delay time of the digital signal and a step of setting filter coefficients for the filtering step, based on the position of the sound image and the distance from the listener.

16. A sound field control method according to claim 14, wherein the signal processing step further includes a step of continuously changing summation ratios of the direct sound signal and the reflection sound signal to be added.

17. A sound field control method according to claim 14, wherein the signal processing step further includes a step of adding a reverberation sound to a sum signal generated in the adding step, the conditions further includes an expansion of a sound field, and the parameter control step further includes a step of setting a parameter for the step of adding a reverberation sound based on the expansion of the sound field.

18. A sound field control method according to claim 14, wherein the signal processing step further includes a step of controlling frequency characteristics of the direct sound signal and the reflection sound signal.

19. A sound field control method according to claim 18, wherein the signal processing step further includes a step of continuously changing summation ratios of the direct sound signal and the reflection sound signal to be added.

20. A sound field control method according to claim 18, wherein the conditions include a side reflection angle which is formed by a direction of a reflection sound which reaches the listener after being emitted from a sound source and then reflected from a wall of an audio space with respect to a direction from the sound source to the listener, and in the step of controlling the parameters, the side reflection angle is converted into a parameter of a position of a listener and/or a parameter of a position of a sound image.

21. A sound field control method according to claim 13, wherein the conditions includes the position of the sound image, the distance from the listener, and an expansion of a sound field, and the signal processing step includes the steps of:

processing the digital signal so as to generate a direct sound signal for localizing a sound image of a direct sound in a direction toward a sound source;

delaying the digital signal in accordance with a reflection time of a reflection sound, and processing the delayed digital signal so as to generate a reflection sound signal for localizing a sound image of the reflection sound in a direction in which the reflection sound is reflected;

adding the direct sound signal and the reflection sound signal by continuously changing summation ratios thereof, and outputting a sum signal; and adding a reverberation sound signal to the sum signal in accordance with the expansion of the sound field.

22. A sound field control method according to claim 13, wherein the step of setting the conditions includes a step of receiving sound field control signals supplied from the outside of the sound field controller and a step of determining conditions based on the control signals.

23. A sound field control method according to claim 13, wherein the signal processing step includes the steps of:

processing the digital signal so as to generate a direct sound signal;

delaying the digital signal in accordance with respective reflection times of a plurality of reflection sounds, generating a plurality of delay signals, and adjusting respective gains for the delay signals so as to generate reflection sound signals; and adding the direct sound signal and the reflection sound signals.

24. A sound field control method according to claim 13, wherein the parameter controlling step includes:

storing a plurality of values of the parameters for localizing the sound image at a respective position in a respective direction with respect to the listener; and selecting values of the parameters which satisfy the conditions from among the stored plurality of values of the parameters.

* * * * *

UNITED STATES PATENT AND TRADE MARK OFFICE

CERTIFICATE OF CORRECTION

PATENT NO. : 5,742,688
DATED : April 21, 1998
INVENTOR(S) : Ogawa et al.

It is certified that error appears in the above-identified patent and that said Letters Patent is hereby corrected as shown below:

Column 39, line 12, "Hall" should be --wall--.

Signed and Sealed this

First Day of December, 1998

*Attest:*

*Attesting Officer*

Bruce Lehman

BRUCE LEHMAN

*Commissioner of Patents and Trademarks*